US012156622B2

(12) United States Patent
Zheng et al.

(10) Patent No.: US 12,156,622 B2
(45) Date of Patent: Dec. 3, 2024

(54) BASE STATION, AND ROBOT CLEANING SYSTEM AND CONTROL METHOD THEREFOR

(71) Applicant: Positec Power Tools (Suzhou) Co., Ltd, Jiangsu (CN)

(72) Inventors: Yue Zheng, Jiangsu (CN); Jianqiang Xu, Jiangsu (CN); Shisong Zhang, Jiangsu (CN); Hongfeng Zhong, Jiangsu (CN); Yimin Sun, Jiangsu (CN)

(73) Assignee: Positec Power Tools (Suzhou) Co., Ltd, Jiangsu (CN)

( * ) Notice: Subject to any disclaimer, the term of this patent is extended or adjusted under 35 U.S.C. 154(b) by 361 days.

(21) Appl. No.: 17/608,979

(22) PCT Filed: Apr. 30, 2020

(86) PCT No.: PCT/CN2020/088339
§ 371 (c)(1),
(2) Date: Nov. 4, 2021

(87) PCT Pub. No.: WO2020/224542
PCT Pub. Date: Nov. 12, 2020

(65) Prior Publication Data

US 2022/0211241 A1 Jul. 7, 2022

(30) Foreign Application Priority Data

May 5, 2019 (CN) ..... 201910369193.0
Aug. 8, 2019 (CN) ..... 201910729481.2
(Continued)

(51) Int. Cl.
*A47L 11/40* (2006.01)
*A47L 11/28* (2006.01)

(52) U.S. Cl.
CPC ..... *A47L 11/4091* (2013.01); *A47L 11/28* (2013.01); *A47L 11/4011* (2013.01); *A47L 11/4036* (2013.01); *A47L 2201/028* (2013.01)

(58) Field of Classification Search
None
See application file for complete search history.

(56) References Cited

U.S. PATENT DOCUMENTS 5,959,423 A 9/1999 Nakanishi et al.
9,717,388 B2 8/2017 Jeong et al.
(Continued)

FOREIGN PATENT DOCUMENTS

BR 0910450 A2 7/2016
CN 2681215 Y 2/2005
(Continued)

OTHER PUBLICATIONS

English Machine Translation of CN-107951448-A.*
(Continued)

*Primary Examiner* — Mikhail Kornakov
*Assistant Examiner* — Pradhuman Parihar
(74) *Attorney, Agent, or Firm* — Lee & Hayes, P.C.

(57) ABSTRACT

The present invention relates to a base station for a cleaning robot to park in, where the cleaning robot includes a wiping board, and a flexible wiping member replaceably butts the wiping board to form a wiping surface to wipe a working surface on which the cleaning robot walks, where the base station includes: a storage module, configured to store a continuous wiping base material; and a feeding module, configured to drive a free end of the wiping base material to be conveyed to a cutting position, to cause the free end to be cut from the wiping base material to form the wiping member. The present invention has the following beneficial effects: After returning to the base station, the cleaning robot
(Continued)

may automatically mount a wiping member without intervention by a user.

18 Claims, 43 Drawing Sheets

(30) Foreign Application Priority Data

| | | |
|---|---|---|
| Oct. 23, 2019 | (CN) | 201911011396.9 |
| Oct. 25, 2019 | (CN) | 201911023104.3 |
| Dec. 5, 2019 | (CN) | 201911233337.6 |
| Dec. 13, 2019 | (CN) | 201911281590.9 |
| Feb. 24, 2020 | (CN) | 202010112090.9 |

(56) References Cited

U.S. PATENT DOCUMENTS

| | | | | |
|---|---|---|---|---|
| 11,667,041 | B2 | 6/2023 | Kim et al. | |
| 2007/0044258 | A1 | 3/2007 | Damrath et al. | |
| 2009/0281661 | A1 | 11/2009 | Dooley et al. | |
| 2011/0153081 | A1 | 6/2011 | Romanov et al. | |
| 2011/0160903 | A1 | 6/2011 | Romanov et al. | |
| 2015/0182089 | A1* | 7/2015 | Jeong | A47L 11/4038 15/98 |
| 2016/0227975 | A1 | 8/2016 | Ebrahimi Afrouzi | |
| 2016/0316982 | A1* | 11/2016 | Kim | A47L 9/2857 |
| 2017/0297455 | A1 | 10/2017 | Romanov et al. | |
| 2020/0353822 | A1 | 11/2020 | Romanov et al. | |

FOREIGN PATENT DOCUMENTS

| | | | | | |
|---|---|---|---|---|---|
| CN | 101122811 | A | | 2/2008 | |
| CN | 102083352 | A | | 6/2011 | |
| CN | 203280338 | U | | 11/2013 | |
| CN | 103533813 | A | | 1/2014 | |
| CN | 104545732 | | | 4/2014 | |
| CN | 203506628 | | | 4/2014 | |
| CN | 203506628 | U | | 4/2014 | |
| CN | 203539248 | | | 4/2014 | |
| CN | 203539248 | U | | 4/2014 | |
| CN | 104248395 | A | | 12/2014 | |
| CN | 104545710 | A | | 4/2015 | |
| CN | 104545732 | A | | 4/2015 | |
| CN | 205433581 | U | | 8/2016 | |
| CN | 106859512 | | | 6/2017 | |
| CN | 106859512 | A | | 6/2017 | |
| CN | 106889955 | | | 6/2017 | |
| CN | 106889955 | A | | 6/2017 | |
| CN | 206312061 | U | | 7/2017 | |
| CN | 206462947 | | | 9/2017 | |
| CN | 206462947 | U | | 9/2017 | |
| CN | 107479677 | A | | 12/2017 | |
| CN | 107550406 | | | 1/2018 | |
| CN | 107550406 | A | | 1/2018 | |
| CN | 107951448 | | | 4/2018 | |
| CN | 107951448 | A | * | 4/2018 | A47L 11/24 |
| CN | 107979962 | A | | 5/2018 | |
| CN | 108459685 | A | | 8/2018 | |
| CN | 207755219 | | | 8/2018 | |
| CN | 207755219 | U | | 8/2018 | |
| CN | 207911224 | U | | 9/2018 | |
| CN | 207960762 | U | | 10/2018 | |
| CN | 108742350 | A | | 11/2018 | |
| CN | 3422835 | A1 | | 1/2019 | |
| CN | 208367593 | U | | 1/2019 | |
| CN | 110174933 | A | | 8/2019 | |
| CN | 210348382 | U | | 4/2020 | |
| CN | 110123216 | B | | 11/2020 | |
| CN | 112704440 | A | | 4/2021 | |
| CN | 112971630 | A | | 6/2021 | |
| CN | 113287977 | A | | 8/2021 | |
| EP | 2303085 | A1 | | 4/2011 | |
| EP | 2918212 | A1 | | 9/2015 | |
| EP | 3311722 | A2 | | 4/2018 | |
| KR | 1020110026414 | A | | 3/2011 | |
| WO | 2009132317 | A1 | | 10/2009 | |
| WO | WO2018107465 | | | 6/2018 | |
| WO | 2021104689 | A1 | | 6/2021 | |

OTHER PUBLICATIONS

English Translation of Chinese Office Action for Chinese applciation No. 201910480864, dated Jan. 30, 2024, 6 pages.

English Translation of Chinese Office Action for Chinese application No. 201910480864, dated May 22, 2024, 9 pages.

English Translation of Chinese Search Report for corresponding Chinese application No. 201910480864, dated Jan. 30, 2024, 2 pages.

English Translation of Japanese Office Action for Japanese application No. 2021565977, dated Oct. 17, 2023, 4 pages.

English Translation of PCT search report for PCT applciation No. PCT/CN2020/094151, dated Nov. 2, 2019, 2 pages.

English Translation of PCT written opinion for PCT applciation No. PCT/CN2020/094151, dated Sep. 9, 2020, 5 pages.

* cited by examiner

BASE STATION, AND ROBOT CLEANING SYSTEM AND CONTROL METHOD THEREFOR

This application is a National Stage Application of International Application No. PCT/CN2020/088339, filed on Apr. 30, 2020, which claims benefit of and priority to Chinese Patent Application No. 201910369193.0, filed on May 5, 2019, Chinese Patent Application No. 201910729481.2, filed on Aug. 8, 2019, Chinese Patent Application No. 201911011396.9, filed on Oct. 23, 2019, Chinese Patent Application No. 201911233337.6, filed on Dec. 5, 2019, Chinese Patent Application No. 201911281590.9, filed on Dec. 13, 2019, Chinese Patent Application No. 202010112090.9, filed on Feb. 24, 2020, and Chinese Patent Application No. 201911023104.3, filed on Oct. 25, 2019, all of which are hereby incorporated by reference in their entirety for all purposes as if fully set forth herein.

BACKGROUND

Technical Field

The present invention relates to a base station, and a robot cleaning system and a control method therefor, and in particular, to a robot cleaning system that can automatically replace a wiping member.

Related Art

With the development of sciences and technologies and people's continuous pursuit of higher life quality, household cleaning robots including but not limited to sweeping machines, mopping machines, and window cleaning machines are gradually widely favored by users because of being capable of helping people be emancipated from heavy housework.

A cleaning robot usually uses a wiping member (for example, tissue or wiper) to perform cleaning work, and when traveling according to a set route, the cleaning robot drives the wiping member to move on a working surface (for example, floor or glass), to implement the cleaning work. Inevitably, as the cleaning work time is lengthened, stains attached to the wiping member are growing, and the cleaning effect deteriorates. For this reason, the dirty wiping member needs to be taken down and replaced with a clean wiping member.

In an existing cleaning robot, a manner of manually replacing a wiping member is usually used, and a user needs to continuously pay attention to a cleaning work process and replace a dirtied wiping member in time. This manner requires human participation and intervention to manually replace a wiping member, and the user is prone to dirty both hands during wiping member replacement. Consequently, the experience is relatively poor.

SUMMARY

To overcome defects of the prior art, the problem that the present invention needs to resolve is to provide a cleaning robot configured to automatically replace a wiping member without intervention by a user during normal working.

In the present invention, a technical solution adopted to solve the current technical problem is as follows:

A base station for a cleaning robot to park in, wherein the cleaning robot comprises a wiping board, and a flexible wiping member replaceably butts the wiping board to form a wiping surface to wipe a working surface on which the cleaning robot walks, the base station comprises: a storage module, configured to store a continuous wiping base material; and a feeding module, configured to drive a free end of the wiping base material to be conveyed to a cutting position, to cause the free end to be cut from the wiping base material to form the wiping member.

Another technical solution adopted in the present invention to resolve the problem in the prior art is as follows:

A control method for a robot cleaning system, wherein the robot cleaning system comprises a cleaning robot and a base station for the cleaning robot to park in, the cleaning robot comprises a wiping board, for a flexible wiping member to replaceably butt to form a wiping surface to wipe a working surface, wherein the method comprises: conveying a free end of a continuous wiping base material to a cutting position; cutting the free end from the wiping base material to form the wiping member; and mounting the wiping member on the wiping board.

In a feasible solution, the control method further includes: separating the wiping member from the wiping board.

In a feasible solution, the control method further includes: separating the wiping board from the cleaning robot before the separating the wiping member from the wiping board.

In a feasible solution, the control method further includes: driving, before the separating the wiping member from the wiping board, the wiping board separated from the cleaning robot to move to a wiping member operating position.

In a feasible solution, the control method further includes: mounting the wiping board in the cleaning robot after the mounting the wiping member on the wiping board.

In a feasible solution, the control method further includes: moving, by the cleaning robot, a preset distance in a first direction after the separating the wiping board from the cleaning robot.

In a feasible solution, the control method further includes: mounting the wiping board in the cleaning robot after the moving, by the cleaning robot, a preset distance in a first direction.

In a feasible solution, after the wiping member is mounted on the wiping board, the cleaning robot moves the preset distance in a second direction, and the wiping board is mounted in the cleaning robot, wherein the first direction and the second direction are opposite.

Another technical solution adopted in the present invention to resolve the problem in the prior art is as follows:

A robot cleaning system, comprising a cleaning robot and a base station for the cleaning robot to park in, the cleaning robot comprises: a main body; a movable module, mounted on the main body and configured to drive the cleaning robot to move on a working surface; and a wiping board, mounted on the main body, for a flexible wiping member to detachably butt to form a wiping surface to wipe the working surface; the wiping board comprises a loading portion, configured to fix the wiping member; and the base station comprises: a storage module, configured to store a continuous wiping base material; a feeding module, configured to convey a free end of the wiping base material to a cutting position, to cause the free end to be cut from the wiping base material to form the wiping member; and an operating module, mounted on the main body or the base station and configured to act on the wiping board and/or the wiping member, to cause the wiping member to be combined with the loading portion of the wiping board.

In a feasible solution, the base station includes a wiping member operating position, used for receiving the wiping member to be mounted on the wiping board.

In a feasible solution, the cutting position is in the wiping member operating position or between the feeding module and the wiping member operating position.

In a feasible solution, the base station includes a cutting module, configured to act on the wiping base material between the storage module and the cutting position and cut the free end from the wiping base material to form the wiping member.

In a feasible solution, at least based on that the free end of the wiping base material reaches the cutting position, the feeding module locks the wiping base material on at least one side of a weak connection point of the wiping base material, to cause the free end to be cut from the wiping base material through stretching at the weak connection point.

In a feasible solution, the feeding module intermittently clamps the wiping base material.

In a feasible solution, the feeding module includes a delivery wheel, and an outer contour of the delivery wheel includes at least two curvatures, to cause a surface of the delivery wheel to intermittently come into contact with the wiping base material.

In a feasible solution, the feeding module is at least partially higher than the wiping member operating position, to cause the free end of the wiping base material to be at least partially conveyed to the wiping member operating position based on gravity.

In a feasible solution, the wiping member operating position extends in a substantially vertical direction, to cause the wiping member to expand under a gravity action.

In a feasible solution, the base station includes a limit device, configured to detect a position of the wiping member, to cause the feeding module to convey the wiping member to the wiping member operating position.

In a feasible solution, the wiping base material is wound around a rotatable shaft, and the storage module includes a mounting rack cooperating with the rotatable shaft, to cause the rotatable shaft to be mounted in the base station.

In a feasible solution, the mounting rack includes a first state of keeping the rotatable shaft mounted and a second state of allowing the rotatable shaft to be detached.

In a feasible solution, the base station includes an operating module, configured to act on the wiping member and/or the wiping board, to cause the wiping member to be combined with a loading portion of the wiping board.

In a feasible solution, the operating module is configured to act on the wiping member and/or the wiping board, to cause the wiping member to be separated from the loading portion of the wiping board.

In a feasible solution, the operating module is detachably mounted in the base station.

In a feasible solution, the base station includes a wiping board operating position, for the cleaning robot to mount or separate the wiping board.

In a feasible solution, the wiping member operating position is higher than the wiping board operating position, to form a space for the cleaning robot to park in.

In a feasible solution, the base station includes a driving module, configured to drive the wiping board to move between the wiping board operating position and the wiping member operating position.

In a feasible solution, the wiping member operating position includes a wiping member mounting position and a wiping member separating position, for the wiping board to separate or mount the wiping member, and the driving module is configured to drive the wiping board to move and/or rotate in a substantially horizontal direction to cause the wiping board to move to the wiping member mounting position or the wiping member separating position.

In a feasible solution, the base station includes a receiving module, configured to receive the wiping member separated from the wiping board.

In a feasible solution, the base station includes a separating module, configured to act on the wiping member and/or the wiping board, to cause the wiping member to be separated from a loading portion of the wiping board.

In a feasible solution, the receiving module is located in a moving direction of the wiping board, to cause a wiping member to compress, when moving to the separating module, the wiping member in the receiving module.

In a feasible solution, in at least one state, an opening of the receiving module for receiving the wiping member is at least partially lower than the wiping member operating position, to cause the wiping member to be recycled to the receiving module at least partially based on a gravity action.

In a feasible solution, the receiving module is detachably mounted in the base station.

In a feasible solution, a communication module is disposed on each of the base station and the cleaning robot, and the base station communicates with the cleaning robot to cause the base station and the cleaning robot to collaboratively replace the wiping member.

In a feasible solution, the base station comprises a charging module, for the cleaning robot to be charged when docking with the base station.

Compared with the prior art, the beneficial effects of the present invention are as follows: The base station continuously outputs the wiping base material, and cuts the free end of the outputted wiping base material to form the wiping member, for the wiping board to mount, to enable the cleaning robot to completely automatically replace the wiping member in the base station. Based on that the existing cleaning robot automatically returns to the base station for charging, the cleaning robot in this solution automatically returns to the base station to replace the wiping member. Compared with the conventional cleaning robot, after the cleaning robot wipes a surface, the user neither needs to replace the wiping member nor needs to much intervene in the base station and the cleaning robot, but only needs to mount the continuous wiping base material to the base station and throw away the used wiping member separated from the cleaning robot.

BRIEF DESCRIPTION OF THE DRAWINGS

The foregoing objects, technical solutions, and beneficial effects of the present invention can be implemented with reference to the accompanying drawings below:

FIG. 41A to FIG. 43A are diagrams of a process in which an operating module mounts a wiping member for a cleaning module;

FIG. 41B to FIG. 43B are side views of FIG. 41A to FIG. 43A respectively;

FIG. 41C to FIG. 43C are cross-sectional views of FIG. 41A to FIG. 43A respectively;

DETAILED DESCRIPTION

By means of technical solutions provided in embodiments of the present invention, a cleaning robot can automatically replace a wiping member during wiping member replacement without intervention by a user, so that the wiping member replacement is more automated and intelligent, and a user has a better use experience.

Figure 1:
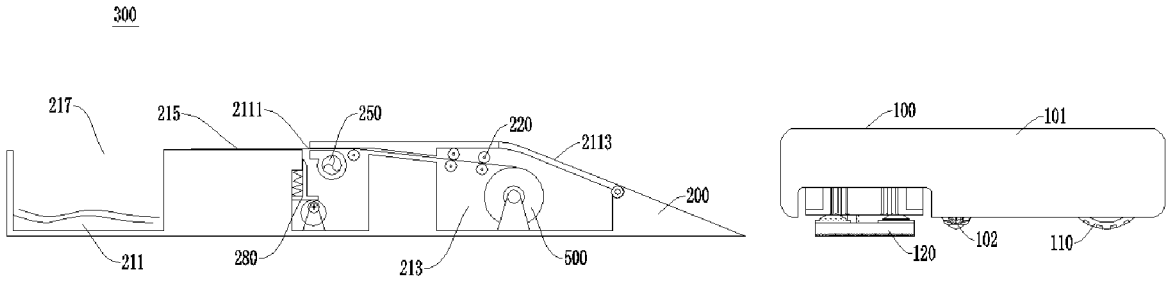
FIG. 1 to FIG. 3 are schematic structural diagrams of a first feasible solution of a cleaning system according to a first embodiment of the present invention.
Figure 63:
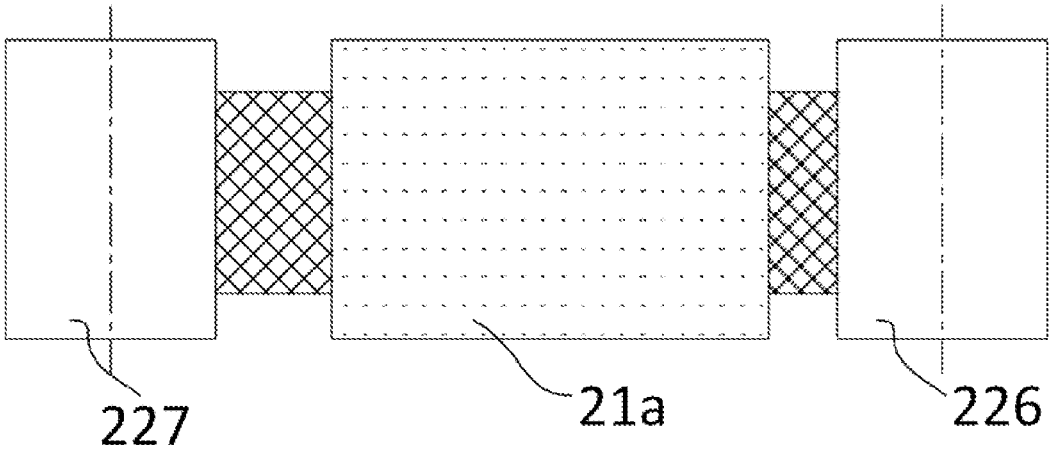
FIG. 63 is a schematic diagram of a structure in which a base belt moves a new cleaning member to a wiping member operating position.

As shown in FIG. 1 to FIG. 63, an automatic cleaning system 300 includes a cleaning robot 100 and a base station 200. The cleaning robot 100 includes a main body 101 and a wiping board (122, 1201) mounted on the main body 101, and a flexible wiping member butts the wiping board (122, 1201) to form a wiping surface, so that when the cleaning robot 100 moves on a working surface, the wiping surface can act on the working surface to perform wiping.

Figure 14:
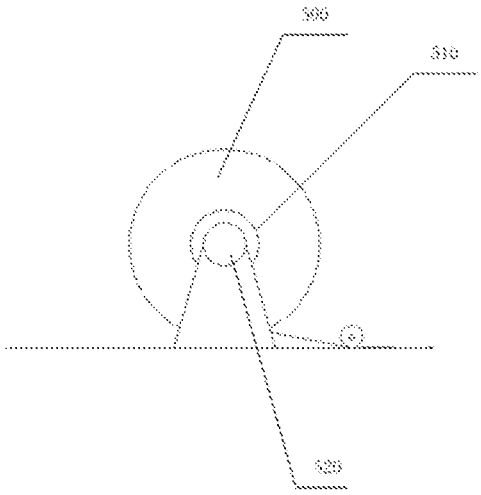
FIG. 14 is a schematic structural diagram of a feasible solution of mounting a wiping base material 500 in the base station.

In a feasible manner, as shown in FIG. 1 and FIG. 14, the base station 200 includes a storage module (213, 520), configured to store a wiping base material 500. The base station 200 includes a feeding module (220, 421), and the feeding module (220, 421) is configured to convey a free end of the wiping base material 500 to a cutting position, to cut the free end from the body of the wiping base material 500, to form the wiping member.

Figure 19:
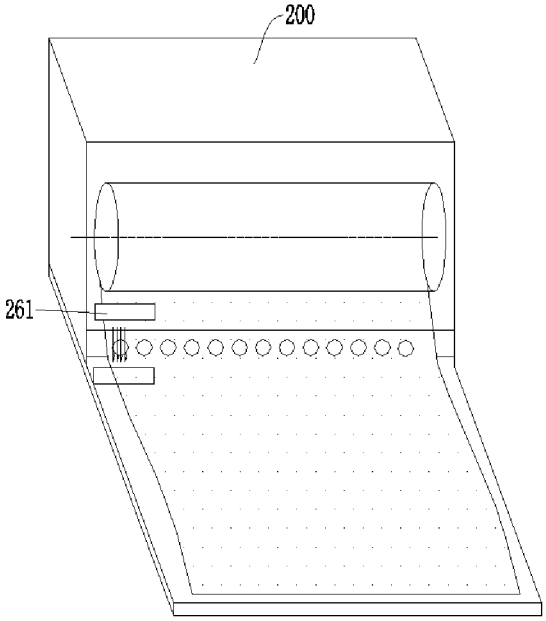
FIG. 19 is a schematic structural diagram of a ninth feasible solution of the base station.
Figure 23:
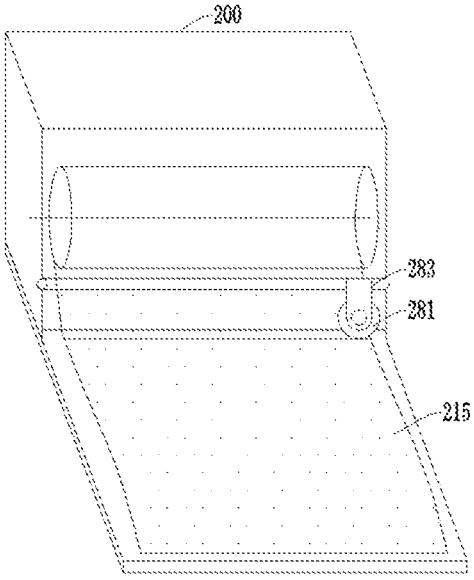
FIG. 23 is a schematic structural diagram of a twelfth feasible solution of the base station.

In a feasible manner, a length and a width of the wiping member are related to a length and a width of the wiping board (122, 1201), and both the length and the width of the wiping member are usually greater than those of the wiping board (122, 1201). The wiping member is obtained by cutting the free end of the wiping base material 500 from the body of the wiping base material 500. Optionally, as shown in FIG. 19, the wiping base material 500 is formed by connecting several wiping members with a standard length, and a connection strength between the wiping members is relatively small. For example, a plurality of spaced holes is set between the wiping members, so that weak connection points with a relatively weak connection strength exist between the wiping members, and when two sides of the weak connection points are stressed and stretched, a wiping member can be cut from the wiping base material 500. Optionally, as shown in FIG. 23, the wiping base material 500 may be made of a flexible material whose length is far greater than that of the wiping member and that has no weak connection point that is set intermediately. After the wiping base material 500 is mounted on the base station 200, the free end of the wiping base material 500 is cut from the body of the wiping base material 500 through a cutting module 280 of the base station 200 to obtain the wiping member.

In a feasible manner, as shown in FIG. 14, one end of the wiping base material 500 is fixed to a rotatable shaft 510, and the wiping base material 500 is wound around the rotatable shaft 510 with the one end as a start point. The storage module 520 includes a mounting rack, the mounting rack is mounted on the base station 200, and the mounting rack matches the rotatable shaft 510 wound around the wiping base material 500, to enable the rotatable shaft 510 to be mounted on the mounting rack. Optionally, the rotatable shaft 510 can rotate relative to the mounting rack, and when the free end of the wiping base material 500 is stressed under the action of the feeding module (220, 421), the wiping base material 500 drives the rotatable shaft 510 to rotate relative to the mounting rack, thereby conveying the free end of the wiping base material 500 to a far place. Optionally, the rotatable shaft 510 is mounted on the mounting rack and fixed relative to the mounting rack, and a part of the mounting rack connected to the rotatable shaft 510 may rotate under the driving of the feeding module (220, 421), thereby driving the rotatable shaft 510 to rotate, to convey the free end of the wiping base material 500 to a far place. In this manner, the feeding module (220, 421) includes a motor configured to drive the mounting rack to rotate.

In a feasible manner, the mounting rack includes a first state and a second state, and when the mounting rack is in the first state, the rotatable shaft 510 can be kept in a mounted state and prevented from being detached from the mounting rack; and when the user needs to mount or detach the rotatable shaft 510, the mounting rack is in the second state, to enable the rotatable shaft 510 to be detached from the mounting rack. Optionally, the mounting rack includes a first rack and a second rack disposed oppositely and cooperating with a left end and a right end of the rotatable shaft 510 respectively. When the mounting rack is in the first state, a relative distance between the first rack and the second rack is relatively short. When the mounting rack is in the second state, a relative distance between the first rack and the second rack is relatively long. In a feasible manner, the first state of the mounting rack is a state of being mounted on the base station, the second state is a detached state, and when the mounting rack is in the detached state, the rotatable shaft 510 may be mounted on the mounting rack, or the rotatable shaft 510 may be detached from the mounting rack.

Figure 46A:
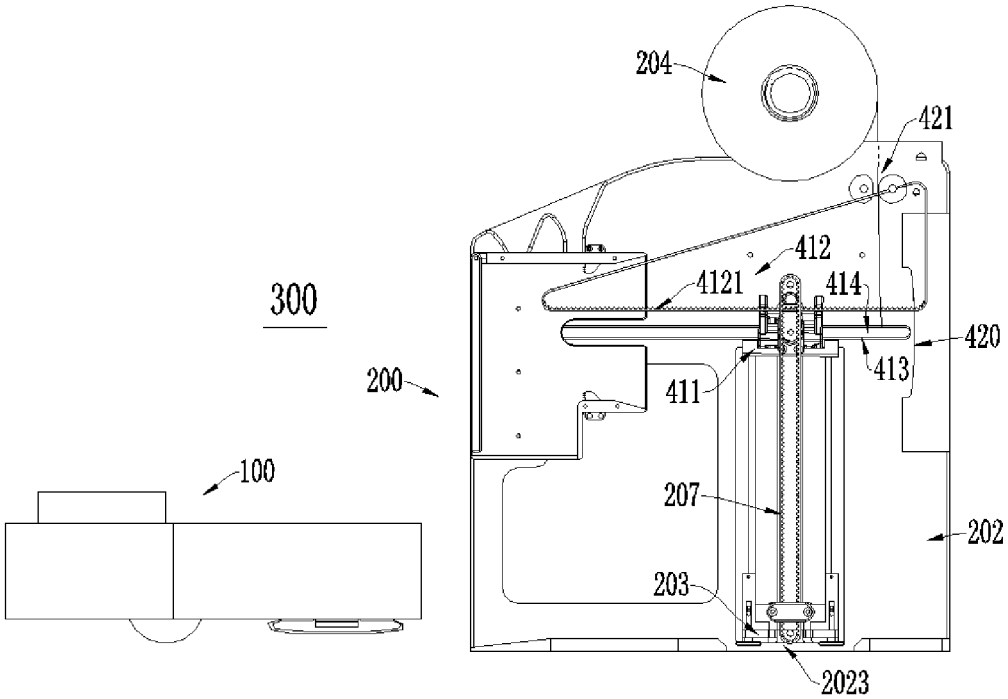
FIG. 46A to FIG. 46L are diagrams of a process in which the base station of the third feasible solution replaces a wiping member for a cleaning robot according to the second embodiment of the present invention.
Figure 46B:
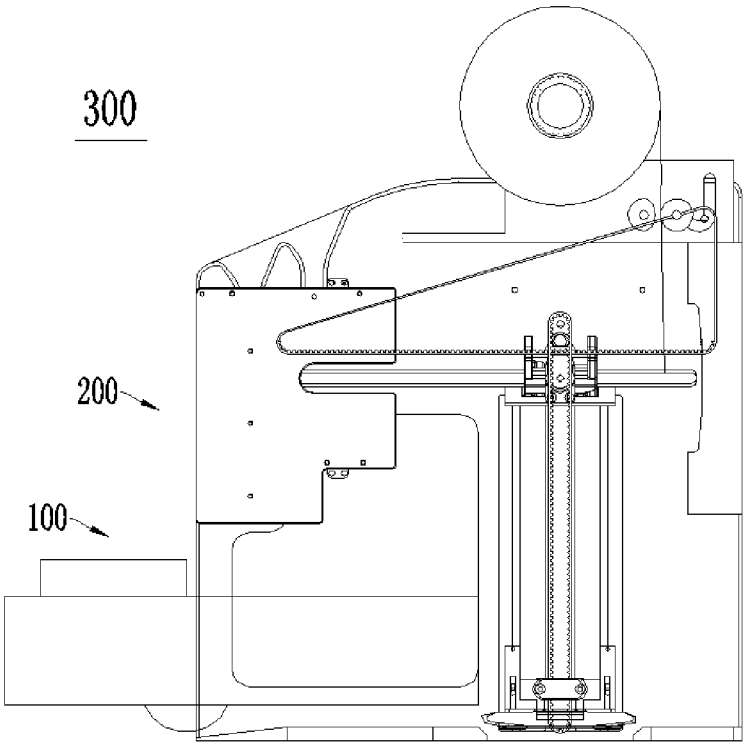
Figure 46C:
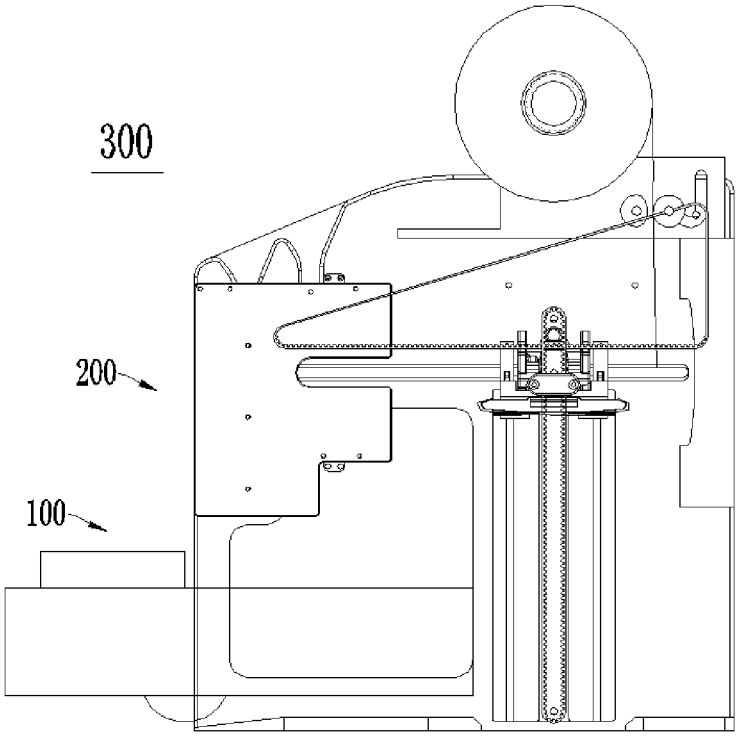
Figure 46D:
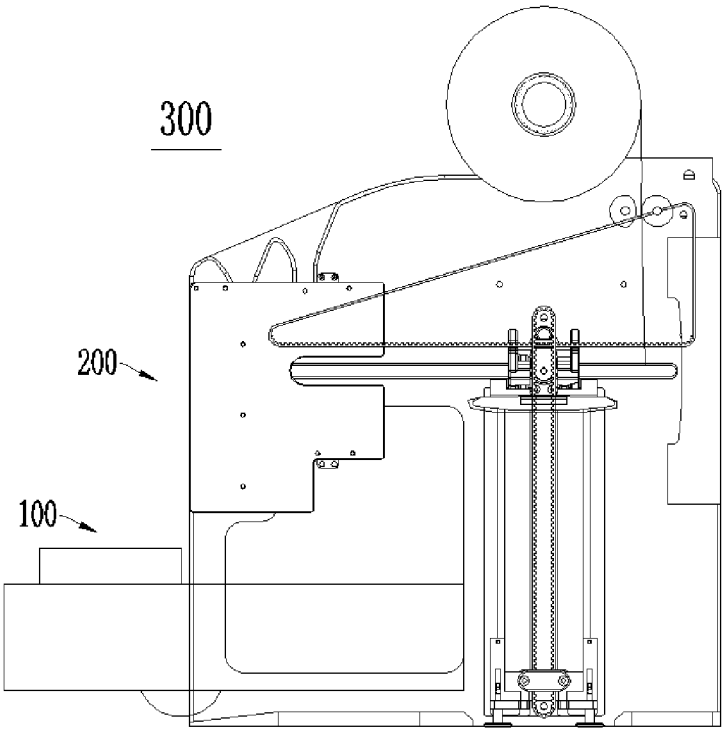

The base station 200 includes a wiping member operating position (2021, 2022, 215, 217, 218, 13, 4221, 420), for the wiping board (122, 1201) to mount or separate the wiping member. In a feasible manner, the cutting position includes a wiping member operating position (2021, 2022, 215, 217, 218, 13, 4221, 420). As shown in FIG. 46I, the feeding module (220, 421) conveys the free end of the wiping base material 500 to the wiping member operating position 420, and locks the free end on a side of the weak connection point of the wiping base material 500. In a process in which the wiping base material 500 is mounted on the wiping board (122, 1201), a tensile force is generated between the free end of the wiping base material 500 and the body of the wiping base material 500, thereby cutting the body of the wiping base material 500 on the side of the weak connection point of the wiping base material 500 from the free end of the wiping base material 500 on another side of the wiping base material 500, to form the wiping member. Optionally, after the free end of the wiping base material 500 reaches the wiping member operating position (2021, 2022, 215, 217, 218, 13, 4221, 420), the cleaning robot 100 mounts the free end of the wiping base material 500 on the wiping board (122, 1201); and when the cleaning robot 100 moves, the free end of the wiping base material 500 together with the wiping board (122, 1201) is stretched relative to the body of the wiping base material 500, thereby being cut from the wiping base material 500.

In a feasible manner, as shown in FIG. 46I, the feeding module (220, 421) conveys the free end of the wiping base material 500 to the wiping member operating position (2021, 2022, 215, 217, 218, 13, 4221, 420), and then stops conveying the free end. After the free end of the wiping base material 500 is fixed in the wiping member mounting position (2021, 2022, 215, 217, 218, 13, 4221, 420), the feeding module (220, 421) stretches the wiping base material 500 in an opposite direction, to cut the body of the wiping base material 500 on the side of the weak connection point of the wiping base material 500 from the free end of the wiping base material 500 on another side of the wiping base material 500, to form the wiping member.

In a feasible manner, as shown in FIG. 1, the base station 200 includes a cutting module 280, configured to act on the wiping base material 500 to cut the wiping base material. Optionally, the cutting module 280 may include a device, such as a metal blade or plastic blade, configured to generate an action force on the wiping base material 500 to separate the wiping base material. The feeding module (220, 421) conveys the free end of the wiping base material 500 to the wiping member operating position, and then stops conveying the free end to the wiping member operating position (2021, 2022, 215, 217, 218, 13, 4221, 420). After the free end of the wiping base material 500 in the wiping member operating position (2021, 2022, 215, 217, 218, 13, 4221, 420) and the body of the wiping base material 500 are separately locked, the cutting module 280 acts on the wiping base material 500 to cut the wiping base material, to form the wiping member. Optionally, the cutting module 280 may alternatively include a laser knife or another device configured to generate no action force on the wiping base material 500 to separate the wiping base material. The feeding module (220, 421) conveys the free end of the wiping base material 500 to the wiping member operating position (2021, 2022, 215, 217, 218, 13, 4221, 420), and then stops conveying the free end. After the wiping base material 500 is stopped from being conveyed, the cutting module 280 cuts the free end of the wiping base material 500 from the body of the wiping base material 500.

In a feasible manner, the cutting position includes an intermediate position between the feeding module (220, 421) and the wiping member operating position, and before the feeding module (220, 421) conveys the free end of the wiping base material 500 to the wiping member operating position (2021, 2022, 215, 217, 218, 13, 4221, 420), the free end of the wiping base material 500 is first cut from the body of the wiping base material 500 to form the wiping member, and the feeding module (220, 421) then conveys the wiping member to the wiping member operating position (2021, 2022, 215, 217, 218, 13, 4221, 420).

In a feasible manner, the feeding module (220, 421) includes a delivery wheel (2041, 278), and optionally two delivery wheels (2041, 278) perform clamping, to convey the clamped wiping base material 500 outward during rotation. The wiping base material 500 is flexible. Therefore, if the wiping base material 500 has a wrinkle formed, in a process in which the delivery wheels (2041, 278) continuously clamp the wiping base material 500 to perform rotation, the wrinkle cannot be unfolded. As a result, the wiping member formed after the free end of the wiping base material 500 is cut also keeps a specific wrinkle morphology, and consequently the wiping member cannot be mounted on the wiping board in a straightly unfolded state. Therefore, the delivery wheels (2041, 278) intermittently clamp the wiping base material 500, to cause the wiping base material 500 to be not stressed intermittently during motion and be naturally flattened. Optionally, the outer contour of the delivery wheel (2041, 278) includes at least two curvatures, for example, ellipse, to cause the delivery wheel (2041, 278) to be pressed sometimes and separated sometimes during rotation. Optionally, the delivery wheel (2041, 278) intermittently automatically separates, to cause the delivery wheel (2041, 278) to be separated from another surface in contact with the delivery wheel. Optionally, to prevent the free end of the wiping base material 500 from dropping when the feeding module (220, 421) is separated, the storage module (213, 520) may be provided with a damper, or the delivery wheel (2041, 278) may be provided with a damper.

Figure 37A:
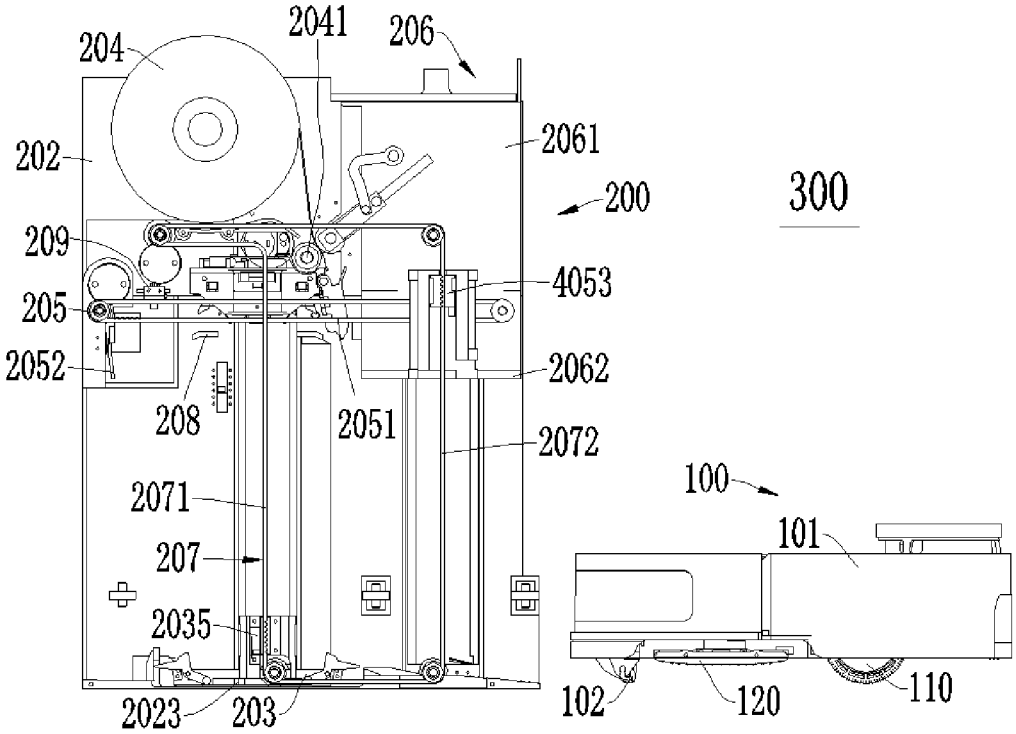
FIG. 37A to FIG. 37L are diagrams of a process in which the base station of the first feasible solution replaces a wiping member for a cleaning robot according to a second embodiment of the present invention.

In a feasible manner, as shown in FIG. 1 and FIG. 37A, the feeding module (220, 421) is at least partially higher than the wiping member operating position. Because the feeding module (220, 421) conveys the free end of the wiping base material 500 to the wiping member operating position (2021, 2022, 215, 217, 218, 13, 4221, 420), when the feeding module (220, 421) is higher than the wiping member operating position (2021, 2022, 215, 217, 218, 13, 4221, 420), the wiping base material 500 can move to the wiping member operating position (2021, 2022, 215, 217, 218, 13, 4221, 420) partially in dependence on gravity.

Figure 44A:
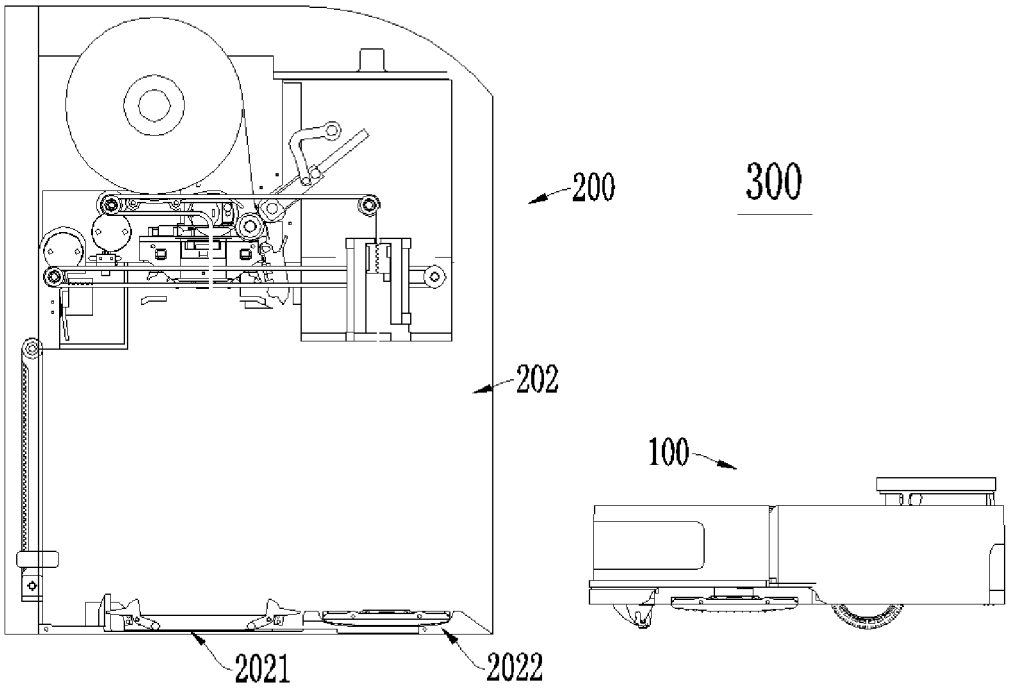
FIG. 44A to FIG. 44I are diagrams of a process in which the base station of the second feasible solution replaces a wiping member for a cleaning robot according to the second embodiment of the present invention.

In a feasible manner, as shown in FIG. 44A, the wiping member operating position (2021, 2022, 215, 217, 218, 13, 4221, 420) extends in a substantially vertical direction. Based on that the feeding module (220, 421) is higher than the wiping member operating position (2021, 2022, 215, 217, 218, 13, 4221, 420), as long as the feeding module (220, 421) outputs the wiping base material 500 outward, the wiping base material 500 can naturally expand in the wiping member operating position in dependence on gravity, and it is not required that another device changes the moving direction of the wiping base material 500 to cause the moving direction to correspond to the extending direction of the wiping member operating position (2021, 2022, 215, 217, 218, 13, 4221, 420).

In a feasible manner, the base station 200 includes a limit module, configured to detect the position of the wiping member, to enable the wiping member to be cut with a substantially accurate length and be conveyed to a substantially accurate position. Optionally, the limit module includes a sensor assembly 261, configured to detect an edge of the wiping member, and the sensor assembly 261 is disposed on a boundary of the wiping member mounting position. When the sensor assembly 261 has detected the edge of the wiping member, it indicates that the feeding module (220, 421) has conveyed the wiping member to the wiping member operating position, and then the feeding module (220, 421) stops conveying the wiping member outward. Optionally, the sensor assembly 261 is configured to detect a position tag of the wiping member. As shown in FIG. 19, the sensor assembly 261 is disposed at another edge of the wiping member operating position, and the sensor assembly 261 is configured to detect a position tag disposed on the wiping base material 500, for example, holes spaced at the weak connection points of the wiping base material 500. When the sensor assembly 261 has detected the position tag, it indicates that the feeding module (220, 421) has conveyed the wiping member to the wiping member operating position, and then the feeding module (220, 421) stops conveying the wiping member outward.

In a feasible manner, as shown in FIG. 4 to FIG. 8, the wiping board (122, 1201) includes a loading portion (123, 127), and by being combined with the loading portion (123, 127), the wiping member is fixed to the wiping board (122, 1201). Specifically, the loading portion (123, 127) may include a clamping structure configured to clamp at least a part of the edge of the wiping member between the loading portion (123, 127) and the wiping board (122, 1201) in a mechanical manner, or at least a part of the edge of the wiping member is fixed to the wiping board (122, 1201) by pasting the wiping member.

In a feasible manner, the automatic cleaning system 300 includes an operating module (125, 400), and the operating module (125, 400) is optionally mounted on the main body 101 of the cleaning robot 100 or mounted on the base station 200, or may be partially mounted on the main body 101 of the cleaning robot 100 and partially mounted on the base station 200. The operating module (125, 400) corresponds to the wiping member operating position (2021, 2022, 215, 217, 218, 13, 4221, 420) of the base station 200. When the wiping board (122, 1201) and the wiping member are both located at the wiping member operating position (2021, 2022, 215, 217, 218, 13, 4221, 420), the operating module (125, 400) may act on the wiping board (122, 1201) and/or the wiping member, and cooperate with the loading portion (123, 127) of the wiping board (122, 1201), to mount the wiping member on the wiping board (122, 1201). Optionally, the operating module (125, 400) is detachably mounted on the cleaning robot 100 or the base station 200, to facilitate maintenance. Optionally, the operating module (125, 400) not only may be used for mounting the wiping member on the wiping board (122, 1201), but also may be used for separating the wiping member from the wiping board (122, 1201). Optionally, as shown in FIG. 46A, the operating module (125, 400) is only used for mounting the wiping member on the wiping board (122, 1201), the base station 200 further includes a separating module 422, and the separating module 422 is configured to act on the wiping board (122, 1201) and/or the wiping member, to separate the wiping member from the wiping board (122, 1201).

Figure 51:
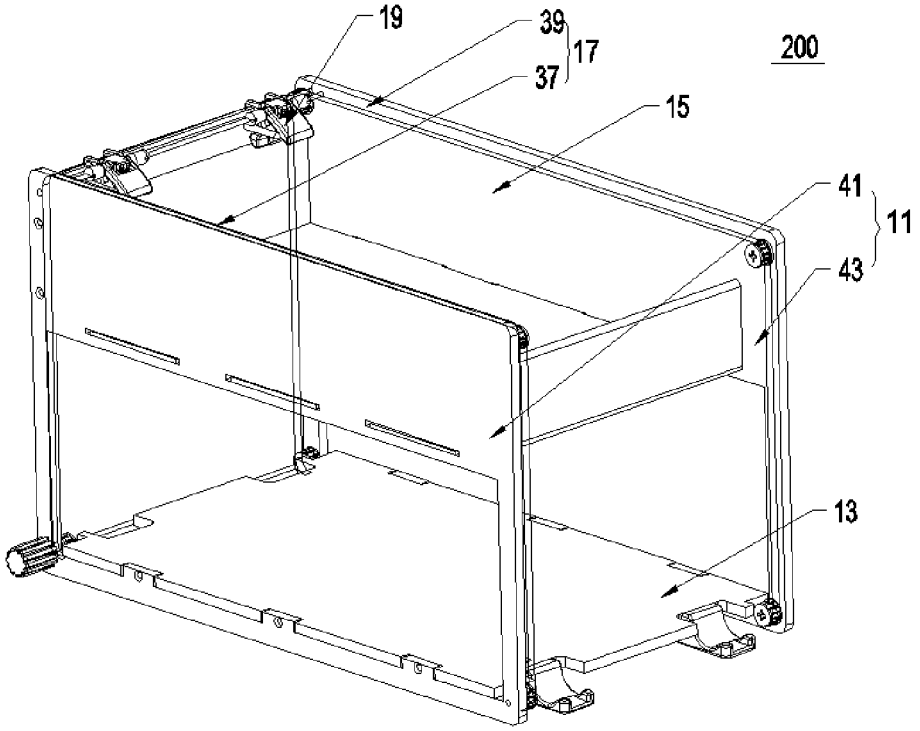
FIG. 51 is a schematic three-dimensional structural diagram of a base station according to a fourth embodiment of the present invention.
Figure 52:
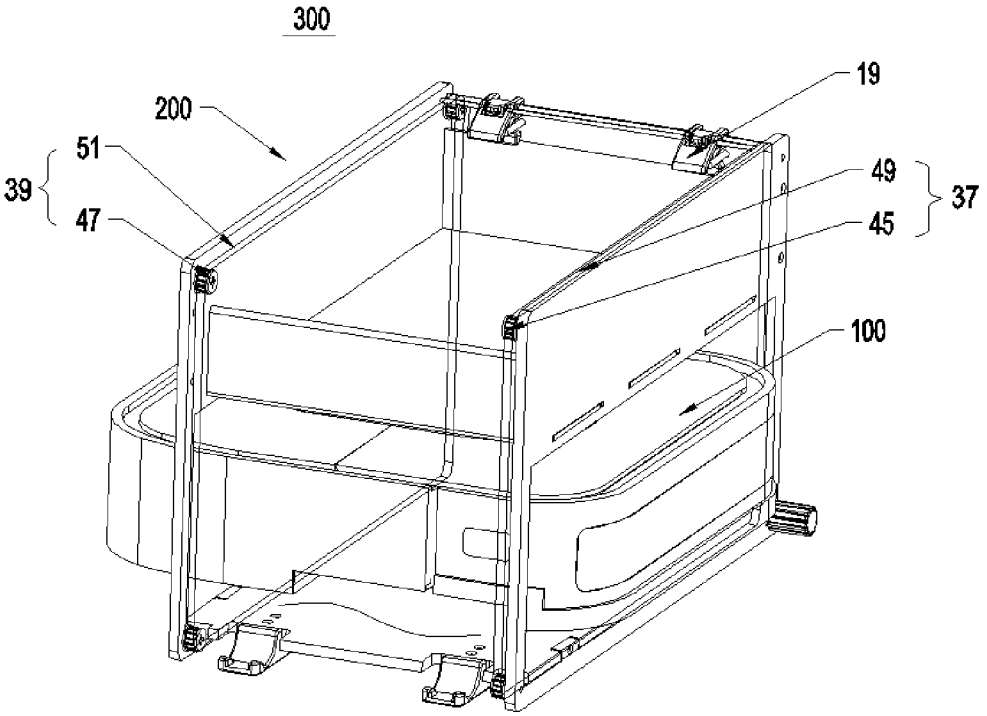
FIG. 52 is a schematic diagram of a structure in which a cleaning robot is located in the base station shown in FIG. 51.
Figure 53:
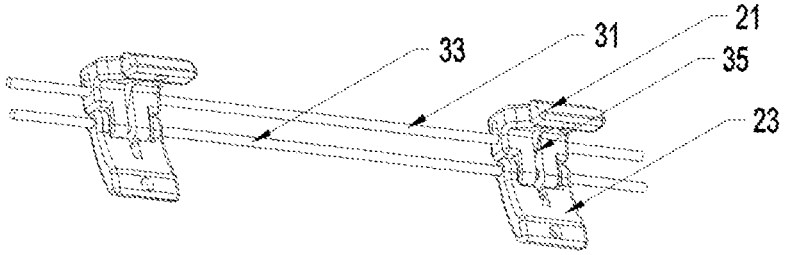
FIG. 53 is a schematic structural diagram of a clamping mechanism.

In a feasible manner, as shown in FIG. 1 and FIG. 51, the base station 200 includes a receiving module (211, 15, 206, 240), configured to receive the wiping member separated from the wiping board (122, 1201). Optionally, an opening on the receiving module (211, 15, 206, 240) is provided for the user to place a bag for storing wiping members into the receiving module (211, 15, 206, 240). When the bag for storing wiping members is insufficient in capacity, the base station 200 may perform detection and remind the user to perform replacement. Optionally, the receiving module (211, 15, 206, 240) is detachable. After the user detaches the receiving module (211, 15, 206, 240) from the base station 200, the wiping member stored in the receiving module (211, 15, 206, 240) is poured.

In a feasible manner, a wiping member recycling module generates an action force on the wiping member separated from the wiping board (122, 1201), and recycles the wiping member into the receiving module (211, 15, 206, 240). A specific implementation of the wiping member recycling module is described in detail in the following embodiments.

In a feasible manner, as shown in FIG. 37A to FIG. 43, the operating module 400 is mounted on the base station 200. In this embodiment, the base station 200 includes the wiping board operating position (215, 2021, 2022, 2023, 218, 13), for the cleaning robot 100 to assemble or separate the wiping board (122, 1201) equipped with the wiping member and the main body 101. When the cleaning robot 100 returns to the base station 200, the cleaning robot 100 separates the wiping board (122, 1201) equipped with the wiping member and the main body 101. The base station 200 includes a driving module (207, 205, 412), and the driving module (207, 205, 412) moves the wiping board (122, 1201) separated from the main body 101 to the wiping member operating position (2021, 2022, 215, 217, 218, 13, 4221, 420), to cause the operating module (125, 400) to separate the used wiping member and the wiping board (122, 1201). Optionally, the wiping member operating position (2021, 2022, 215, 217, 218, 13, 4221, 420) is higher than the wiping board operating position. As shown in FIG. 37, a space is formed between the wiping member operating position (2021, 2022, 215, 217, 218, 13, 4221, 420) and the wiping board operating position, for the cleaning robot 100 to park in. This solution may optimize the size of the base station 200 in the horizontal direction, to make the structure of the base station 200 more compact.

In a feasible manner, as shown in FIG. 46A, the wiping member operating position (2021, 2022, 215, 217, 218, 13, 4221, 420) includes a wiping member separating position 4221 and a wiping member mounting position 420, and the wiping member separating position and the wiping member mounting position 420 are basically on a same horizontal plane, to enable the driving module (207, 205, 412) to drive the wiping board in the horizontal direction to move between the wiping member separating position and the wiping member mounting position 420.

In a feasible manner, the opening of the receiving module (211, 15, 206, 240) used for receiving the wiping member is lower than the wiping member operating position (2021, 2022, 215, 217, 218, 13, 4221, 420) in at least one state, specifically, lower than the wiping member separating position 217. As shown in FIG. 1, in an implementation, the cleaning robot 100 separates the wiping member in the wiping member separating position 217, and the receiving module (211, 15, 206, 240) is disposed below the wiping member separating position 217, to cause the wiping member to drop into the receiving module (211, 15, 206, 240). In the manner, wiping members compress each other in dependence on their own gravity, to enable the receiving module (211, 15, 206, 240) to receive more wiping members. As shown in FIG. 37A, in an implementation, the opening of the receiving module (211, 15, 206, 240) is higher than the wiping member separating position 217 in a state and lower than the wiping member separating position 217 in another state. In this implementation, the receiving module 211 may move in the height direction, to form a space in the base station 200, for the cleaning robot 100 to park in. When the cleaning robot 100 parks in the base station 200, a distance between the receiving module (211, 15, 206, 240) and a bottom surface of the base station 200 is greater than the height of the cleaning robot 100. Optionally, the receiving module (211, 15, 206, 240) is driven by the driving module (207, 205, 412) to move in the height direction, that is, the driving module (207, 205, 412) drives both the wiping board (122, 1201) and the receiving module (211, 15, 206, 240) to move.

In a feasible manner, the receiving module 211 is located in the moving direction of the wiping board (122, 1201). As shown in FIG. 46, the receiving module (211, 15, 206, 240) includes a recycling box 206, and the driving module (207, 205, 412) drives the wiping board (122, 1201) to move toward the recycling box 206, to separate the wiping member and the wiping board (122, 1201) in the recycling box 206. Further, when the driving module (207, 205, 412) drives the wiping board (122, 1201) to move toward the recycling box 206, the wiping board (122, 1201) compresses wiping members in the recycling box 206, to help the recycling box 206 store more wiping members.

In a feasible manner, a control method for an automatic cleaning system 300 includes the following steps:

- conveying a free end of a continuous wiping base material 500 to a cutting position;
- cutting the free end of the wiping base material 500 from the wiping base material 500 to form a wiping member; and
- mounting the wiping member on a wiping board (122, 1201).

The cutting the free end of the wiping base material 500 from the wiping base material 500 and the mounting the wiping member on the wiping board (122, 1201) may be performed simultaneously; or the wiping member may be first mounted on the wiping board (122, 1201), and then the free end of the wiping base material 500 is cut from the wiping base material 500.

Specifically, the conveying a free end of a continuous wiping base material 500 to a cutting position includes: conveying the free end of the wiping base material 500 stored in a storage module 213 to the cutting position through a feeding module (220, 421).

The mounting the wiping member on a wiping board (122, 1201) includes: mounting the wiping member on a loading portion (123, 127) of the wiping board (122, 1201) through an operating module (125, 400).

The cutting the free end from the wiping base material 500 to form a wiping member includes: cutting, through locking and/or stretching of the feeding module (220, 421) for the wiping base material 500, the free end from the wiping base material 500 to form the wiping member.

The cutting the free end from the wiping base material 500 to form a wiping member includes: cutting, through a cutting module 280, the free end from the wiping base material 500 to form the wiping member.

In a feasible manner, a control method for an automatic cleaning system 300 includes the following steps: separating a wiping member from a wiping board (122, 1201). After the wiping member and the wiping board (122, 1201) are separated, a new wiping member is mounted on the wiping board through the foregoing steps, to automatically replace the wiping member.

In a feasible manner, a control method for an automatic cleaning system 300 includes the following steps: separating, before the separating a wiping member from a wiping board (122, 1201), the wiping board (122, 1201) and a cleaning robot 100. After the wiping board (122, 1201) and the cleaning robot 100 are separated, a base station 200 operates only the separated wiping board (122, 1201) equipped with the wiping member, to cause the wiping board to replace the wiping member.

In a feasible manner, as shown in FIG. 37A to FIG. 43, a control method for an automatic cleaning system 300 includes the following steps: driving, before the separating a wiping member from a wiping board (122, 1201), the wiping board separated from the cleaning robot to move to a wiping member operating position (2021, 2022, 215, 217, 218, 13, 4221, 420). In this implementation, the separation of the wiping board (122, 1201) and the cleaning robot 100 is completed in the wiping board operating position, and the separation of the wiping member and the wiping board (122, 1201) is completed in the wiping member operating position (2021, 2022, 215, 217, 218, 13, 4221, 420). Therefore, after the wiping board (122, 1201) and the cleaning robot 100 are separated, the driving module (207, 205, 412) moves the wiping board (122, 1201) from the wiping board operating position to the wiping member operating position (2021, 2022, 215, 217, 218, 13, 4221, 420), and then completes replacement of the wiping member.

In a feasible manner, a control method for an automatic cleaning system 300 includes the following steps: mounting the wiping board (122, 1201) in the cleaning robot 100 after the mounting the wiping member on the wiping board (122, 1201).

In a feasible manner, a control method for an automatic cleaning system 300 includes the following steps: moving, by the cleaning robot 100, a preset distance in a first direction after the separating the wiping board (122, 1201) from the cleaning robot 100. As shown in FIG. 37A to FIG. 43, because the wiping member operating position (2021, 2022, 215, 217, 218, 13, 4221, 420) is located above the wiping board operating position, after the wiping board (122, 1201) and the cleaning robot are separated, the driving module (207, 205, 412) drives a wiping board from the wiping board operating position to the wiping member operating position (2021, 2022, 215, 217, 218, 13, 4221, 420). If the cleaning robot 100 parks in the wiping board operating position, the main body 101 of the cleaning robot 100 hinders the driving module (207, 205, 412) from driving the wiping board (122, 1201) to move in the vertical direction. Therefore, the cleaning robot 100 moves in the first direction, and preferably the first direction is a direction opposite to the moving direction of the cleaning robot 100, to make space for movement of the wiping board (122, 1201).

In a feasible manner, a control method for an automatic cleaning system 300 includes the following steps: As shown in FIG. 44, mounting the wiping board (122, 1201) in the cleaning robot 100 after the moving, by the cleaning robot 100, a preset distance in a first direction. In this implementation, the base station 200 includes a wiping board mounting position 2022 and a wiping board separating position 2021. After the cleaning robot 100 separates the wiping board (122, 1201) in the wiping board separating position 2021, the cleaning robot moves in the first direction to reach the wiping board mounting position. Preferably, the first direction is a direction opposite to the moving direction of the cleaning robot 100.

FIG. 44A to FIG. 44I show an embodiment in which the wiping board mounting position and the wiping board separating position are separated. In the embodiment, the separating and assembling of the wiping board (122, 1201) and the cleaning robot 100 are completed in different positions respectively. Certainly, in some embodiments, the wiping board mounting position and the wiping board separating position may be a same position, that is, the separating and assembling of the wiping board (122, 1201) and the cleaning robot 100 are completed in a same position, as shown in embodiments in FIG. 1 to FIG. 36, FIG. 37A to FIG. 37L, FIG. 46A to FIG. 46L, and FIG. 58 to FIG. 63. In these embodiments, the wiping board operating position not only serves as the wiping board mounting position, but also serves as the wiping board separating position.

In a feasible manner, a control method for an automatic cleaning system 300 includes the following steps: As shown in FIG. 37, in this implementation, the wiping board operating position of the base station 200 is provided for the cleaning robot 100 to separate and mount the wiping board (122, 1201) in a same position, and after the wiping member is mounted on the wiping board (122, 1201), the cleaning robot 100 moves the preset distance in a second direction to return to the wiping board operating position, and the wiping board (122, 1201) is mounted in the cleaning robot 100, where the first direction and the second direction are opposite.

Figure 2:
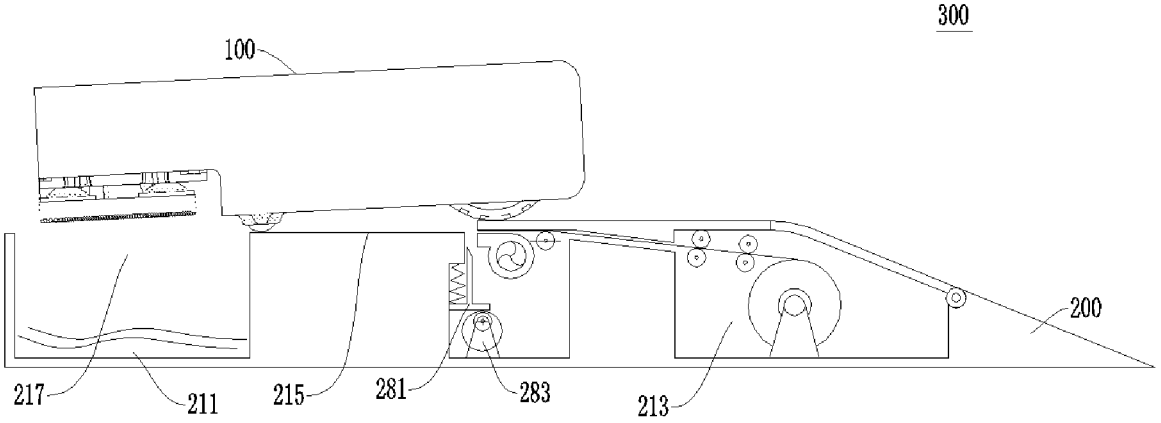
Figure 3:
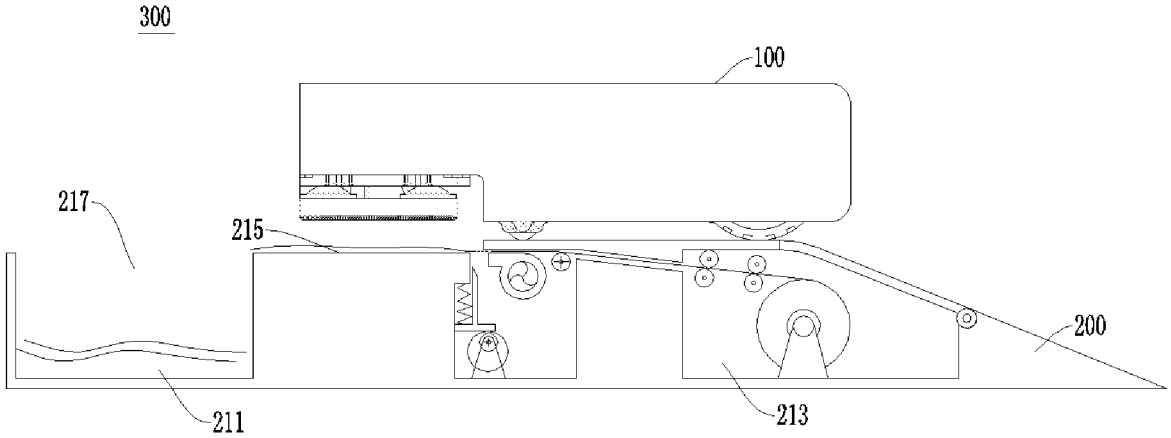

FIG. 1 to FIG. 36 are accompanying drawings involved in a first embodiment of the present invention. FIG. 1 to FIG. 3 are schematic structural diagrams of a first feasible solution of an automatic cleaning system 300 according to this embodiment of the present invention, where the cleaning system includes a cleaning robot 100 and a base station 200. The cleaning robot 100 may be an automatic mopping machine, or an automatic mopping and sweeping integrated machine, or an automatic sweeping machine. The cleaning robot 100 works in a working region to complete tasks such as mopping and sweeping. When the cleaning robot needs to return to the base station 200, for example, when it is detected that a wiping member needs to be replaced or the cleaning robot 100 needs to be charged, a returning program is started, and the cleaning robot 100 returns to the base station 200 to complete automatic replacement of a wiping member or charging.

As shown in FIG. 1, the cleaning robot 100 includes a main body 101, and a movable module disposed at the bottom of the main body 101 and configured to drive the main body 101 to move on a working surface. The movable module includes a walking wheel 110. It may be understood that, the movable module may alternatively include a tracked structure. The cleaning robot 100 further includes a cleaning mechanism. In this embodiment, a cleaning module 120 serves as the cleaning mechanism, and the cleaning robot 100 performs mopping work on the working surface through the cleaning module 120. In another embodiment, the cleaning mechanism of the cleaning robot 100 may further include a roller brush and a side brush, which are configured to clean sundries such as dust on a ground, a corner, and the like, the sundries are relatively concentrated at the roller brush by using the side brush for processing, and the dust is collected into a dust-collecting box.

The cleaning robot 100 further includes a power mechanism, a power source, and a sensor system. The power mechanism includes a motor and a transmission mechanism connected to the motor, the transmission mechanism is connected to the mobile module, the motor drives the transmission mechanism to work, and a transmission effect of the transmission mechanism enables the mobile module to move. The transmission mechanism may be a worm gear and worm mechanism, a bevel gear mechanism, or the like.

The power source of the cleaning robot 100 is configured to provide energy to the cleaning robot 100 and provide power to the power mechanism to enable the cleaning robot 100 to move and work. The power source is usually set as a battery pack. When energy consumption of the battery pack reaches a threshold, the cleaning robot 100 automatically returns to the base station 200 to replenish energy, and continues to work after charging ends.

The sensor system of the cleaning robot 100 includes a cliff sensor, configured to change a walk policy if existence of a cliff is detected; a side sensor, configured to generate a policy of walking along a side if a side of a working region is detected; a tilt sensor, configured to change a working policy and send an indication to a user if tilt of a machine is detected; and various other common sensors. Details are not described herein again.

The cleaning robot 100 further includes a control module that may be an embedded digital signal processor, a microprocessor, an application-specific integrated circuit, a central processing unit, a field programmable gate array, or the like. The control module may control work of the cleaning robot 100 according to a preset condition or according to an instruction received by the cleaning robot 100. Specifically, the control module may control the movable module to walk randomly in a working region of the cleaning robot 100 or walk according to a preset walking path. While the movable module drives the cleaning robot 100 to walk, the cleaning mechanism works, so as to clear stains, dust, and the like on a surface of the working region.

In this embodiment, the cleaning module 120 is equipped with a wiping member, configured to wipe dust on the working surface or stains attached to the working surface. The wiping base material 500 may be cut into at least two wiping members, and the wiping member is sheet-shaped, has a thickness less than 0.5 cm, and includes natural fabrics such as cotton or linen, chemical fabrics such as polyester fiber or nylon fiber, or a sponge product such as rubber or cellulose sponge, a paper product such as original wood pulp or absorbent cotton, or a disposable soft article such as the foregoing synthetic product. In an embodiment, the wiping member can generate static electricity through friction with the working surface, and is, for example, electrostatic paper, thereby adsorbing hair, dust, and the like on the working surface. In an embodiment, the wiping member has a water absorption function and integrity of the wiping member can be kept in a period of time.

In this embodiment, the base station 200 includes a storage device, configured to store a wiping base material 500. The storage device includes a receiving module 211 and a storage module 213, the receiving module 211 is configured to store a used wiping member, and the storage module 213 is configured to store the to-be-used wiping base material 500.

As shown in FIG. 2, the base station 200 includes a wiping member separating position 217 and a wiping member mounting position 215. When the cleaning robot 100 returns to the base station 200 and moves to the wiping member separating position 217, the wiping member mounted in the cleaning robot 100 is located above the wiping member separating position 217, the used wiping member may be separated, and the separated wiping member enters the receiving module 211.

As shown in FIG. 3, after being separated from the wiping member in the wiping member separating position 217, the cleaning robot 100 retreats to the wiping member mounting position 215. In this embodiment, the base station 200 includes a feeding module 220, configured to export the wiping member from the storage module 213 to the wiping member mounting position 215, for the cleaning robot 100 to mount. Under the action of the feeding module 220, the wiping member is exported from the storage module 213, and is moved to the wiping member mounting position 215 in a direction substantially parallel to the wiping member mounting position 215, and the wiping member is kept as flat as possible.

The wiping base material 500 in the storage module 213 is continuous. Therefore, after the length of the wiping member on the wiping member mounting position 215 meets a preset length, the feeding module 220 stops working. The base station 200 further includes a limit module, configured to detect the length of the wiping member on the wiping member mounting position 215, and a control module is configured to control the feeding module 220 according to a detection result of the limit module. In this embodiment, the wiping member separating position 217 and the wiping member mounting position 215 are in different positions of the base station 200. In other embodiments, the wiping member separating position 217 and the wiping member mounting position 215 may partially or completely coincide.

Optionally, the base station 200 includes a flattening module 250. The wiping member is relatively soft and prone to wrinkle. Therefore, after the feeding module 220 exports the free end of the wiping base material 500, to make it convenient for the cleaning robot 100 to normally mount the wiping member, the wiping member needs to keep a relatively flat state, and the flattening module 250 keeps the wiping member flat by means of airflow, a pressing rod, or the like.

Optionally, the base station 200 includes a cutting module 280, configured to separate the free end of the wiping base material 500 on the wiping member mounting position 215 and the wiping base material 500 in the storage module 213. To ensure that after being completely mounted by the user, the wiping base material 500 in the storage module 213 can continue to be exported under the action of the feeding module 220, the wiping base material 500 stored in the storage module 213 is continuous. If the limit module detects that the length of the wiping member meets the preset length, the free end of the wiping base material 500 on the wiping member mounting position 215 and the wiping base material 500 in the storage module 213 need to be separated.

In a case, the continuous wiping base material 500 in the storage module 213 is formed by connecting several wiping members with a standard length, and has a relatively small connection strength, and the cleaning robot 100 may naturally separate the wiping member during mounting of the wiping member process. In another case, when the wiping member on the wiping member mounting position 215 meets the preset length, the cutting module 280 works to separate the free end and the body of the wiping base material 500.

In this embodiment, the wiping member mounting position 215 includes a first position away from the storage module 213 and a second position close to the storage module 213. When the wiping member reaches the second position, it indicates that the length of the wiping member on the wiping member mounting position 215 meets a preset length requirement, the control module may control the feeding module 220 to stop working. The storage module 213 includes an exit 2111, and the width of the exit 2111 is greater than the width of the wiping member. The feeding module 220 exports the wiping base material 500 from the exit 2111 to the wiping member mounting position 215. Optionally, the storage module 213 includes a pivotable cover body 2113, for the user to open to replace the wiping base material 500. The receiving module 211 includes an exit, for the user to open to dispose of the used wiping member stored in the receiving module 211. Optionally, the receiving module 211 includes a rubbish bag receiving structure, the user may load a rubbish bag into the receiving module 211, the used wiping member is directly stored in the rubbish bag, and the user may directly take the rubbish bag out from the exit.

In an embodiment, the storage module 213 is provided with a mounting rack parallel to the ground, and two ends of the mounting rack are supported by bearings. Correspondingly, the storage module 213 may store the wiping base material 500 in the form of a roller-type wiping base material 500, and includes a cylindrical hollow rolling body, wrapped with the wiping base material 500 whose length is far greater than that required for single-time use. The user may mount the hollow rolling body in the storage module 213 through the mounting rack, to enable the hollow rolling body to rotate around the mounting rack.

In an embodiment, the movable module includes an auxiliary wheel 102. When the cleaning robot 100 returns to the base station 200, the cleaning module 120 is raised, the auxiliary wheel 102 is lowered, and the movable module drives the cleaning robot 100 to enter the base station 200. Before the cleaning robot 100 starts a wiping member mounting program, the cleaning module 120 is kept in a raised state. When the cleaning robot 100 starts the wiping member mounting program, the auxiliary wheel 102 is raised, and the cleaning module 120 is lowered to the wiping member mounting position 215 to complete mounting of the wiping member.

Figure 4:
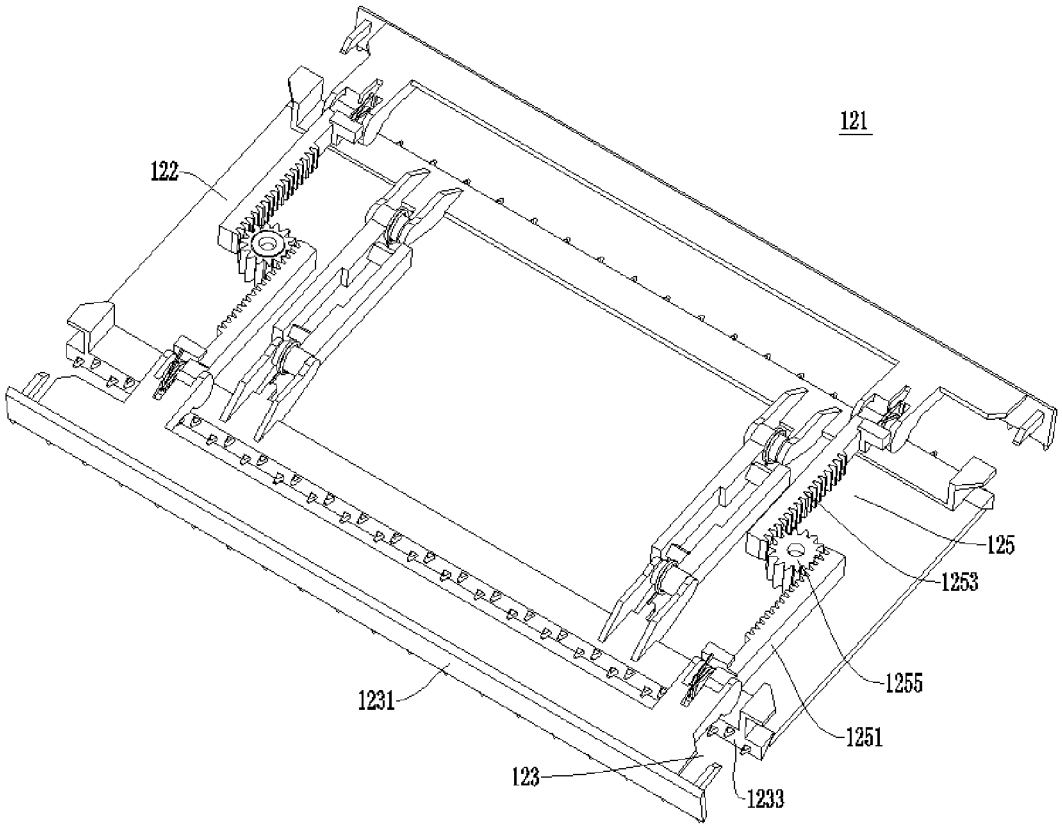
FIG. 4 is a schematic structural diagram of a cleaning module configured for a cleaning robot included in the cleaning system shown in FIG. 1 to FIG. 3.

As shown in FIG. 4, the cleaning module 120 includes an obtaining unit 121, configured to obtain a new wiping member or separate an old wiping member, thereby performing wiping member replacement without intervention by a user. As shown in FIG. 4, in this embodiment, the obtaining unit 121 includes a wiping board 122 and a clamping assembly 123. The clamping assembly 123 includes external clamping components 1231 and an internal clamping component 1233, and is mounted on the wiping board 122 through a transmission assembly 125.

The transmission assembly 125 includes a first horizontal gear 1251, a second horizontal gear 1253, and an intermediate gear 1255. There are two external clamping components 1231, respectively disposed on two opposite sides of the wiping board 122. The first horizontal gear 1251 and the second horizontal gear 1253 are respectively fixedly connected to the two external clamping components 1231, to cause the first horizontal gear 1251, the second horizontal gear 1253, and the two external clamping components 1231 to move simultaneously. The first horizontal gear 1251 and the second horizontal gear 1253 are meshed through the intermediate gear 1255, and always reciprocate in opposite directions. The first horizontal gear 1251 and the external clamping component 1231 are connected, to cause the first horizontal gear 1251 and the external clamping component 1231 to reciprocate simultaneously. The intermediate gear 1255 is driven by a motor. When the intermediate gear 1255 rotates around the first direction, the first horizontal gear 1251 and the second horizontal gear 1253 contract inward simultaneously, to drive the two external clamping components 1231 to contract inward. When the external clamping component 1231 contracts inward, the internal clamping component 1233 also contracts inward. A spring component (not shown) and the internal clamping component 1233 are connected, and when the internal clamping component 1233 is in a state of contracting inward, the spring component is in a compressed state. When the motor drives the intermediate gear 1255 to rotate around the second direction, a compression force of the spring component pushes outward, and the internal clamping component 1233 connected to the spring component also separates outward together.

In an embodiment, a spring (not shown) is disposed on an end portion of the second horizontal gear 1253, and when the first horizontal gear 1251 reciprocates, the spring is repeatedly compressed and loosened. If the intermediate gear 1255 drives the first horizontal gear 1251 to move inward, the spring is compressed, and the external clamping components 1231 clamp the wiping member. If the intermediate gear 1255 drives the external first horizontal gear 1251 to move outward, the compression force of the compressed spring is used for causing the external clamping components 1231 to separate outward, to release the wiping member sandwiched between the internal clamping component 1233 and the external clamping components 1231. In other embodiments, an end portion of the first horizontal gear 1251 may also be provided with a spring, thereby forming a double compression force.

Figure 5:
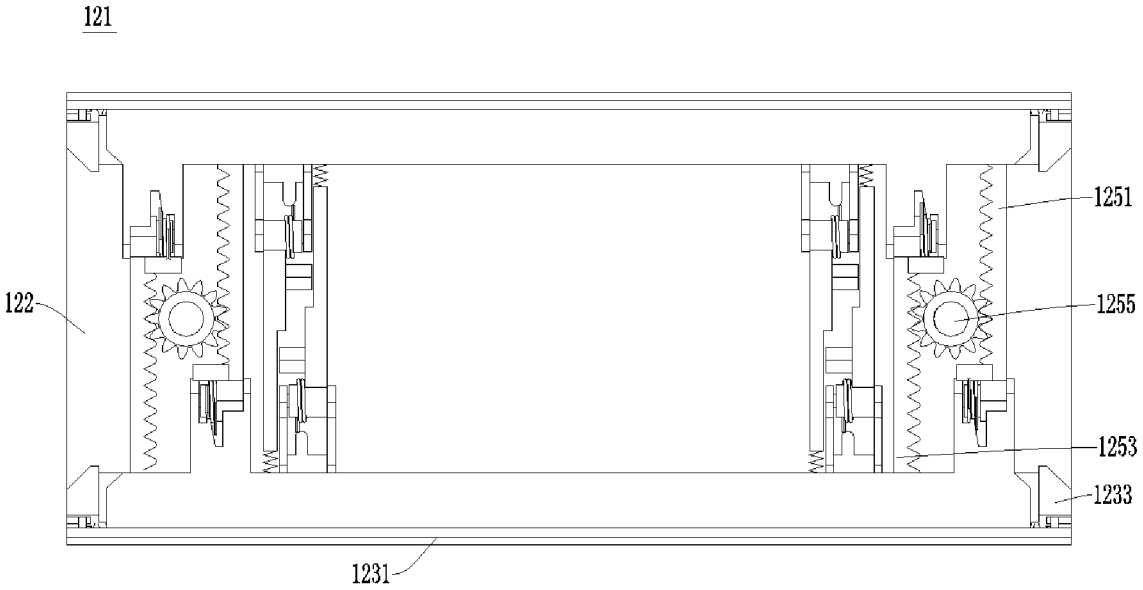
FIG. 5 is a top view of the cleaning module shown in FIG. 4 in a working state.
Figure 6:
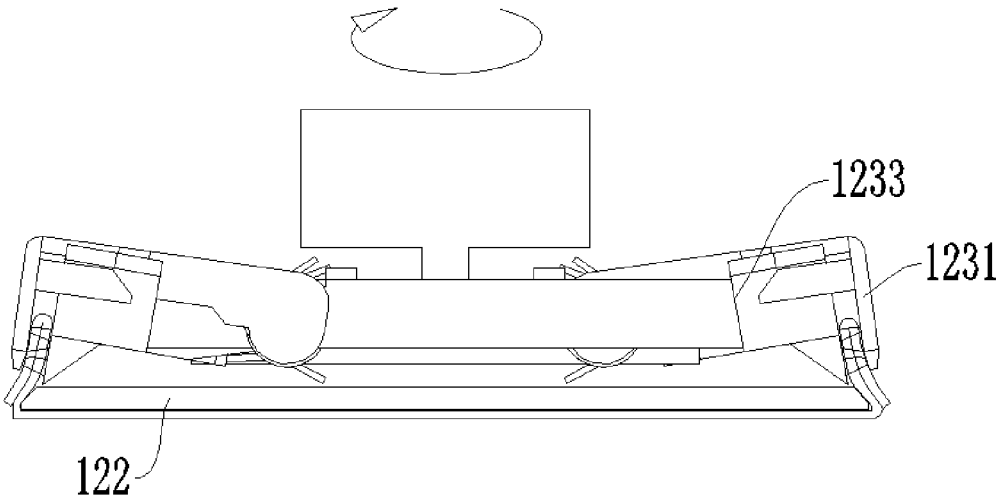
FIG. 6 is a side view of the cleaning module shown in FIG. 5.

As shown in FIG. 5 and FIG. 6, when the cleaning robot 100 moves to the base station 200 to obtain the wiping member, the wiping member is detachably fixed to the cleaning robot 100 under the action of the obtaining unit 121. When the intermediate gear 1255 rotates around the first direction (for example, a clockwise direction shown in FIG. 5), the external clamping components 1231 horizontally move inward, pawls of the external clamping components 1231 drive two sides of the wiping member to move inward, to cause a part of the wiping member close to the pawl to protrude upward. When the external clamping components 1231 and the internal clamping component 1233 are in contact, the wiping member protruding upward is clamped between the external clamping components and the internal clamping component. An inner side of the internal clamping component 1233 includes an inclined surface. When the external clamping components 1231 drive the internal clamping component 1233 to further move inward, the inclined surface of the internal clamping component 1233 butts the wiping board 122, to cause the internal clamping component 1233 to move in a direction along the inclined surface and drive the external clamping component 1231 to move in the direction along the inclined surface. Correspondingly, the wiping member between the external clamping components 1231 and the internal clamping component 1233 also moves upward accordingly, and the wiping member below the wiping board 122 is tensioned. After the intermediate gear 1255 cannot continue to rotate, the external clamping components 1231 and the internal clamping component 1233 reach a tensioned position. In this case, the wiping member has been maximally tensioned and clamped between the external clamping components 1231 and the internal clamping component 1233, and is not prone to fall off during working.

Figure 7:
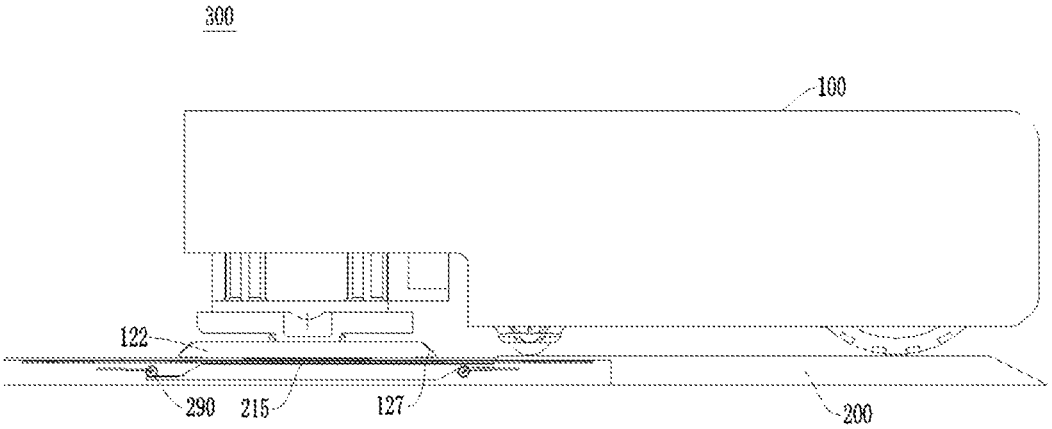
FIG. 7 and FIG. 8 are schematic partially structural diagrams of the cleaning system according to the first embodiment of the present invention.
Figure 8:
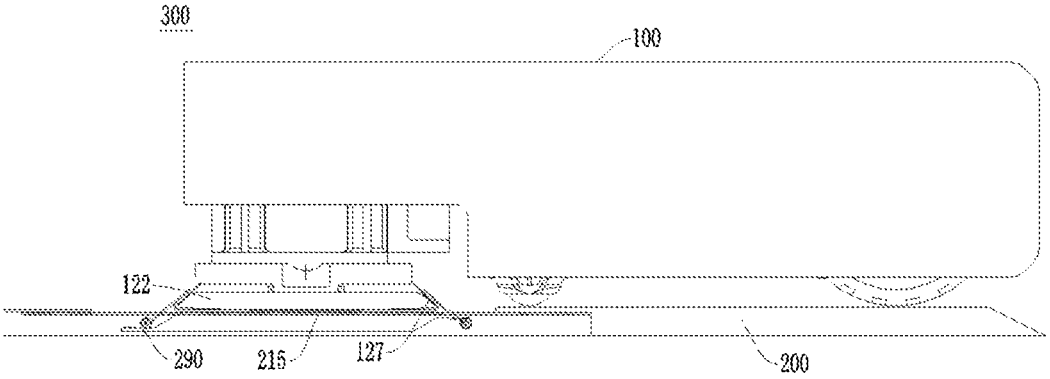

As shown in FIG. 7 and FIG. 8, in an embodiment, the obtaining unit 121 of the cleaning robot 100 includes a wiping board 122 and a sticking assembly 127, and the sticking assembly 127 is mounted on two sides of the wiping board 122. When being in contact with the sticking assembly 127, the wiping member may be relatively stably pasted to the sticking assembly 127, to cause the wiping member to be mounted on the wiping board 122. Specifically, the sticking assembly 127 may be a device detachably connected to the wiping member, such as a magic fastener.

The base station 200 includes an operating module 290, configured to assist in mounting the wiping member on the cleaning robot 100. The operating module 290 is disposed below the wiping member mounting position 215, and includes a first pressing board and a second pressing board. When the cleaning robot 100 reaches the wiping member mounting position 215, the first pressing board and the second pressing board pivot upward, to attach the wiping member on the first pressing board and the second pressing board to the sticking assembly 127.

As shown in FIG. 8, in this embodiment, the first pressing board and the second pressing board are respectively mounted on the first gear and the second gear, the first gear and the first rack are engaged, the second gear and the second rack are engaged, and the first rack and the second rack are connected, to move in a same direction. Specifically, a gear core of the first gear is relatively fixedly mounted on the base station 200, and the first gear may rotate relative to the gear core. The second gear is similar to the first gear. The first gear is mounted above the first rack, and the second gear is mounted below the second rack. When the first rack and the second rack move in a direction toward the first rack, the first gear clockwise rotates, thereby driving the first pressing board to clockwise rotate; but the second gear counterclockwise rotates, thereby driving the second pressing board to counterclockwise rotate. To match action surfaces of the first pressing board and the second pressing board, two corresponding sides of the wiping board 122 are inclined surfaces, that is, the sticking assembly 127 is disposed on the two inclined surfaces of the wiping board 122, thereby being laminated with the first pressing board and the second pressing board.

Figure 9:
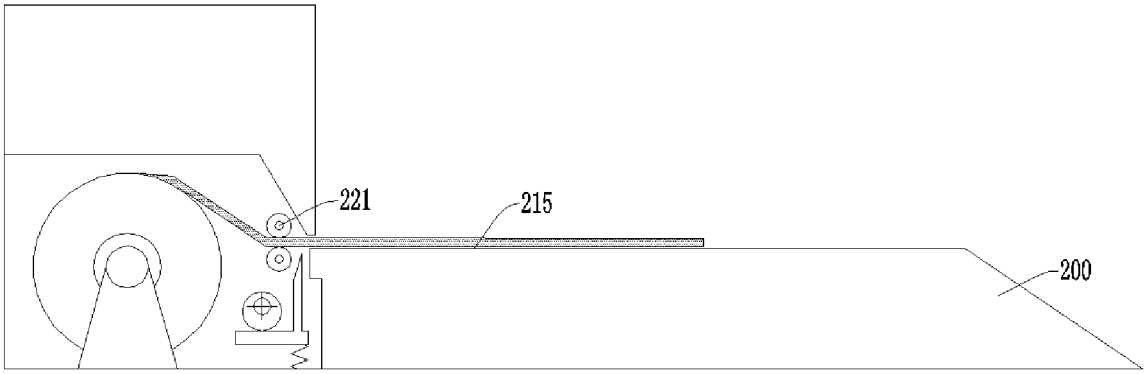
FIG. 9 is a schematic structural diagram of a first feasible solution of a base station.

As shown in FIG. 9, the feeding module 220 includes a rolling wheel assembly 221. In this embodiment, the rolling wheel assembly 221 includes a driving rolling wheel and a driven rolling wheel, and the motor drives the driving rolling wheel to rotate around the first direction, thereby driving the driven rolling wheel to rotate around the second direction. The free end of the wiping base material 500 is sandwiched between the rolling wheel assembly 221, a pressure between the driving rolling wheel and the driven rolling wheel forms a friction force on the wiping base material 500, thereby driving the wiping base material 500 to leave the hollow rolling body, to reach the wiping member mounting position 215. In other embodiments, the rolling wheel assembly 221 may include more than two rolling wheels, for example, two groups of rolling wheels cooperating with each other, the wiping base material 500 is exported under the driving of the two groups of rolling wheels, and a larger traction force may be provided. In other embodiments, the rolling wheel assembly 221 may include one rolling wheel, the rolling wheel acts on a surface of the base station 200, and a friction force on the wiping base material 500 is used for driving the free end of the wiping base material 500 to be exported while the rolling wheel is rotating.

Figure 10:
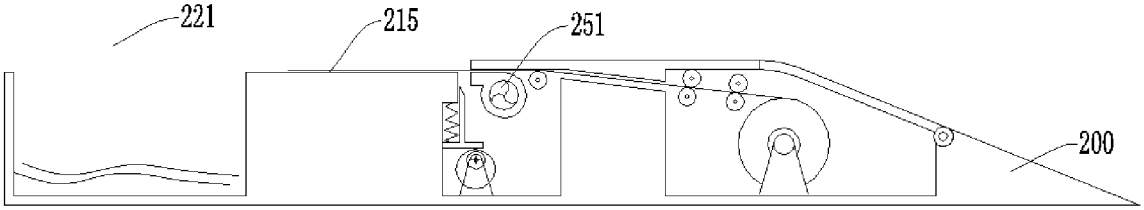
FIG. 10 is a schematic structural diagram of a second feasible solution of the base station.

As shown in FIG. 10, the flattening module 250 includes a fan 251. When the feeding module 220 works, the control module controls the fan 251 to work, and an air outlet of the fan 251 faces the first position, so that a flowing direction of gas at the air outlet of the fan 251 is substantially from the second position to the first position, and the wiping member moves toward the first position under the driving of airflow. Further, because the airflow at the air outlet of the fan 251 generates an action force on the wiping member in a direction parallel to the wiping member, the wiping member keeps an unfolded state in a horizontal direction.

In an embodiment, a cavity in which an air inlet of the fan 251 is located and air in the wiping member mounting position 215 are in communication, and the air outlet faces an outer side of the base station 200. After the wiping member is exported to the wiping member mounting position 215, the gas near the wiping member mounting position 215 flows into the fan 251, thereby generating a negative pressure in the wiping member mounting position 215, to adsorb the wiping member in the wiping member mounting position 215. Therefore, the wiping member is insusceptible to an external force, and can park in the wiping member mounting position 215 in a relatively stable state, to wait for the cleaning robot 100 to mount.

Figure 11:
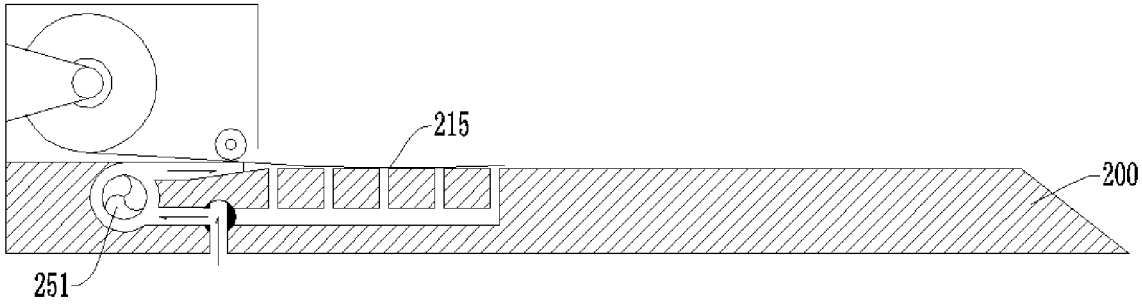
FIG. 11 and FIG. 12 are schematic structural diagrams of a third feasible solution of the base station.
Figure 12:
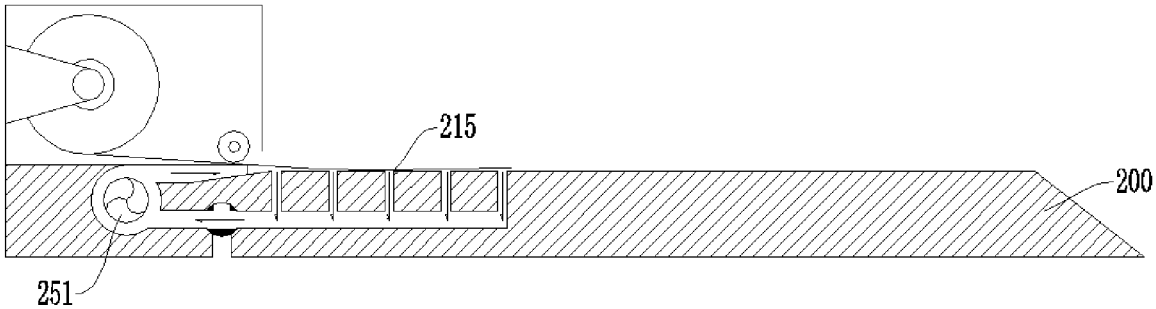

As shown in FIG. 11, the fan 251 includes two air intake channels, a first air intake channel is directly in communication with outside of the base station 200, and does not affect other modules of the base station 200, and a second air intake channel and the wiping member mounting position 215 are in communication. A valve such as a three-way valve is mounted between the two air intake channels and the air inlet of the fan 251. The air outlet of the fan 251 acts on the wiping member along a direction of exporting the wiping member. In the process of exporting the wiping member, the air inlet of the fan 251 and the first air intake channel are in communication, the control module controls the valve to close the second air intake channel, and the wiping member is exported to the wiping member mounting position 215 with the aid of the fan 251. As shown in FIG. 12, after the wiping member reaches the wiping member mounting position 215, the air inlet of the fan 251 and the second air intake channel are in communication, and the control module controls the valve to close the first air intake channel. The wiping member mounting position 215 generates a negative pressure under the action of the fan 251, to adsorb the wiping member in the wiping member mounting position 215.

Figure 13:
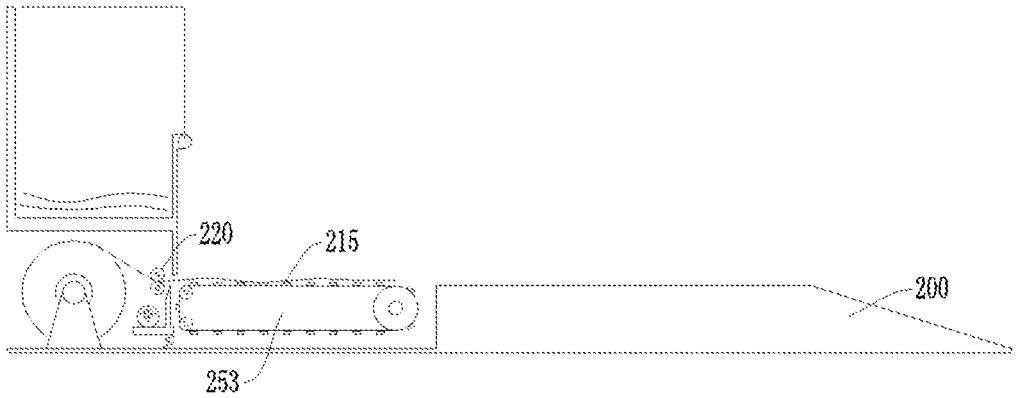
FIG. 13 is a schematic structural diagram of a fourth feasible solution of the base station.

As shown in FIG. 13, the flattening module 250 includes a synchronization belt assembly 253 that specifically includes a front wheel, a rear wheel, and a synchronization belt disposed around the front wheel and the rear wheel, and the front wheel or the rear wheel drives the synchronization belt to move. After the feeding module 220 exports the wiping member to a position of the front wheel, the synchronization belt drives the wiping member to move toward the first position. In this embodiment, to cause the synchronization belt to better drive the wiping member, a felt is disposed on the synchronization belt, and a relatively large friction force is generated after the felt and the wiping member come into contact, to assist the wiping member in moving toward the first position. Moreover, after the wiping member reaches the wiping member mounting position 215, the wiping member is not prone to move under the action of the felt, to prevent the wiping member from wrinkling.

Figure 15A:
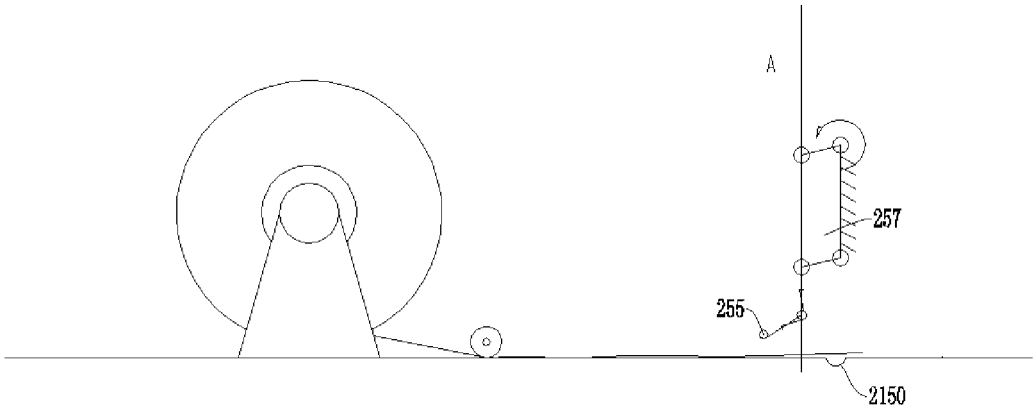
FIG. 15*a* to FIG. 15*b* are a schematic structural diagram of a fifth feasible solution of the base station.
Figure 15B:
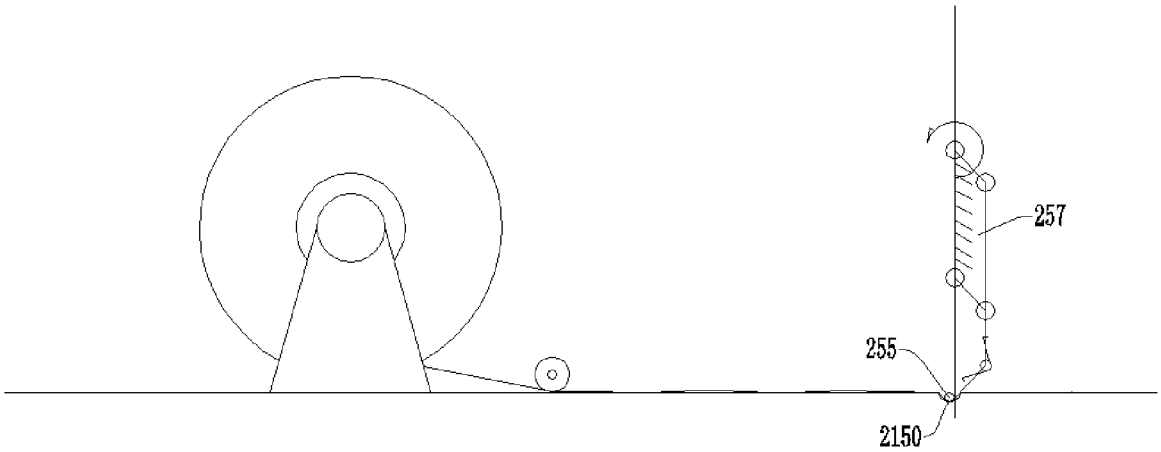

As shown in FIG. 15*a* and FIG. 15*b*, the flattening module 250 includes a pressing rod 255, and the pressing rod 255 acts on the wiping member and moves toward the second position, to cause the wiping member to be tensioned with movement of the pressing rod 255. In this embodiment, the pressing rod 255 and a four-bar assembly 257 are connected, the four-bar assembly 257 includes a rack, a connecting rod, and a crank, and the rack is fixed to the base station 200, and coincides with the second point of the wiping member mounting position 215 in a height direction. The connecting rod moves in the height direction and the horizontal direction under the driving of the crank, and the pressing rod 255 and the connecting rod are connected through a tension spring. When the connecting rod is in a position A, the pressing rod 255 is located at a highest point in the height direction, and is not in contact with the wiping member mounting position 215. When the connecting rod is in a position B, the pressing rod 255 is in contact with the wiping member mounting position 215. When the connecting rod is in a position C, the pressing rod 255 reaches a lowest point under the driving of the connecting rod, and the tension spring generates a pressure on the pressing rod 255, thereby generating a pressure on the wiping member in the wiping member mounting position 215. When the connecting rod is in a position D, the pressing rod 255 moves toward the second position, thereby pulling the wiping member between the pressing rod 255 and the wiping member mounting position 215 to move toward the second position. In this embodiment, the second position of the wiping member mounting position 215 is provided with a groove 2150, to cause the pressing rod 255 to be pressed by the tension spring downward into the groove 2150, to pull the wiping member to be tensioned downward. When the cleaning robot 100 completes mounting, the connecting rod is controlled to move upward to a position E, and the pressing rod 255 leaves the wiping member mounting position 215.

Figure 16:
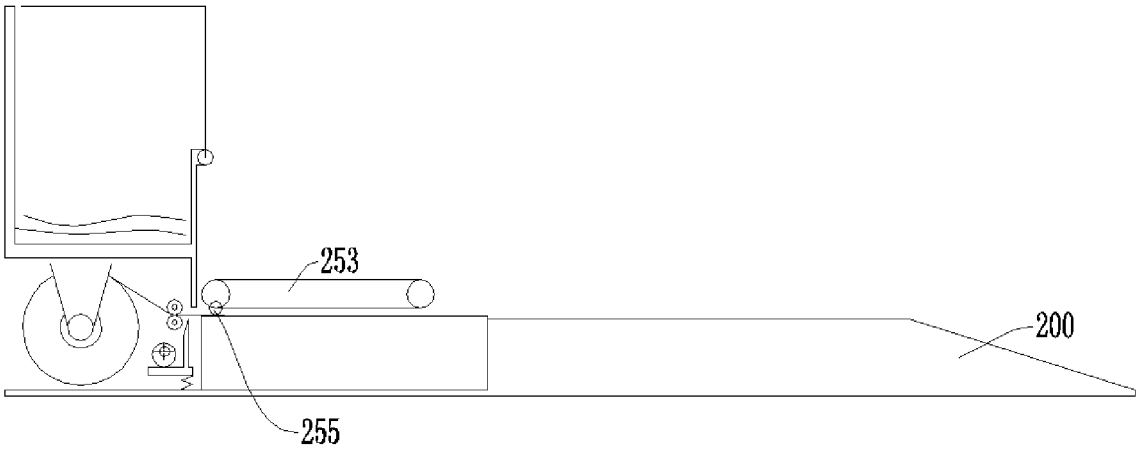
FIG. 16 is a schematic structural diagram of a sixth feasible solution of the base station.

As shown in FIG. 16, the pressing rod 255 is mounted on the synchronization belt assembly 253, and moves in synchronization with the synchronization belt assembly 253. When the free end of the wiping base material 500 is exported from the storage module 213 to the first position, the synchronization belt assembly 253 counterclockwise rotates to cause the pressing rod 255 to move downward to a position a. When the pressing rod 255 is in a lowest position, the pressing rod 255 forms a pressure on the wiping base material 500, and the pressing rod 255 moves toward a position b under the driving of the synchronization belt assembly 253, thereby driving the wiping base material 500 to move. When the pressing rod 255 reaches a position c, the wiping base material 500 also reaches the second position to wait for the cleaning robot 100 to mount, and the wiping base material 500 is tensioned under the action of the pressing rod 255. After the cleaning robot 100 completes mounting, the synchronization belt assembly 253 continues to move, to raise the pressing rod 255.

Figure 17:
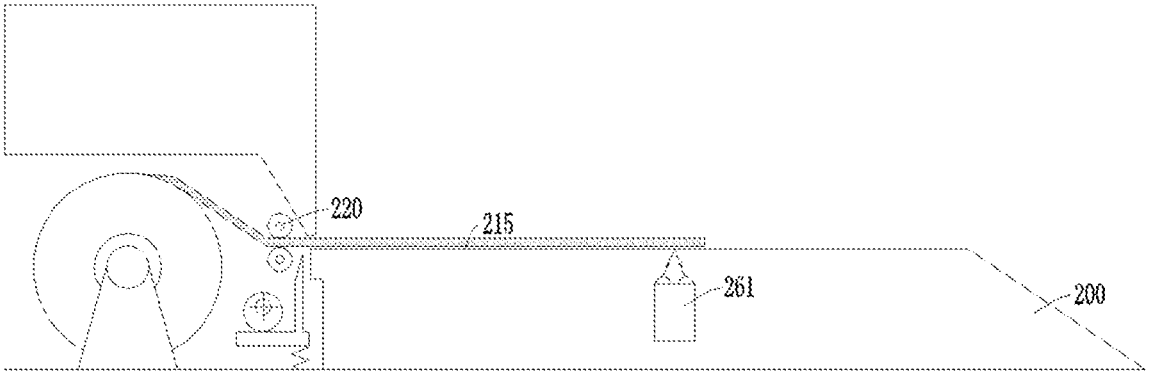
FIG. 17 is a schematic structural diagram of a seventh feasible solution of the base station.

As shown in FIG. 17, the limit module includes a sensor assembly 261 that is configured to detect the length of the wiping member exported in the wiping member mounting position 215 and that may specifically include a photoelectric sensor, a Hall sensor, or the like. In this embodiment, the sensor assembly 261 is mounted on the second position of the wiping member mounting position 215, and when the sensor assembly 261 has detected a wiping member in the second position, it indicates that the exported length of the wiping member meets the preset length requirement, and the control module controls the feeding module 220 to stop working.

Figure 18:
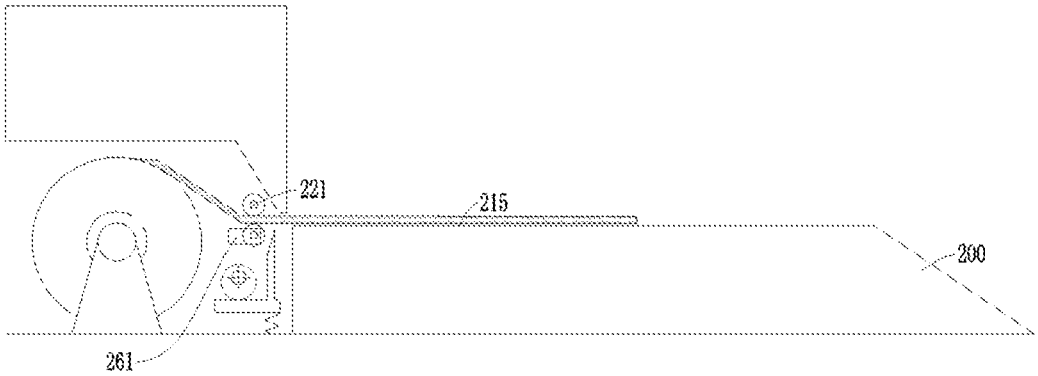
FIG. 18 is a schematic structural diagram of an eighth feasible solution of the base station.

As shown in FIG. 18, the sensor assembly 261 is mounted on the rolling wheel assembly 221, and configured to detect an angle that the rolling wheel assembly 221 rotates. The sensor assembly 261 may include an angular displacement sensor and the like. The free end of the wiping base material 500 is exported to the wiping member mounting position 215 under the driving of the rolling wheel assembly 221, and without slipping, a perimeter of a loop around which the rolling wheel assembly 221 rotates and the corresponding exported length of the wiping member are consistent. Therefore, the exported length of the wiping member may be calculated by detecting an angle that the rolling wheel assembly 221 rotates. If the sensor assembly 261 has detected that the angle that the rolling wheel assembly rotates reaches a preset angle, it indicates that the exported length of the wiping member meets the preset length requirement, and the control module controls the rolling wheel assembly 221 to stop working.

As shown in FIG. 19, the wiping base material 500 stored in the storage module 213 may be formed by connecting a plurality of wiping members with a standard length, and a connection strength between every two wiping members is relatively small, to facilitate cutting. In this embodiment, a plurality of light transmitting holes exists between every two wiping members. Therefore, the exported length of the free end of the wiping base material 500 may be detected by detecting the light transmitting holes. The sensor assembly 261 is mounted on the second position, and if the sensor assembly 261 has detected light transmitting holes, it indicates that the exported length of the free end of the wiping base material 500 meets the preset length requirement, and the control module controls the feeding module 220 to stop working. In this embodiment, the sensor assembly 261 includes a light transmitter and a light receiver, and when the light receiver has detected, through the light transmitting holes between the wiping members, light transmitted by the light transmitter, the sensor assembly 261 outputs a signal, and the control module controls, according to the signal outputted by the sensor assembly 261, the feeding module 220 to stop working.

Figure 20:
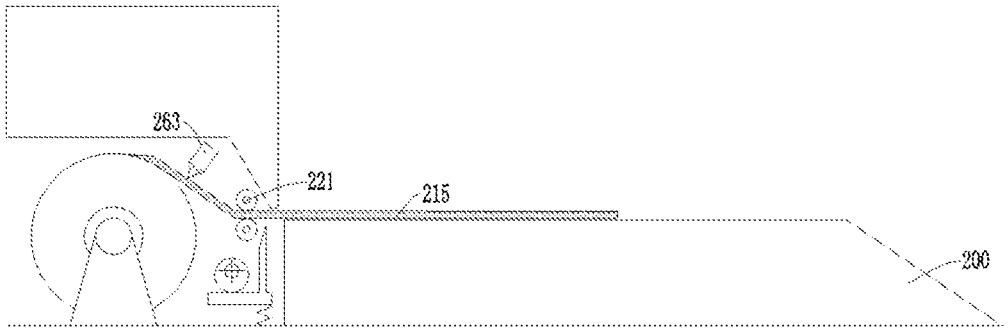
FIG. 20 is a schematic structural diagram of a tenth feasible solution of the base station.

As shown in FIG. 20, the limit module includes a sensor assembly 263, configured to detect a storage remainder of the wiping base material 500 in the storage module 213. When the storage remainder is less than a preset remainder, the control module reminds the user to perform replacement, to avoid a case that the cleaning robot 100 returns to the base station 200 but cannot normally mount a new wiping member. The sensor assembly 263 may include a micro-switch, a Hall element, a light coupled element, or the like. In this embodiment, the sensor assembly 263 is disposed between the mounting rack and the wiping member mounting position 215. The wiping base material 500 can be continuously exported if the remainder is sufficient. Therefore, if the sensor assembly 263 has not detected the wiping base material 500, the length of the remaining wiping base material 500 is less than a usable length or less than a suggested length, and the user needs to be reminded to perform replacement. In this embodiment, a reminder lamp, a buzzer, or the like is disposed on the base station 200, and the control module controls the reminder lamp or buzzer to work, thereby reminding the user. In other embodiments, the base station 200 may communicate with the user equipment, and if the sensor assembly 263 has not detected the wiping base material 500, the control module sends reminder information to the user equipment.

Figure 21:
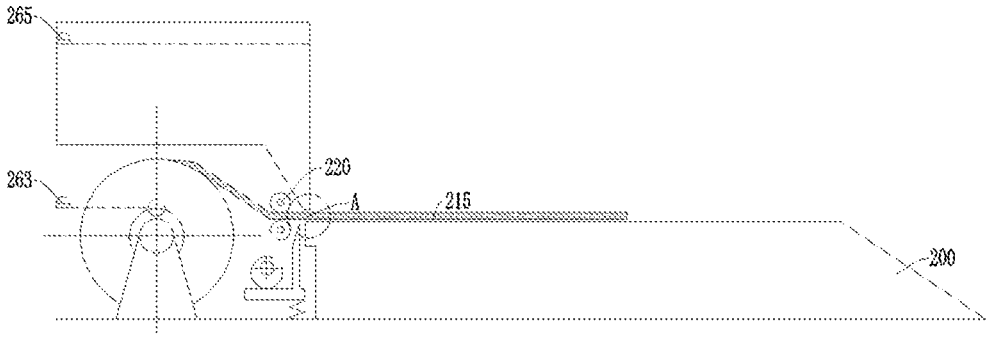
FIG. 21 is a schematic structural diagram of an eleventh feasible solution of the base station.

As shown in FIG. 21, the sensor assembly 263 is configured to detect the height of the wiping base material 500, thereby detecting the storage remainder of the wiping base material 500. For the roller-type wiping base material 500, a larger quantity of loops by which the wiping base material 500 wraps the hollow rolling body indicates a larger height. Therefore, a preset remainder of the wiping base material 500 corresponds to a preset height. If the height of the wiping base material 500 is less than the preset height, the length of the remaining wiping base material 500 is less than the suggested length, and the user needs to be reminded to perform replacement.

In an embodiment, the sensor assembly 263 is configured to detect the weight of the roller-type wiping base material 500, thereby detecting the storage remainder of the wiping base material 500. In this embodiment, the sensor assembly 263 is mounted on the mounting rack of the roller-type wiping base material 500. The weight of the roller-type wiping base material 500 in the storage module 213 is reduced as the wiping base material 500 is reduced. Therefore, when the weight of the wiping base material 500 is less than the preset weight, or when a ratio of the weight of the wiping base material 500 to an initial weight is less than a preset ratio, the length of the remaining wiping base material 500 is less than the suggested length, and the user needs to be reminded to perform replacement.

In an embodiment, the control module counts signals outputted by the sensor 261, and each time the exported length of the wiping member meets the preset length requirement, the count is increased by 1. When the count is greater than or equal to a preset value, it indicates that the storage remainder in the storage module 213 is less than the preset remainder, and the control module performs reminding about replacement.

As shown in FIG. 21, in an embodiment, the limit module includes a sensor assembly 265, and the sensor assembly 265 is mounted on the receiving module 211. In this embodiment, the sensor assembly 265 is mounted above the receiving module 211 in the height direction, to detect whether the wiping member in the receiving module 211 reaches a mounting position. It may be understood that, a larger quantity of wiping members in the receiving module 211 indicates a larger height. Therefore, when detecting that the wiping member reaches the mounting position, the sensor assembly 265 sends a reminder signal, to remind the user to dispose of the wiping member in the receiving module 211. In other embodiments, the sensor assembly 265 may be configured to detect the weight and other parameters of the receiving module 211, to remind, by setting thresholds, the user to perform disposal.

As shown in FIG. 2, in an embodiment, the cutting module 280 includes a cutting device 281 and a transmission device 283. When the exported length of the free end of the wiping base material 500 reaches the preset length, the control module controls, through the transmission device 283, the cutting device 281 to come into contact with and act on the wiping base material 500, thereby cutting the wiping base material 500. In this embodiment, the cutting device 281 includes a blade mounted on a blade holder, the transmission device 283 includes a cam, the bottom of the blade holder and the cam are in contact, and the cam rotates under the action of the motor, to cause the blade holder to move in the height direction. The top of the blade holder and a spring are connected, and the spring provides a force causing the blade holder to move downward, to keep the blade holder tightly pressing the cam. The control module controls the motor to drive the cam to rotate around an output shaft of the motor, and the changing diameter of the cam forms an upward pushing force on the blade holder, thereby controlling the blade holder to move in the height direction, to cause the blade to be in contact or not in contact with the wiping base material 500.

Figure 22:
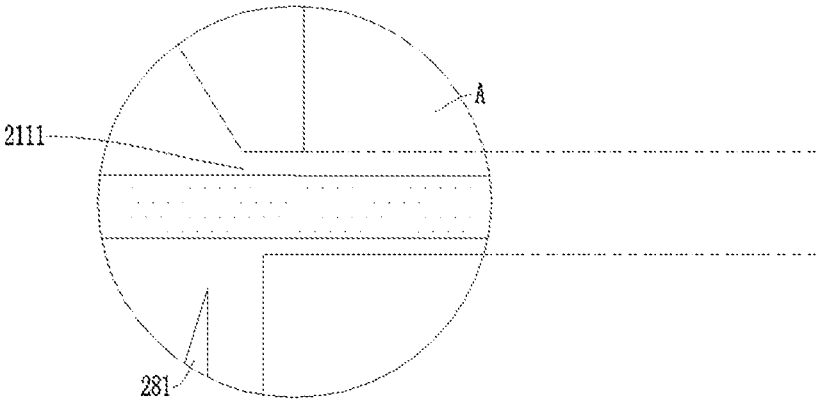
FIG. 22 is a partially enlarged view of the base station according to an embodiment shown in FIG. 21.

As shown in FIG. 22, in an embodiment, the cutting device 281 is mounted in the storage module 213. The cutting device 281 includes a sharp cutting device such as the blade. Therefore, to ensure safety of the user, the width of the exit 2111 of the storage module 213 is less than or equal to 3 cm, to avoid a case that the user stretches into the storage module 213 to come into contact with the cutting device 281. In an embodiment, the cutting device 281 is mounted outside the storage module 213. Therefore, to ensure safety of the user, an additional protecting cover needs to be disposed, the protecting cover includes an exit, and the width of the exit is less than or equal to 3 cm.

As shown in FIG. 23, the cutting device 281 moves in the horizontal direction, and the bottom of the cutting device 281 may come into contact with the wiping member mounting position 215. In this embodiment, the transmission device 283 includes a horizontal guide rail, the cutting device 281 is mounted on the sliding block, and as the sliding block moves on the guide rail, the cutting device 281 may move in the horizontal direction. When the feeding module works, the cutting device 281 is offset on a side. When the exported length of the free end of the wiping base material 500 reaches the preset length, the control module controls the cutting device 281 to move horizontally toward another side in the width direction of the wiping base material 500, thereby cutting the wiping base material 500. In this embodiment, the blade is round and is pivotably mounted on the sliding block, and when the sliding block moves, friction is generated between the blade and the wiping base material 500, thereby generating rotation. In other embodiments, a blade in another shape may also cut the wiping base material 500 under the driving of the sliding block.

As shown in FIG. 1, in an embodiment, the receiving module 211 opens upward, and the wiping member separating position 217 is located above the receiving module 211. When the cleaning robot 100 moves to the wiping member separating position 217, the cleaning module 120 is separated from the wiping member, to cause the wiping member to directly drop into the receiving module 211. In this embodiment, the wiping member separating position 217 and the wiping member mounting position 215 do not coincide, and the wiping member separating position 217 is located on a front side of the cleaning robot 100 in the moving direction. After separating the wiping member, the cleaning robot 100 may retreat to the wiping member mounting position 215 to mount the wiping member, and may retreat, after completing the mounting, from the base station 200 to perform cleaning work.

Figure 24:
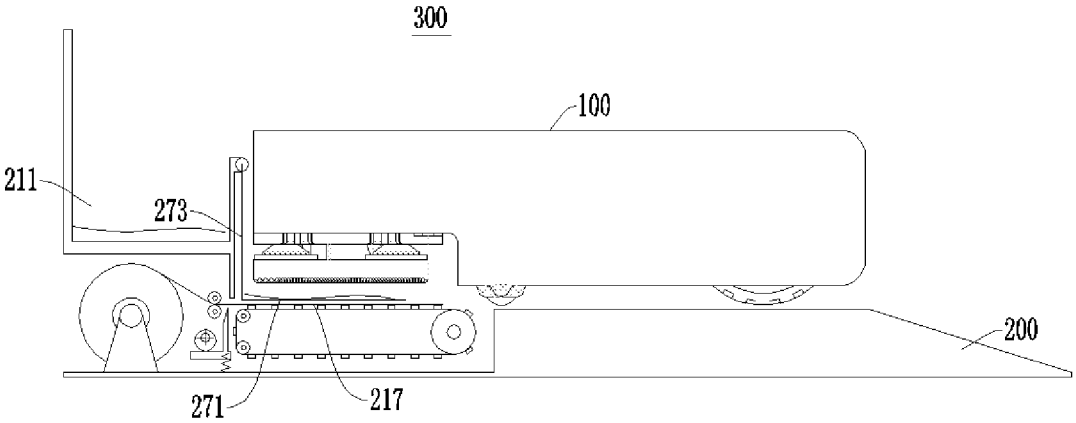
FIG. 24 to FIG. 26 are schematic structural diagrams of a second feasible solution of the cleaning system according to the first embodiment of the present invention.
Figure 25:
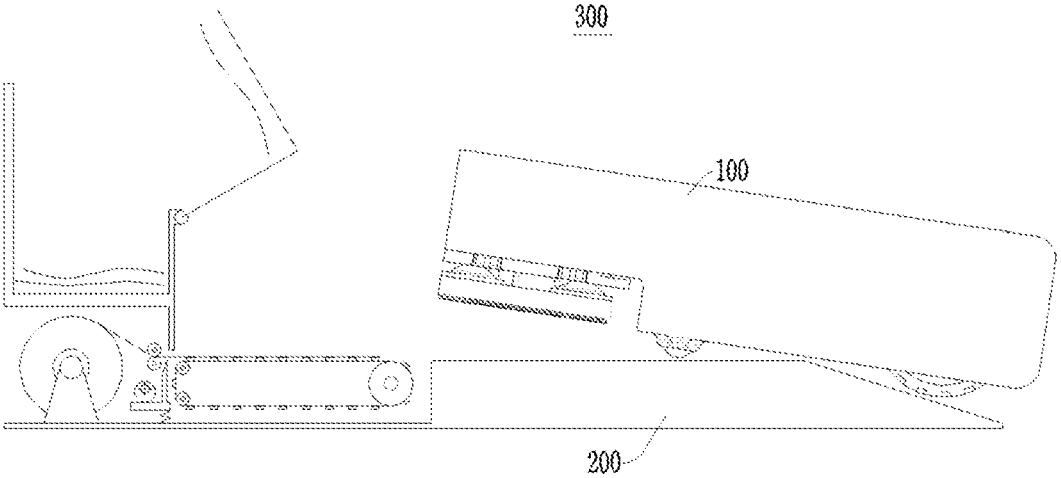
Figure 26:
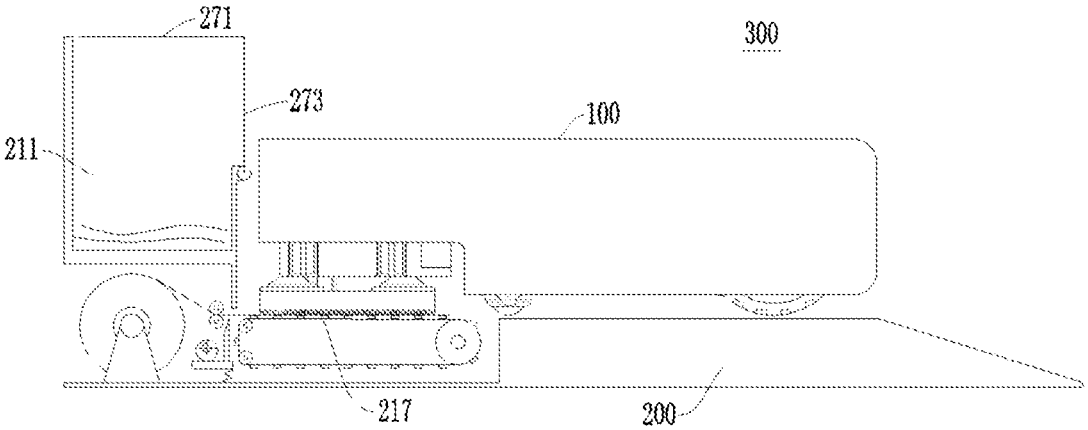

As shown in FIG. 24 to FIG. 26, in an embodiment, the base station 200 includes a wiping member recycling module, configured to recycle the wiping member on the wiping member separating position 217 into the receiving module 211. In this embodiment, the wiping member recycling module is mounted on the receiving module 211. The wiping member recycling module includes a receiving member 271, and a rotatable shaft 273 connected to the receiving member 271, and the rotatable shaft 273 is pivotably mounted on a side of the receiving module 211. When the rotatable shaft 273 rotates downward, a first surface of the receiving member 271 is caused to be upward. In this case, the receiving member 271 is located in a first recycling position, and the first surface of the receiving member 271 is used for receiving a used old wiping member. The first recycling position and the wiping member separating position 217 coincide or partially coincide. After the cleaning module 120 of the cleaning robot 100 moves to the wiping member separating position 217, the wiping member is separated, to cause the wiping member to drop onto the first surface of the receiving member 271. After the cleaning robot 100 separates the wiping member, and leaves the wiping member separating position 217, the control module controls the rotatable shaft 273 to upward pivot, and the receiving member 271 and the rotatable shaft 273 synchronously pivot. When the rotatable shaft 273 pivots by a maximum angle, the first surface of the receiving member 271 is downward. In this case, the receiving member 271 is in a second recycling position, the wiping member on the receiving member 271 drops, to enter the receiving module 211. It may be understood that, in this embodiment, the opening position of the receiving module 211 is higher than the wiping member separating position 217, and the wiping member is recycled through pivoting of the wiping member recycling module in the height direction.

In an embodiment, the wiping member separating position 217 and the wiping member mounting position 215 coincide or partially coincide, and if the wiping member recycling module has a displacement in the height direction during working, steps in which the cleaning robot 100 returns to the base station 200 to replace the wiping member are as follows:

S1: The cleaning robot 100 moves to the wiping member mounting position 215, to cause the obtaining unit 121 and the wiping member separating position 217 to be aligned.

S2: The cleaning robot 100 separates the wiping member.

S3: The cleaning robot 100 moves out of the wiping member separating position 217.

S4: The base station 200 recycles the wiping member.

S5: The base station 200 exports a new wiping member to the wiping member mounting position 215.

S6: The cleaning robot 100 moves to the wiping member mounting position 215.

S7: The cleaning robot 100 mounts the wiping member.

Figure 27:
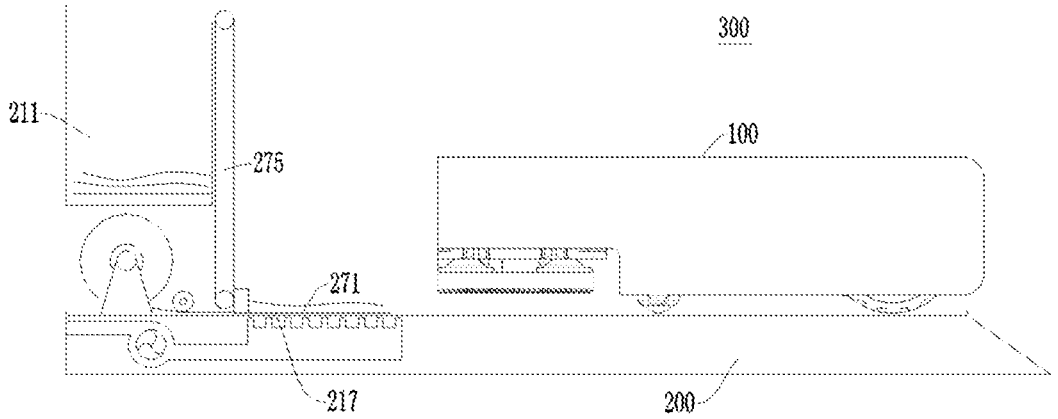
FIG. 27 to FIG. 29 are schematic structural diagrams of a third feasible solution of the cleaning system according to the first embodiment of the present invention.
Figure 28:
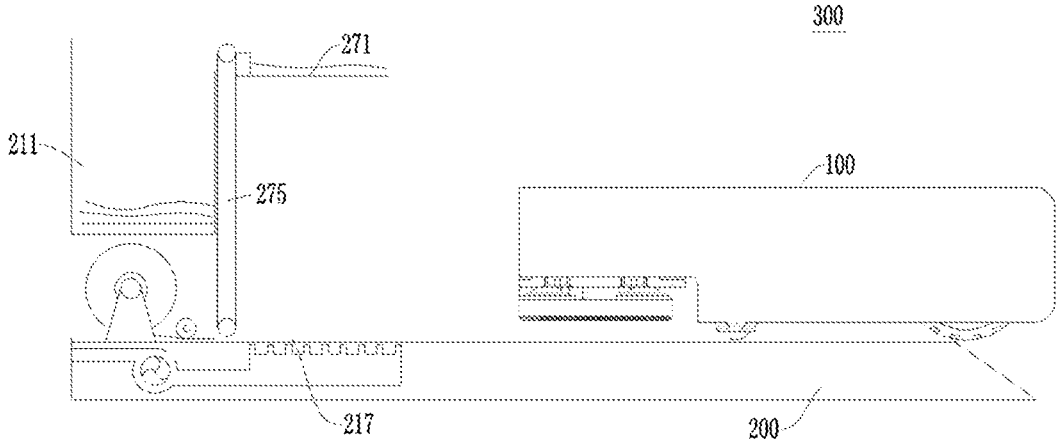
Figure 29:
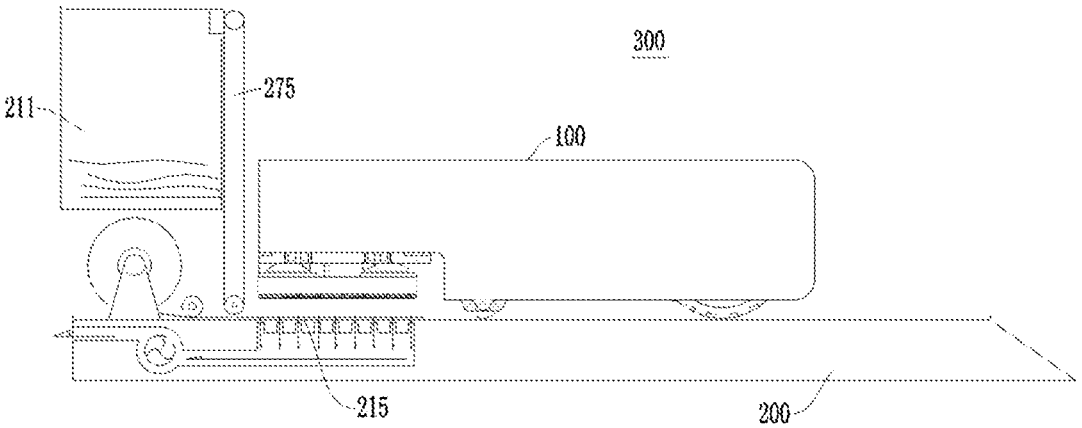

As shown in FIG. 27 to FIG. 29, in an embodiment, the wiping member recycling module includes a receiving member 271 and a lifting assembly 275, and the receiving member 271 is mounted on the lifting assembly 275, to enable the receiving member to move along with the lifting assembly 275 in the height direction. When the receiving member 271 is at a lowest point of the lifting assembly 275, the receiving member 271 is in a first recycling position. In this embodiment, the first recycling position and the wiping member separating position 217 coincide or partially coincide. After the cleaning module 120 of the cleaning robot 100 moves to the wiping member separating position 217, the wiping member is separated, to cause the wiping member to fall onto the receiving member 271. After the cleaning robot 100 separates a used wiping member, and leaves the wiping member separating position 217, the lifting assembly 275 drives the receiving member 271 to rise, and continues to drive the receiving member to rotate toward the receiving module 211, to cause the first surface of the receiving member 271 to be downward. In this case, the receiving member 271 is in a second recycling position, the wiping member drops, to enter the receiving module 211. In this embodiment, the lifting assembly 275 includes a synchronization belt. If the synchronization belt continues to move when the receiving member 271 reaches a highest point under the action of the synchronization belt, the receiving member 271 rotates together with the synchronization belt, to reach the second recycling position. In other embodiments, the lifting assembly 275 may alternatively be a sliding rod or another device.

Figure 30:
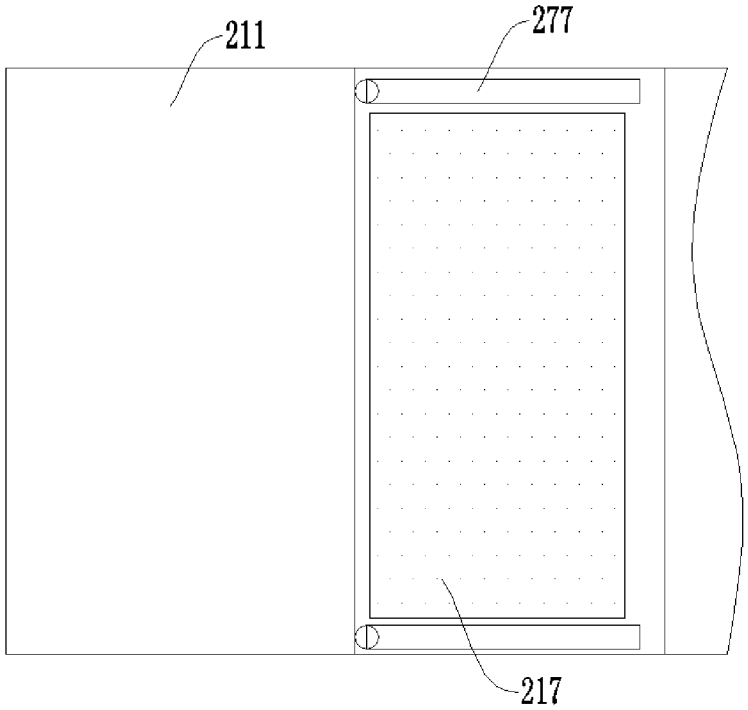
FIG. 30 and FIG. 31 are schematic partially structural diagrams of a thirteenth feasible solution of the base station.
Figure 31:
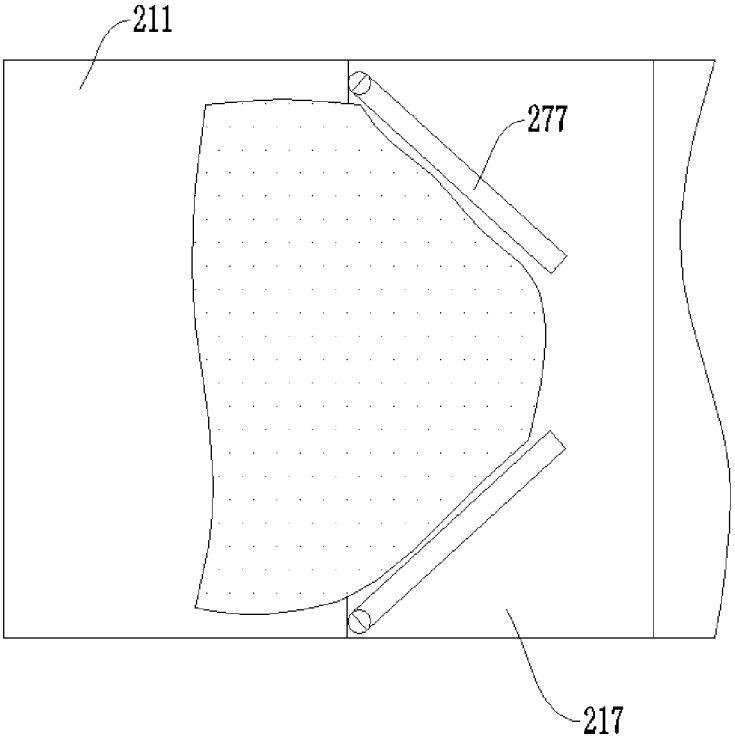

As shown in FIG. 30 and FIG. 31, the wiping member recycling module includes a lifting lever 277, mounted on the wiping member separating position 217 and pivoting in the horizontal direction. When the cleaning robot 100 separates the used wiping member, the lifting lever 277 pivots in a direction toward the receiving module 211, to cause the wiping member on the wiping member separating position 217 to enter the receiving module 211 under the action of the lifting lever 277. In this embodiment, the opening of the receiving module 211 and the wiping member separating position 217 are at a same height in the height direction, or the opening of the receiving module 211 is lower than the wiping member separating position 217; and the wiping member recycling module and the receiving module 211 are neighboring, and when the lifting lever 277 rotates toward the receiving module 211, the wiping member may drop to enter the receiving module 211. In this embodiment, the wiping member mounting position 215 may coincide with the wiping member separating position 217, and after separating the wiping member, the cleaning robot 100 may not move, perform mounting after the base station 200 completes recycling of an old wiping member and exporting of a new wiping member, and then retreat from the base station 200.

Figure 32:
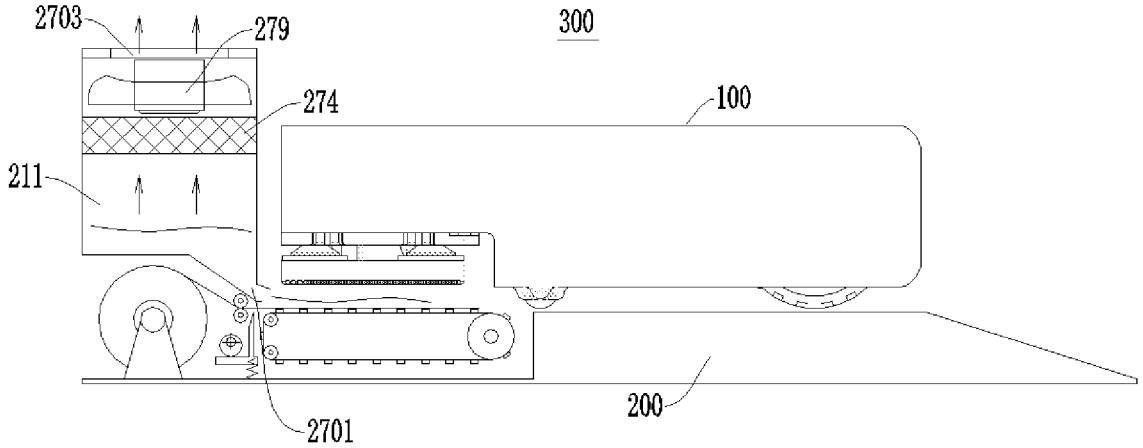
FIG. 32 is a schematic structural diagram of a fourth feasible solution of the cleaning system according to the first embodiment of the present invention.

As shown in FIG. 32, the wiping member recycling module includes a fan 279, and the fan 279 is mounted in the receiving module 211. The receiving module 211 includes an entrance 2701 facing the wiping member separating position 217, and when the fan 279 works, airflow near the wiping member mounting position 215 enters the fan 279 from the entrance 2701. The receiving module 211 includes an exit 2703, and gas flowing out when the fan 279 works is discharged from the exit 2703. The position of the exit 2703 may be above the receiving module 211 or in another direction that does not affect working of the base station 200. When the fan 279 works, air in the receiving module 211 is discharged under the action of the fan 279, a negative pressure is formed in the receiving module 211, to cause the wiping member on the wiping member separating position 217 to enter the receiving module 211 from the entrance 2701. The wiping member recycling module further includes a filtering device 274 mounted between the fan 279 and the entrance 2701 and configured to filter out relatively large particulate matters in air, to avoid damaging the fan 279. Moreover, the wiping member may move upward in the receiving module 211 under the action of the fan 279, and the filtering device 274 can prevent the wiping member from blocking the air inlet of the fan 279.

In an embodiment, the wiping member separating position 217 and the wiping member mounting position 215 coincide, and the wiping member recycling module has no displacement in the height direction during working. That is to say, when the cleaning robot 100 is at the wiping member separating position 217, and the wiping member recycling module works, the base station 200 and the cleaning robot 100 do not affect each other. When separating the wiping member, the cleaning robot 100 may mount a wiping member after the wiping member recycling module completes recycling of the wiping member and the feeding module exports the wiping member, and does not need to move in the entire process. In this case, steps in which the cleaning robot 100 returns to the base station 200 to replace the wiping member are as follows:

S10: The cleaning robot 100 moves to the base station 200, to cause the obtaining unit 121 and the wiping member separating position 217 to be aligned.

S20: The cleaning robot 100 separates the wiping member.

S30: The base station 200 recycles the wiping member.

S40: The base station 200 exports a wiping member to the wiping member mounting position 215.

S50: The cleaning robot 100 mounts the wiping member.

Figure 33:
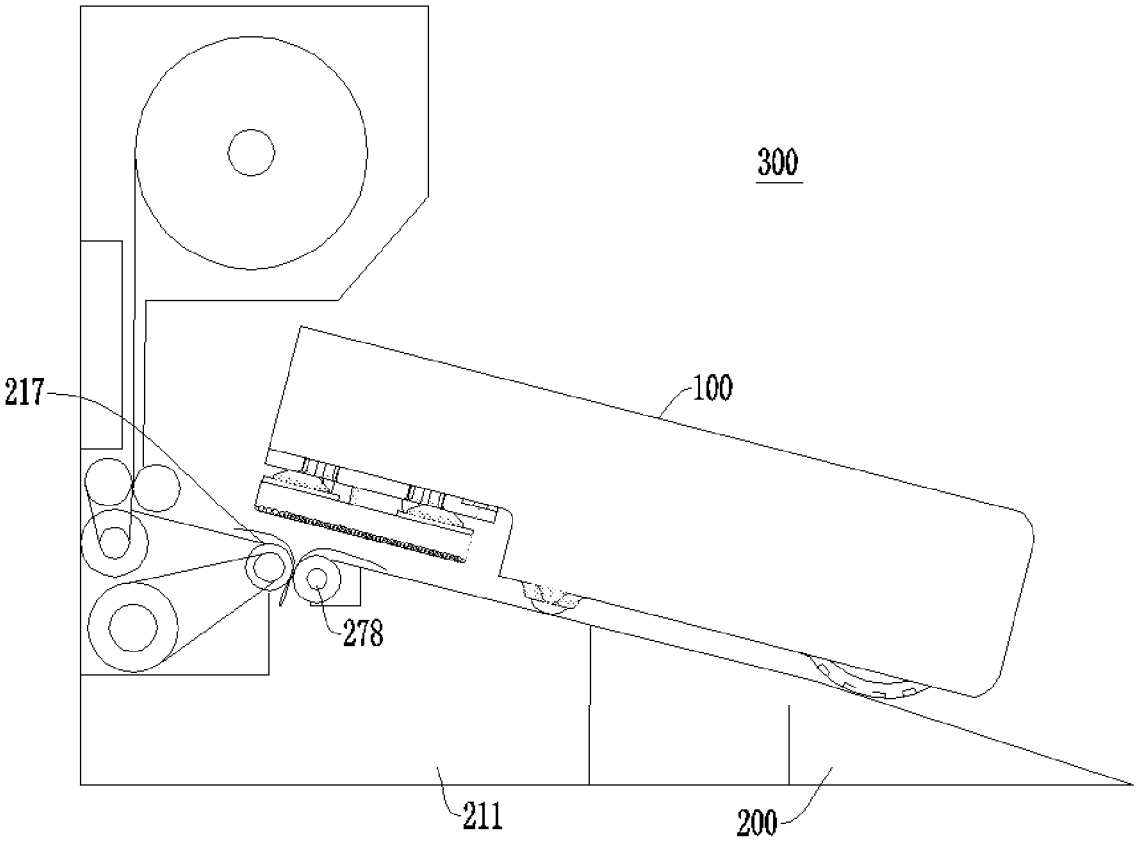
FIG. 33 is a schematic structural diagram of a fifth feasible solution of the cleaning system according to the first embodiment of the present invention.

As shown in FIG. 33, the receiving module 211 is disposed below the wiping member separating position 217, and the wiping member recycling module includes a rolling wheel assembly 278, including a driving rolling wheel driven by a motor and a driven rolling wheel driven by the driving rolling wheel to rotate. In this embodiment, the driving rolling wheel clockwise rotates, and the driven rolling wheel counterclockwise rotates. When the wiping member is at the wiping member separating position 217, the driving rolling wheel and the driven rolling wheel directly come into contact with the wiping member, and the wiping member is folded from the middle and moves downward under the action of the rolling wheel assembly 278. When the rolling wheel assembly 278 further rotates, the wiping member further drops downward into the receiving module 211. In an embodiment, the receiving module 211 is disposed below the wiping member separating position 217, and if the bottom surface of the base station 200 and the working surface of the cleaning robot 100 are on a same horizontal plane, the wiping member separating position 217 is higher than the working surface of the cleaning robot 100. Therefore, a surface at which the wiping member separating position 217 is located is an inclined surface, to help the cleaning robot 100 move from the working surface to the wiping member separating position 217. In this embodiment, the wiping member separating position 217 and the wiping member mounting position 215 are a same position, that is, after moving to the wiping member mounting position 215/wiping member separating position 217, the cleaning robot 100 may complete separating and mounting of wiping members at the same position.

Figure 34:
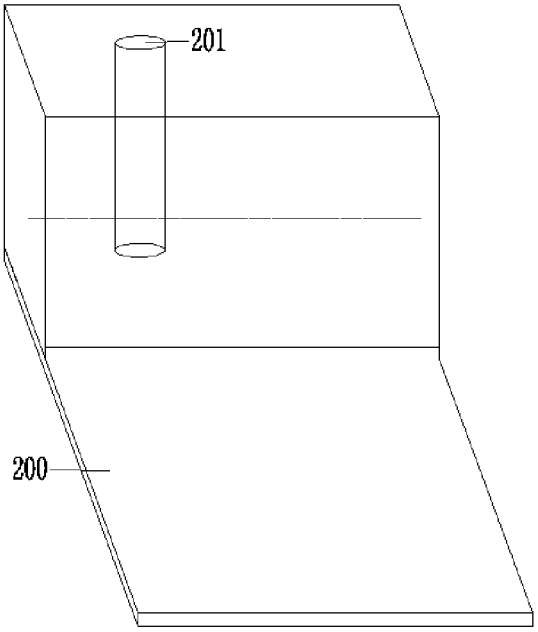
FIG. 34 and FIG. 35 are schematic partially structural diagrams of a thirteenth feasible solution of the base station.
Figure 35:
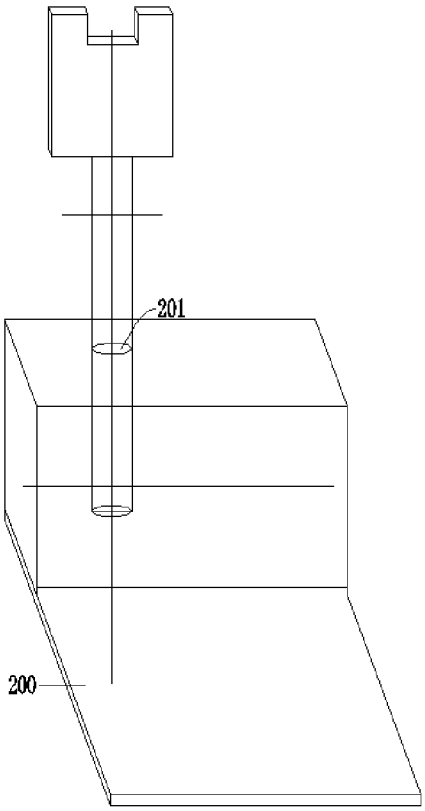

As shown in FIG. 34 and FIG. 35, the base station 200 includes an interface 201, configured to mount a hanger of a handheld vacuum cleaner, and the handheld vacuum cleaner is integrated in the base station 200 through the interface 201. For the user using the handheld vacuum cleaner or another handheld device while using the cleaning robot 100, disposition of the interface 201 can extend the storage space from the height direction, thereby improving space utilization.

Figure 36:
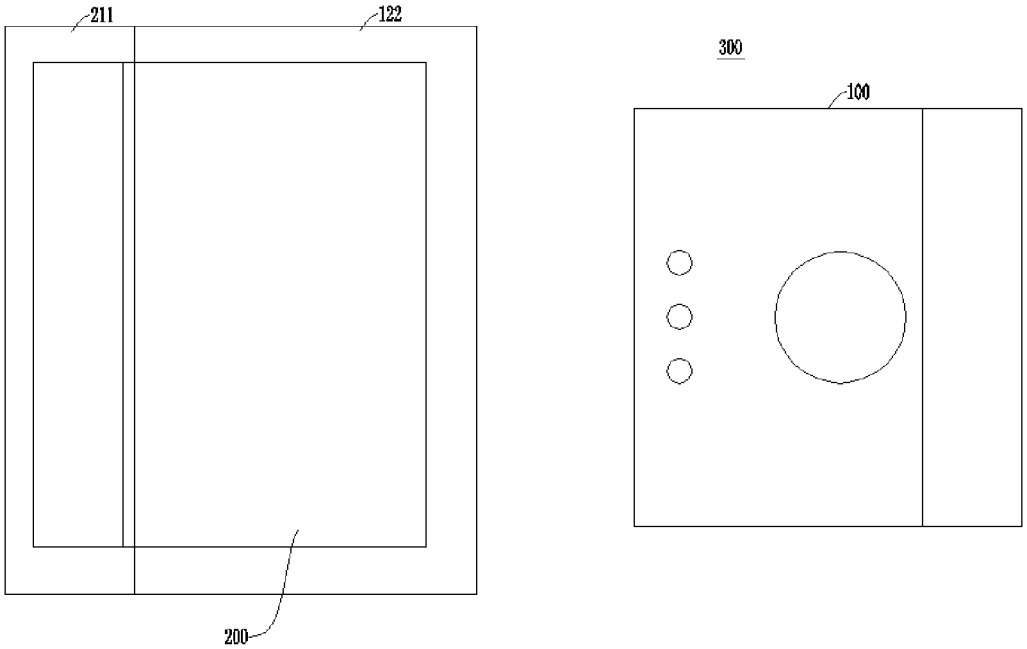
FIG. 36 is a schematic structural top view of a sixth feasible solution of the cleaning system according to the first embodiment of the present invention.

As shown in FIG. 36, the moving direction of the cleaning robot 100 is the length direction, the direction perpendicular to the working surface is the height direction, and the direction perpendicular to the length direction and the height direction is the width direction. In an embodiment, the width of the wiping board 122 is less than the width of the wiping member, to enable two sides of the wiping member in the width direction to be fixed to the wiping board 122, thereby mounting the wiping member. In other embodiments, the width of the main body 101 of the cleaning robot 100 is equal to or slightly greater than the width of the wiping board 122, to cause the width of the cleaning robot 100 to be less than the width of the wiping member, to improve compactness of the cleaning robot 100.

In an embodiment, the width of the receiving module 211 is greater than the width of the wiping member, thereby ensuring that the wiping member can be flat stored in the receiving module 211. That is to say, the width of the base station 200 is greater than the width of the wiping member. In an embodiment, the width of the cleaning robot 100 is less than the width of the base station 200.

FIG. 37A to FIG. 46L are accompanying drawings involved in a second embodiment of the present invention. Under guidance of the technical essence of the second embodiment, three different technical solutions are derived and are respectively a first solution shown in FIG. 37A to FIG. 37L, a second solution shown in FIG. 44A to FIG. 44I, and a third solution shown in FIG. 46A to FIG. 46L.

The second embodiment specifically provides a cleaning module 120 for a cleaning robot 100 to mount or carry, an operating module 400 used in cooperation with the cleaning module 120 so as to replace a wiping member for the cleaning module 120, a base station 200 including or equipped with the operating module 400, and an automatic cleaning system 300 employing or equipped with the base station 200. In a feasible embodiment, the cleaning robot 100 may be completely the same as the cleaning robot in the foregoing first embodiment, and details are not described herein.

As shown in FIG. 37A, in the first solution, the bottom of the main body 101 of the cleaning robot 100 may be provided with a connection mechanism (not shown) located between a walking wheel 110 and an auxiliary wheel 102 and configured to connect to the cleaning module 120. A lifting mechanism configured to drive the connection mechanism to move up and down and then drive the cleaning module 120 to ascend or decrease may be further disposed in the main body 101, and the lifting mechanism may have a known cam structure. The top of the main body 101 may be provided with a sounding element connected to the control module, for example, a laser scanning module, configured to detect whether there is an obstacle in front of a walking direction of the cleaning robot 100. When the sounding element detects that an obstacle exists in front of the walking direction of the cleaning robot 100, the control module controls the lifting mechanism to raise the cleaning module 120 and lower the auxiliary wheel 102. In this case, the cleaning robot 100 is in an obstacle crossing mode. After the cleaning robot 100 crosses the obstacle, the control module then controls the lifting mechanism to lower the cleaning module 120 and retract the auxiliary wheel 102. In this case, the cleaning robot 100 is in a working mode, that is, may perform cleaning work.

The connection mechanism and the cleaning module 120 are detachably connected, and after the cleaning robot 100 has worked for a specific time, the wiping member becomes dirty. In this case, the control module may control the cleaning robot 100 to move to the base station 200, and subsequently the cleaning robot 100 detaches and releases the cleaning module 120 into the base station 200. Subsequently, the base station 200 replaces the wiping member for the cleaning module 120 detached by the cleaning robot 100, which specifically includes: detaching the dirty wiping member originally carried on the cleaning module 120, and replacing the dirty wiping member with a new or clean wiping member for the cleaning module 120.

Figure 39A:
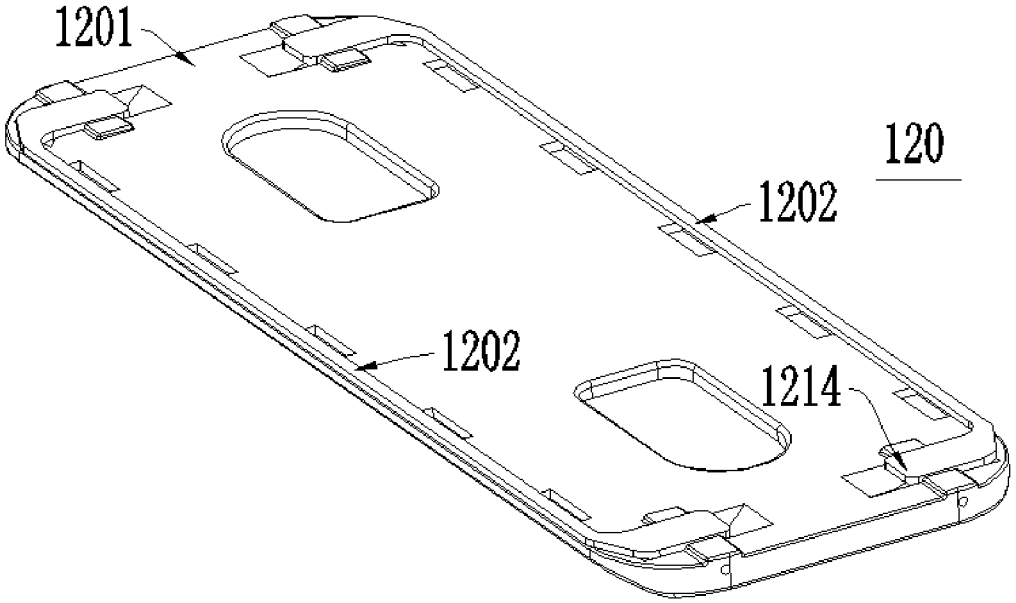
FIG. 39A and FIG. 39B are schematic structural diagrams of a loading portion in a clamped state and an opened state respectively.
Figure 39B:
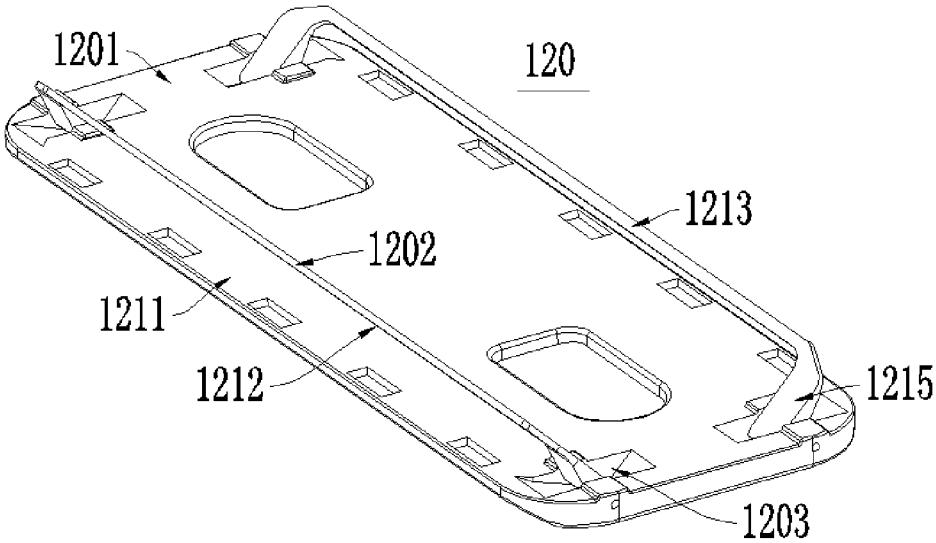

As shown in FIG. 39A and FIG. 39B, in an embodiment of the present invention, the cleaning module 120 may include a wiping board 1201 and a loading portion 1202 rotatably connected to the wiping board 1201, and the wiping member may be clamped between the wiping board 1201 and the loading portion 1202. The wiping board 1201 is substantially in a board shape, including but not limited to a rectangular board shape shown in FIG. 39A and FIG. 39B, whose lower surface may be in a smooth transition arc shape or a plane shape.

The wiping board 1201 has a first clamping surface 1211, and the loading portion 1202 has a second clamping surface 1212 opposite to the first clamping surface 1211. In an embodiment, the first clamping surface 1211 is a partial region of the upper surface of the wiping board 1201, is close to an edge of the upper surface of the wiping board 1201, extends along a long side direction of the wiping board 1201, and may be substantially in the shape of a strip-shaped region. Correspondingly, the second clamping surface 1212 is the lower surface of the loading portion 1202, and preferably is in a shape the same as or matching that of the first clamping surface 1211, namely, strip-shaped.

The loading portion 1202 may include a clamping body 1213 and a pivoting part 1215 connected to the clamping body 1213. The clamping body 1213 may be substantially in the shape of a strip-shaped rod, whose lower surface forms the second clamping surface 1212. The pivoting part 1215 and the wiping board 1201 are rotatably connected, that is, the loading portion 1202 is rotatably connected to the wiping board 1201 through the pivoting part 1215.

To improve stability of the rotatable connection between the loading portion 1202 and the wiping board 1201, one clamping body 1213 is preferably connected to more than one pivoting part 1215, for example, two or more. Two or more pivoting parts 1215 are located at a same side along an axial direction of the clamping body 1213, and all of the pivoting parts 1215 are disposed substantially perpendicular to the clamping body 1213. As shown in FIG. 39A and FIG. 39B, in a schematic embodiment, there are two pivoting parts 1215, respectively disposed on two ends of the clamping body 1213. Preferably, the pivoting parts 1215 may be formed by bending the two ends of the clamping body 1213 toward a same direction (a bending angle is about 90°). In the embodiment, the pivoting parts 1215 and the clamping body 1213 are integrally constructed, but are actually not limited thereto.

The loading portion 1202 and the wiping board 1201 are rotatably connected, and therefore the loading portion 1202 has a clamped state of clamping the wiping member and an opened state of removing clamping on the wiping member and releasing the wiping member.

As shown in FIG. 39A, when the loading portion 1202 is in the clamped state, the first clamping surface 1211 and the second clamping surface 1212 are laminated, thereby clamping the wiping member between the two clamping surfaces. In this case, the wiping member may wrap or cover the lower surface of the wiping board 1201, and has an end portion clamped between the two laminated clamping surfaces. As shown in FIG. 39B, when the loading portion 1202 is in the opened state, the first clamping surface 1211 and the second clamping surface 1212 are separated, and the original wiping member is released.

To improve the clamping strength on the wiping member, to as much as possible avoid a case that the wiping member falls off from the cleaning module 120 when the cleaning robot 100 carrying or equipped with the cleaning module 120 performs cleaning work, the cleaning module 120 may further include a clamping maintaining component, configured to apply, to the loading portion 1202, a clamping force causing the loading portion to maintain the clamped state or switch to the clamped state. The existence of the clamping force causes the loading portion 1202 to always have a trend of being in the clamped state or always have a trend of switching to the clamped state. Therefore, without an external force inverse to the clamping force, the loading portion 1202 is usually in the clamped state.

In a feasible embodiment, the clamping force may be applied through an elastic force applied by an elastic member. Specifically, the clamping maintaining component may include the elastic member disposed between the wiping board 1201 and the loading portion 1202. In this case, in the embodiment, the clamping force is the elastic force generated by the elastic member.

A solution of implementing the foregoing embodiment may be as follows: The pivoting part 1215 is rotatably connected to the wiping board 1201 through a pin shaft, the elastic member may be a tension spring sleeved on the pin shaft, two ends of the tension spring respectively butt the wiping board 1201 and the loading portion 1202, and an elastic force causing the loading portion to always rotate in a direction toward the first clamping surface 1211 of the wiping board 1201 is applied to the loading portion 1202. Specifically, as shown in FIG. 39A and FIG. 39B, the tension spring applies, to the loading portion 1202, an elastic force causing the loading portion to rotate downward or maintain the clamped state.

Alternatively, another implementable solution may be as follows: The elastic member may be an extension spring, two ends of the extension spring are respectively connected to the first clamping surface 1211 and the second clamping surface 1212, and the extension spring is always in a stretched state. Therefore, the extension spring may always apply an elastic tensile force to the loading portion 1202. To reduce occupancy of the two clamping surfaces by the extension spring and as much as possible avoid a case that obstruction or interference is formed on the wiping member, and the extension spring may be disposed on a position in the clamping body 1213 close to the end portion.

Alternatively, still another implementable solution may be as follows: The elastic member may be an elastic sheet, the elastic sheet is fixed on the wiping board 1201, and the end portion of the pivoting part 1215 butts the elastic sheet. Specifically, as shown in FIG. 39A and FIG. 39B, an avoiding groove 1203 corresponding to the pivoting part 1215 is disposed on the wiping board 1201, and a rotatable connection point between the pivoting part 1215 and the wiping board 1201 is located between two ends of the pivoting part 1215, that is, the rotatable connection point between the pivoting part 1215 and the wiping board 1201 is substantially located at a middle position of the pivoting part 1215. In this case, the clamping body 1213 and an end portion of the pivoting part 1215 with the back facing the clamping body 1213 (named as a triggering end 1214) may form a lever structure, and a supporting point of the lever structure is the rotatable connection point between the pivoting part 1215 and the wiping board 1201. The elastic sheet is disposed in the avoiding groove 1203, and the lower surface of the triggering end 1214 of the pivoting part 1215 butts the elastic sheet, so that the elastic sheet always applies an upward elastic force to the triggering end 1214. Then, according to the lever principle, the clamping body 1213 always has a trend of rotating downward or maintaining clamping the main body 101.

In the foregoing embodiment, the clamping force is applied through the elastic member (the tension spring, the extension spring, or the elastic sheet). It should be noted that, actually, any one of the foregoing three implementations may be used, or a combination of any two or all of the foregoing three implementations may be used.

Certainly, the applied clamping force is not limited to the elastic force in the foregoing embodiment. In another feasible embodiment, the clamping force may alternatively be applied through a magnetic force. Specifically, the clamping maintaining component may include a maintaining element (not shown) disposed on the first clamping surface 1211 and a matching element (not shown) disposed on the second clamping surface 1212 and corresponding to the maintaining element. One of the maintaining element and the matching element is a magnetic element and the other is a magnetizable element or magnetic element. In this case, in the embodiment, the clamping force is a magnetic attraction force generated by the maintaining element to the matching element.

The clamping force is applied through a magnetic force without the aid of a tangible physical connection component, thereby simplifying the structure.

In this embodiment, the magnetic element may be a magnetic element capable of generating a magnetic field, for example, may be a magnet with magnetism (for example, permanent magnet or hard magnet), or may be an electromagnetic element capable of generating magnetism after being powered on (for example, electromagnet). The magnetizable element may be made of a material that may be magnetized, for example, iron, cobalt, or nickel, and can be attracted by a magnetic force.

That one of the maintaining element and the matching element is a magnetic element and the other is a magnetizable element or magnetic element includes: one of the maintaining element and the matching element is a magnetic element and the other is a magnetizable element; or both the maintaining element and the matching element are magnetic elements. When both the maintaining element and the matching element are magnetic elements, polarity of the maintaining element facing the matching element and polarity of the matching element facing the maintaining element are different.

In a further preferable solution, to reduce the entire weight of the cleaning module 120, the loading portion 1202 as a whole or the clamping body 1213 is made of a magnetizable material. In this way, the loading portion 1202 itself or the clamping body 1213 forms the matching element, thereby avoiding a case that a matching element is additionally disposed on the loading portion 1202 to cause an increase in weight.

The maintaining element may be a magnet, and there is a plurality of maintaining elements evenly arranged along the length direction of the first clamping surface 1211. Therefore, the maintaining elements may evenly magnetically attract the clamping body 1213 along the length direction, and the clamping effect of the loading portion 1202 is better. A specific disposition manner may be that, the first clamping surface 1211 is depressed inward to form a plurality of accommodating grooves, and the maintaining elements are respectively disposed in the corresponding accommodating grooves. Moreover, after being placed into the accommodating grooves, the maintaining elements are preferably not higher than the first clamping surface 1211. In this way, the second clamping surface 1212 can be preferably laminated with the first clamping surface 1211, to prevent a gap from existing between the two clamping surfaces, thereby improving the clamping force on the wiping member, and ensuring the clamping effect.

The foregoing is about embodiments in which the clamping force is applied through a magnetic field. It should be noted that, the foregoing two embodiments of implementing the clamping force may be both configured in the cleaning module 120, or any one of the foregoing two embodiments may be selected and configured. That is, the clamping force may be any one of the elastic force generated by the elastic member or the magnetic attraction force generated by the maintaining element to the matching element, or may be a combination of the foregoing two forces.

To further improve the clamping strength of the loading portion 1202 on the wiping member, there may be two loading portions 1202, and the two loading portions 1202 are respectively disposed on two opposite sides of the wiping board 1201 (for example, left and right sides shown in FIG. 39A and FIG. 39B). In this way, the two ends of the wiping member may be both clamped between the first clamping surface 1211 and the second clamping surface 1212, and the clamping strength of the wiping member is relatively high.

If two loading portions 1202 are disposed, when the loading portion 1202 is in the clamped state, the cleaning module 120 as a whole presents a plane state in which the upper surface is flat (as shown in FIG. 39A). However, when the loading portion 1202 is in the opened state, outer ends (the clamping body 1213) of the two loading portions 1202 are respectively folded or lifted upward, so that the cleaning module 120 as a whole presents a state in which the upper surface is depressed inward (as shown in FIG. 39B).

With the aid of the foregoing embodiment in which the clamping force is applied and the two loading portions 1202 are symmetrically disposed, the clamping strength of the wiping member may be greatly improved, to maximally avoid a case that the wiping member falls off from the cleaning module 120 when the cleaning robot 100 carrying or equipped with the cleaning module 120 performs cleaning work.

Because the clamping force applied by the clamping maintaining component to the loading portion 1202 always exists, the loading portion 1202 is usually in the clamped state without any external force. Therefore, to cause the loading portion 1202 to switch from the clamped state to the opened state, an external force is required to overcome the clamping force. Specifically, following the foregoing description, the triggering end 1214 of the pivoting part 1215 with the back facing the clamping body 1213 may be configured to receive an external operation force. When the operation force is greater than a preset threshold, the loading portion 1202 may rotate around the rotatable connection point between the loading portion and the wiping board 1201, and switch from the clamped state to the opened state.

In this embodiment, the preset threshold is set according to a size of an arm of force. It can be known according to the lever principle F1S1=F252 that, if a distance S1 between the triggering end 1214 and a rotation supporting point, a distance S2 between the clamping body 1213 and the rotation supporting point, and a clamping force F2 applied to the clamping body 1213 are known, the operation force F1=F2S2/S1. Therefore, actually, when the external operation force applied to the triggering end 1214 reaches or exceeds this preset threshold F2S2/S1, the loading portion 1202 may be opened.

Further, to enable the triggering end 1214 to be smoothly opened under the action of an external operation force, the avoiding groove 1203 corresponding to the pivoting part 1215 is disposed on the wiping board 1201. As shown in FIG. 39A, when the clamping member in the clamped state, the triggering end 1214 is at least partially located outside the avoiding groove 1203, to facilitate cooperation between an external component (which is specifically a top protrusion 404 mentioned below) and the triggering end 1214. When the external operation force exceeds the preset threshold, the loading portion 1202 is opened, and the triggering end 1214 rotates downward, to enter the avoiding groove 1203. In this way, the wiping board 1201 is prevented from forming obstruction or interference on the triggering end 1214, to ensure that the loading portion 1202 can be smoothly rotated and opened. Moreover, by disposing the avoiding groove 1203, the pivoting part 1215 may be at least partially accommodated in the avoiding groove when the loading portion 1202 is in the clamped state, thereby causing the upper surface of the cleaning module 120 to be as flat as possible, to facilitate assembling of the cleaning module 120 and the cleaning robot 100.

As shown in FIG. 40 to FIG. 43C, an operating module 400 configured to replace a wiping member for the foregoing cleaning module 120 and provided in this embodiment of the present invention may include: a supporting framework 401 configured to separably attach to the wiping board 1201 of the cleaning module 120, a first movable mechanism 402 disposed on the supporting framework 401, and a power mechanism 410 configured to drive the first movable mechanism 402 to move inward or outward along a first direction L1 on the supporting framework 401.

When the wiping board 1201 of the cleaning module 120 attaches to the supporting framework 401, the loading portion 1202 is in the opened state, and the first movable mechanism 402 can move inward along the first direction L1 under the driving of the power mechanism 410, to push the wiping member to the first clamping surface 1211 of the wiping board 1201. When the cleaning module 120 and the supporting framework 401 are separated, the loading portion 1202 switches to the clamped state.

Figure 40:
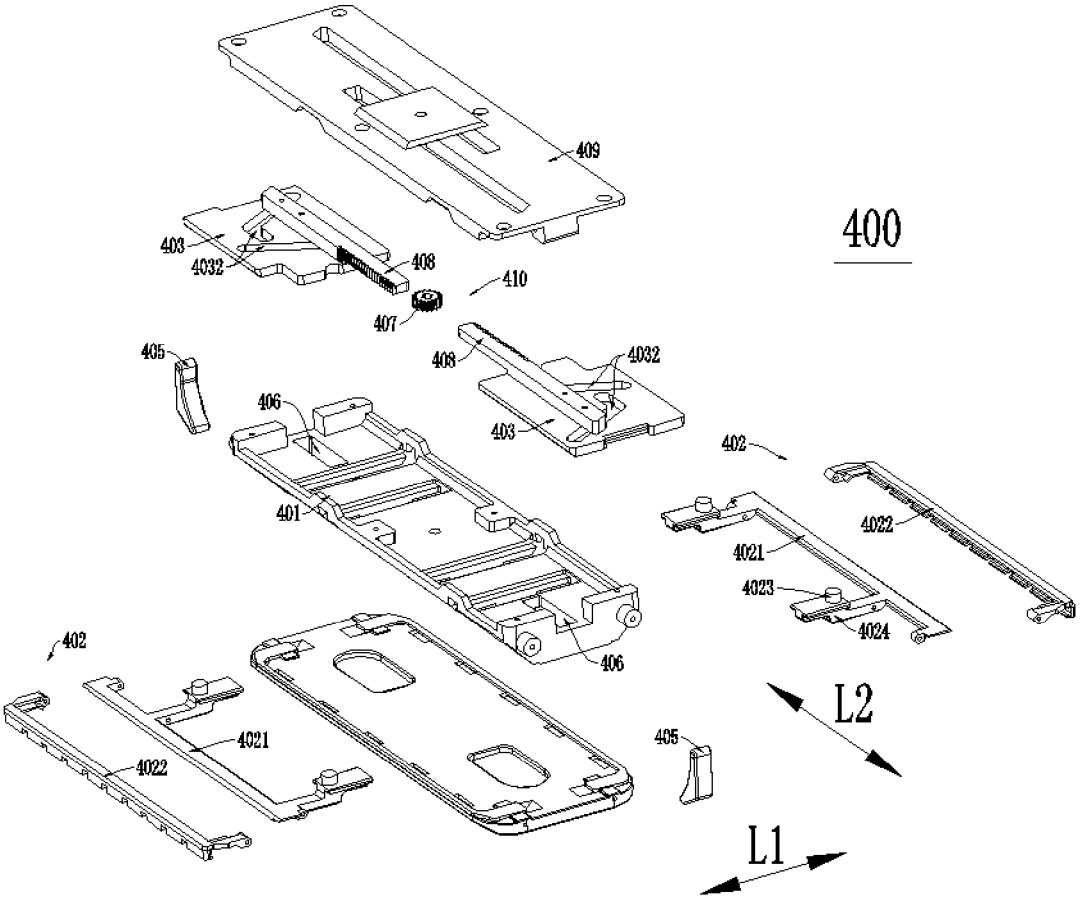
FIG. 40 is a schematic structural exploded view of assembling an operating module and a cleaning module.

In this embodiment, the supporting framework 401 may be substantially in a board shape similar to the shape of the wiping board 1201 of the cleaning module 120, and similarly includes but not limited to the rectangular board shape shown in FIG. 40. The first movable mechanism 402 is disposed on the supporting framework 401, and may move inward or outward along the first direction L1 on the supporting framework 401 under the driving of the power mechanism 410. The first direction L1 is an arrow direction shown by L1 in FIG. 40, or is a horizontal left-right direction shown in FIG. 41A, FIG. 41C, FIG. 42A, FIG. 42C, FIG. 43A, and FIG. 43C. "move inward" means that the first movable mechanism 402 moves in a direction close to the inside or center of the supporting framework 401, and "move outward" means that the first movable mechanism 402 moves in a direction far away from the inside or center of the supporting framework 401. The foregoing explanations are similarly applicable to the following second movable mechanism 403.

When being driven to move inward, the first movable mechanism 402 may push a new or clean wiping member to the first clamping surface 1211 of the wiping board 1201, and therefore a quantity of first movable mechanisms should match or be equal to a quantity of loading portions 1202. In the foregoing case that there are preferably two loading portions 1202, the quantity of first movable mechanisms 402 is also preferably two, and the two first movable mechanisms 402 are disposed on two opposite sides of the supporting framework 401 along the first direction L1, which are specifically left and right sides shown in FIG. 40, FIG. 41A, FIG. 41C, FIG. 42A, FIG. 42C, FIG. 43A, and FIG. 43C. Moreover, the two first movable mechanisms 402 are preferably symmetrically disposed.

As shown in FIG. 40, in a feasible embodiment, the first movable mechanism 402 may include a translation member 4021 and a raking member 4022 rotatably connected to the translation member 4021. The power mechanism 410 may drive the translation member 4021 to move along the first direction L1, and the translation member 4021 then drives the raking member 4022 to move. The translation member 4021 and the raking member 4022 may be substantially in a strip rod shape and are disposed substantially in parallel, two ends of the raking member 4022 are provided with connection ears extending toward the translation member 4021, and the raking member 4022 are rotatably connected to two ends of the translation member 4021 through the two connection ears. The outer end of the raking member 4022 is provided with a hook-shaped structure bending inward, to better come into contact with the wiping member, to push the wiping member to the wiping board 1201.

The manner in which the first movable mechanism 402 is driven to move may be direct driving by the power mechanism 410, or may be indirect or passive driving through linkage with the following second movable mechanism 403. The indirect or passive driving through linkage with the second movable mechanism 403 is introduced below, and the manner of direct driving by the power mechanism is introduced herein.

When there is one first movable mechanism 402, the power mechanism 410 may directly drive the first movable mechanism 402 to move inward or outward. In this case, in the embodiment, the power mechanism 410 may be an air cylinder, a hydraulic cylinder, or the like, or a manner in which a motor to drive a gear to be meshed with a rack disposed on the first movable mechanism 402 may be used for the power mechanism 410.

However, when there are two first movable mechanisms 402, the two first movable mechanisms 402 need to move outward or inward simultaneously. Therefore, two power mechanisms may respectively drive the two first movable mechanisms 402 to move outward or inward simultaneously, and for a specific implementation, reference may be made to the foregoing embodiment. Alternatively, one power mechanism may drive the two first movable mechanisms 402 to move outward or inward simultaneously. Specifically, racks are respectively disposed on the two first movable mechanisms 402, the two racks are meshed with a same gear, and the two racks are located at two opposite sides of the gear.

Further, to cause the wiping board 1201 of the cleaning module 120 to attach to the supporting framework 401, the loading portion 1202 switches from the clamped state to the opened state. As shown in FIG. 43C, the supporting framework 401 may be provided with a top protrusion 404, and the top protrusion 404 may be formed by downward protruding of the bottom of the supporting framework 401. When the cleaning module 120 attaches to the supporting framework 401, the top protrusion 404 may butt the triggering end 1214 of the pivoting part 1215. Therefore, the loading portion 1202 is opened, and the dirty wiping member is released.

Actually, after the top protrusion 404 butts the triggering end 1214, the external force still needs to be applied to the cleaning module 120, to open the loading portion 1202, and a specific process is introduced below. After the loading portion 1202 is opened, to enable the new wiping member to be mounted on the cleaning module 120, the cleaning module 120 still needs to attach to the supporting framework 401.

To achieve the objective, the cleaning module 120 may similarly attach to the supporting framework 401 with the aid of a magnetic force. Specifically, the wiping board 1201 of the cleaning module 120 may be provided with a first attaching element (not shown), and the supporting framework 401 may be provided with a second attaching element (not shown) corresponding to the first attaching element. Specifically, the first attaching element is disposed on the upper surface of the wiping board 1201, and the second attaching element is disposed on the lower surface of the supporting framework 401. One of the first attaching element and the second attaching element is a magnetic element and the other is a magnetizable element or magnetic element. For the magnetizable element and the magnetic element, reference may be made to the foregoing explanations, and details are not described herein. The first attaching element may generate a magnetic attraction force to the second attaching element, to cause the cleaning module 120 to maintain attachment between the cleaning module and the supporting framework 401.

After the cleaning module 120 completes replacement of the wiping member, the cleaning module 120 and the supporting framework 401 need to be separated. For this reason, the supporting framework 401 may be rotatably provided with a separating member 405, and the separating member 405 has a received state of being received in the supporting framework 401, and an extending state of causing the outer end of the separating member to extend out of the supporting framework 401. When the separating member 405 is in the received state, the cleaning module 120 attaches to the supporting framework 401; and when the separating member 405 switches to the extending state, the separating member 405 butts the wiping board 1201 of the cleaning module 120 to cause the wiping board and the supporting framework 401 to be separated.

As shown in FIG. 40, FIG. 41B, FIG. 42B, and FIG. 43B, a position in the supporting framework 401 close to the end portion is provided with a through-hole 406, and the upper end of the separating member 405 may be rotatably connected to the inner wall of the through-hole 406 through a pin shaft. The lower end surface of the separating member 405 may be in a smooth transition arc shape, and when the separating member 405 gradually switches from the received state to the extending state, a distance that the lower end surface of the separating member 405 stretches out the supporting framework 401 is gradually increased, thereby gradually increasing a force applied to the wiping board 1201 of the cleaning module 120, and finally pushing the wiping board 1201 away.

Further, a reset member may be disposed between the separating member 405 and the supporting framework 401, and the reset member applies, to the separating member 405, a reset force causing the separating member to maintain the received state or switch to the received state. In this embodiment, the reset member may be a tension spring, sleeved on the pin shaft, to apply, to the separating member 405, a force causing the separating member to receive inward, so that the separating member 405 is receiving in the supporting framework 401 without any external force.

To drive the separating member 405 to switch to the extending state, a second movable mechanism 403 is disposed on the supporting framework 401, and when the first movable mechanism 402 moves inward or outward along the first direction L1, the second movable mechanism 403 correspondingly moves outward or inward along a second direction L2, and the second direction L2 and the first direction L1 are substantially perpendicular. Specifically, when the first movable mechanism 402 moves inward along the first direction L1, the second movable mechanism 403 correspondingly moves outward along the second direction L2. Similarly, when the first movable mechanism 402 moves outward along the first direction L1, the second movable mechanism 403 correspondingly moves inward along the second direction L2. The second direction L2 is an arrow direction shown by L2 in FIG. 40, or is a vertical up-down direction shown in FIG. 41A, FIG. 41B, FIG. 42A, FIG. 42B, FIG. 43A, and FIG. 43B.

The separating member 405 is located at the outer side of the second movable mechanism 403 along the second direction L2. As shown in FIG. 42B and FIG. 43B, when the second movable mechanism 403 moves outward along the second direction L2, the second movable mechanism 403 pushes the separating member 405 to switch from the received state to the extending state. Specifically, when moving outward, the second movable mechanism 403 gradually approaches the separating member 405, and finally comes into contact with the separating member 405. When the second movable mechanism 403 continues to move outward, the separating member 405 is pushed to rotate, to cause the lower end of the separating member to gradually stretch out from the supporting framework 401. The lower end of the separating member 405 stretching out butts the wiping board 1201 of the cleaning module 120, and as the length of the lower end of the separating member 405 stretching out is increased, the force of the separating member 405 butting the wiping board 1201 is also gradually increased, to finally overcome a magnetic attraction force between the first attaching element and the second attaching element, to cause the wiping board 1201 and the supporting framework 401 to be separated.

Certainly, an implementation of attachment and separation between the wiping board 1201 and the supporting framework 401 is not limited to the foregoing embodiment. In another feasible embodiment, it may be unnecessary to dispose the separating member 405 and the second movable mechanism 403, and the foregoing objective may be achieved only in dependence on changes of the first attaching element and the second attaching element.

Specifically, one of the first attaching element and the second attaching element is an electromagnetic element, and the other is a magnetic element or magnetizable element. For example, the first attaching element is an electromagnetic element, and the second attaching element is a magnetic element or magnetizable element; or the second attaching element is an electromagnetic element, and the first attaching element is a magnetic element or magnetizable element. When the electromagnetic element is powered on, a magnetic field may be generated, thereby adsorbing the second attaching element, to cause the wiping board 1201 to attach to the supporting framework 401, and subsequently, a replacement operation of the wiping member may be performed. After replacement of the wiping member is completed, the electromagnetic element is powered off, the magnetic field disappears, and the wiping board 1201 falls under the action of gravity, to naturally separate from the supporting framework 401.

In this embodiment, the second movable mechanism 403 is formed by a board-shaped structure. Moreover, there are also preferably two second movable mechanisms 403, disposed on two other opposite sides of the supporting framework 401 along the second direction L2, which are specifically upper and lower sides shown in FIG. 40, FIG. 41A, FIG. 41B, FIG. 42A, FIG. 42B, FIG. 43A, and FIG. 43B. Moreover, the two first movable mechanisms 402 are preferably symmetrically disposed.

Figure 41A:
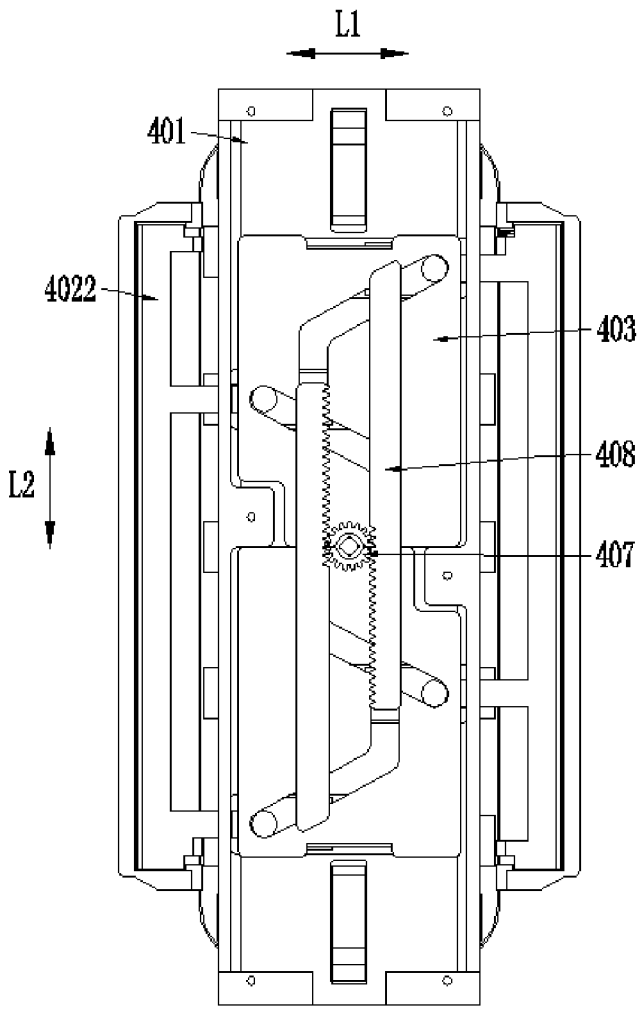
Figure 42A:
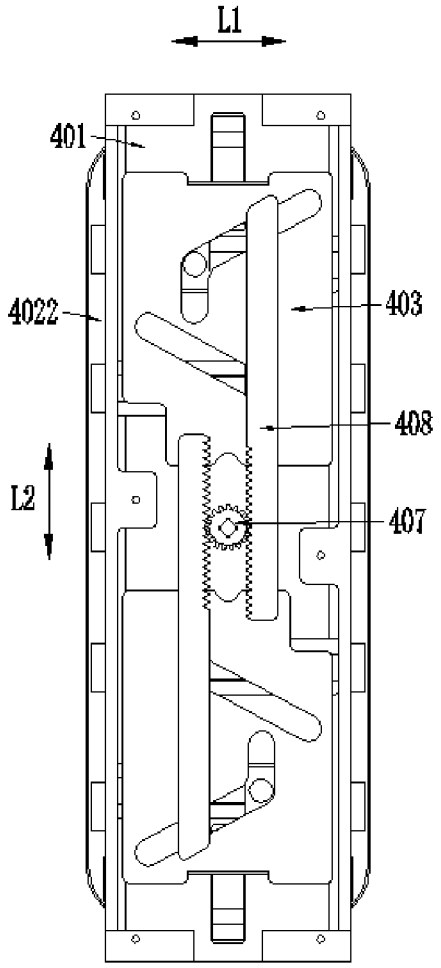
Figure 42B:
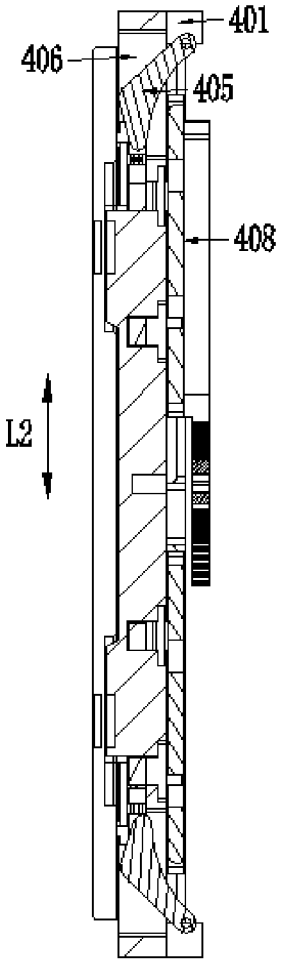
Figure 43A:
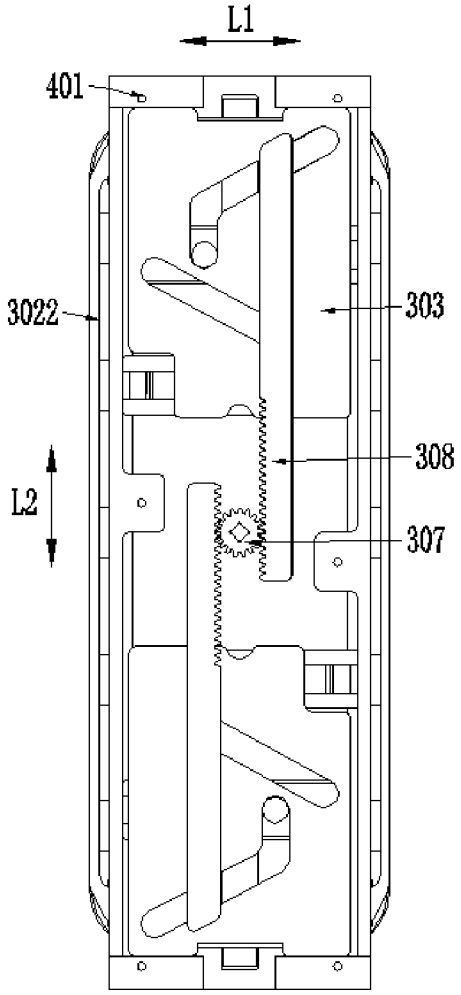
Figure 43B:
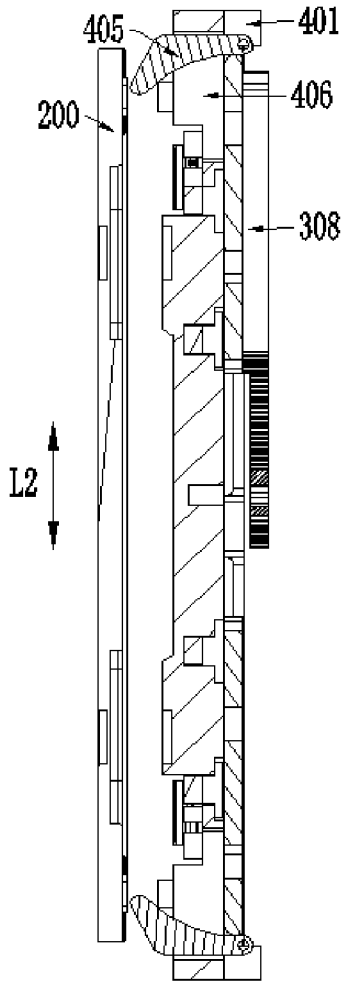
Figure 43C:
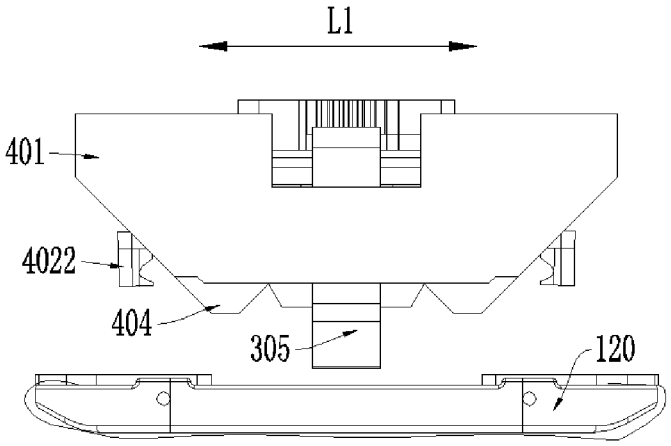

To enable one power mechanism 410 to drive two movable mechanisms simultaneously, with reference to FIG. 41A, FIG. 42A and FIG. 43A, the first movable mechanism 402 is provided with a first contour tracing portion 4023, the second movable mechanism 403 is provided with a second contour tracing portion 4032, and the second contour tracing portion 4032 and the first contour tracing portion 4023 cooperate. The cooperation between the first contour tracing portion 4023 and the second contour tracing portion 4032 is used for conveying a driving power from one movable mechanism to the other movable mechanism. When one of the two movable mechanisms moves inward or outward along a direction corresponding to the one movable mechanism, the other movable mechanism moves outward or inward along a direction corresponding to the other movable mechanism under the action of the cooperation between the first contour tracing portion 4023 and the second contour tracing portion 4032.

In an embodiment, one of the first contour tracing portion 4023 and the second contour tracing portion 4032 is a sliding groove, and the other is a protrusion inserted into the sliding groove. In the embodiment shown in FIG. 40, the first contour tracing portion 4023 is a protrusion, and the second contour tracing portion 4032 is a sliding groove. A specific disposition manner is that the first movable mechanism 402 is disposed between the supporting framework 401 and the second movable mechanism 403, that is, the first movable mechanism 402 is located at a lower layer and the second movable mechanism 403 is located at an upper layer. Two support arms 4024 are disposed on the translation member 4021 of the first movable mechanism 402, and one protrusion is disposed on each support arm 4024. Correspondingly, two sliding grooves are disposed on the second movable mechanism 403. When one of the movable mechanisms is driven by the power mechanism to move, cooperation between the protrusion and the sliding groove causes the other movable mechanism to be driven to move.

As shown in FIG. 41A, FIG. 42A, and FIG. 43A, the sliding groove is segmented, and includes two segments: a tilt segment and a straight segment, and the straight segment and an inner end of the tilt segment are connected. The tilt segment tilts outward along the second direction L2, and the straight segment and the second direction L2 are parallel.

In an embodiment, the power mechanism 410 may include a gear 407 driven by a motor to rotate, and a rack 408 meshed with the gear 407, and the rack 408 is disposed on the first movable mechanism 402 or the second movable mechanism 403. If there two first movable mechanisms 402 and two second movable mechanisms 403, one power mechanism 410 is used for causing the two movable mechanisms to move inward or outward simultaneously, and there are two racks 408, respectively disposed on the two first movable mechanisms 402 or the two second movable mechanisms 403. Moreover, the two racks 408 are located at two sides of the gear 407.

Two manners in which the power mechanism drives the two movable mechanisms simultaneously are included, and are respectively as follows:

(First) The power mechanism directly drives the first movable mechanism 402 to move along the first direction L1, and movement of the first movable mechanism 402 drives, through cooperation between the first contour tracing portion 4023 and the second contour tracing portion 4032, the second movable mechanism 403 to move along the second direction L2. That is, the first movable mechanism 402 is directly driven by the power mechanism 410 to move, and the second movable mechanism 403 is indirectly driven by the power mechanism 410 through cooperation between the first contour tracing portion 4023 and the second contour tracing portion 4032 to move.

(Second) The power mechanism 410 directly drives the second movable mechanism 403 to move along the second direction L2, and movement of the second movable mechanism 403 drives, through cooperation between the first contour tracing portion 4023 and the second contour tracing portion 4032, the first movable mechanism 402 to move along the first direction L1. That is, the second movable mechanism 403 is directly driven by the power mechanism 410 to move, and the first movable mechanism 402 is indirectly driven by the power mechanism 410 through cooperation between the first contour tracing portion 4023 and the second contour tracing portion 4032 to move.

The embodiment shown in FIG. 40, FIG. 41A, FIG. 42A, and FIG. 43A is the foregoing (second) manner, and a process in which the power mechanism 410 drives two movable mechanisms simultaneously is introduced below with reference to FIG. 40, FIG. 41A, FIG. 42A, and FIG. 43A.

In the schematic embodiment, the first movable mechanism 402 is disposed on the supporting framework 401, and the second movable mechanism 403 is disposed on the first movable mechanism 402, that is, the first movable mechanism 402 and the second movable mechanism 403 are sequentially disposed on the supporting framework 401 from bottom to top. There are two first movable mechanisms 402 and two second movable mechanisms 403, the first contour tracing portion 4023 is a protrusion, and the second contour tracing portion 4032 is a sliding groove. One rack 408 is disposed on each second movable mechanism 403, the gear 407 is meshed with the two racks 408, and the two racks 408 are respectively disposed on two opposite sides of the gear 407. When being driven by the motor to rotate, the gear 407 drives the two racks 408 disposed oppositely to move, to further drive the second movable mechanisms 403 to move face to face (inward) or back to back (outward). However, with the aid of cooperation between the protrusion and the sliding groove, the first movable mechanism 402 is correspondingly driven to move back to back (outward) or face to face (inward).

To implement the foregoing (first) driving manner, based on the foregoing schematic embodiment, disposition positions of the first movable mechanism 402 and the second movable mechanism 403 may be exchanged, the first contour tracing portion 4023 and the second contour tracing portion 4032 may be the same as or opposite to those in the foregoing embodiment, and the rack 408 may be disposed on the first movable mechanism 402. Correspondingly, when being driven by the motor to rotate, the gear 407 drives the two racks 408 disposed oppositely to move, to further drive the first movable mechanisms 402 to move face to face (inward) or back to back (outward). However, with the aid of cooperation between the protrusion and the sliding groove, the second movable mechanism 403 is correspondingly driven to move back to back (outward) or face to face (inward).

Furthermore, the supporting framework 401 may be further provided with a top cover 409, and the top cover 409 covers the two movable mechanisms. The top cover 409 is provided with a strip-shaped hole, and the rack 408 is accommodated in the strip-shaped hole and configured to guide and right movement of the rack 408. Moreover, a motor configured to drive the gear 407 may be disposed on the top cover 409.

A process in which the operating module 400 of this embodiment of the present invention replaces a new or clean wiping member 600 for the cleaning module 120 is described below with reference to FIG. 41A to FIG. 43C.

Figure 41B:
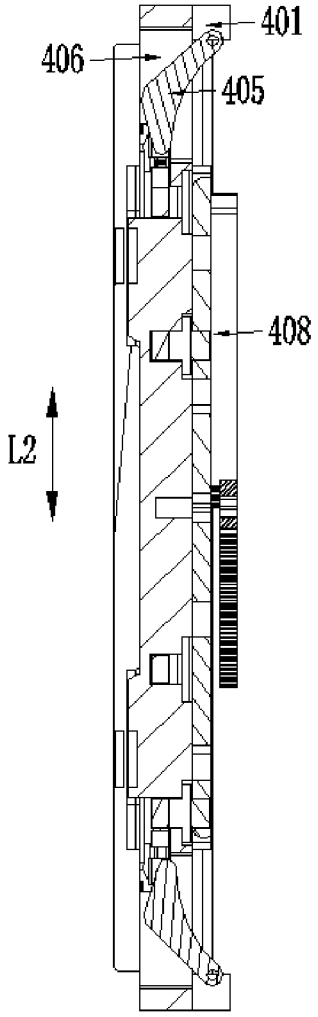
Figure 41C:
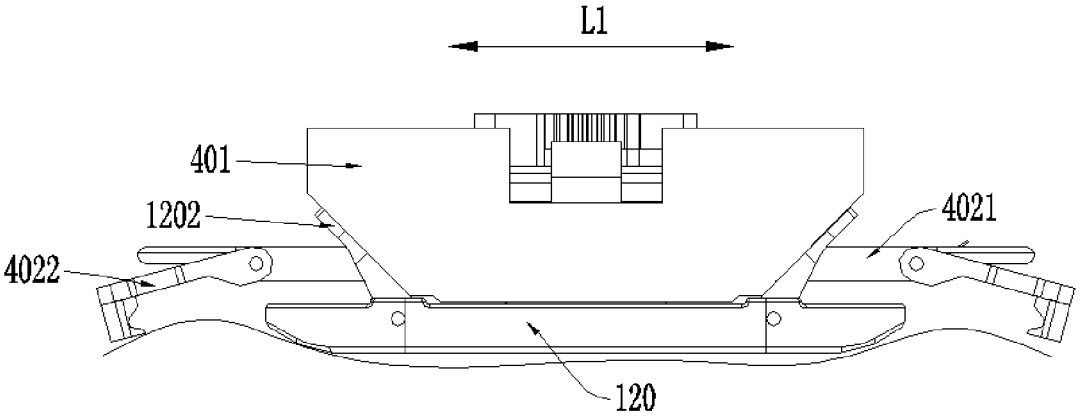

As shown in FIG. 41A to FIG. 41C, through magnetic attraction between the first attaching element and the second attaching element, the wiping board 1201 of the cleaning module 120 is attached to the bottom of the supporting framework 401. The top protrusion 404 disposed at the bottom of the supporting framework 401 butts the triggering end 1214 of the pivoting part 1215, the pivoting part 1215 rotates upward, and the loading portion 1202 is opened. The gear 407 is driven to rotate forward, namely, clockwise rotate, as shown in FIG. 41A, a left rack 408 is driven to move upward, and a right rack 408 is driven to move downward. Correspondingly, the lower second movable mechanism 403 moves upward, and the upper second movable mechanism 403 moves downward. That is, the two second movable mechanisms 403 move inward. Meanwhile, under the action of cooperation between the protrusion and the tilt segment of the sliding groove, the left first movable mechanism 402 moves leftward, and the right first movable mechanism 402 moves rightward. That is, the two second movable mechanisms 403 move outward.

Figure 42C:
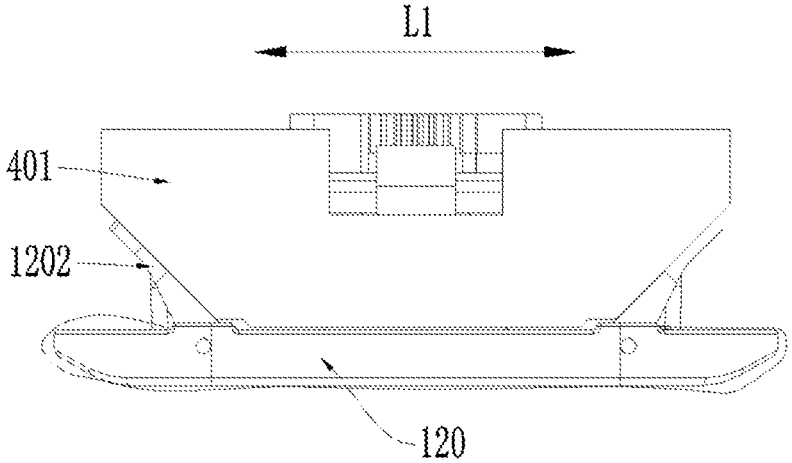

As shown in FIG. 42A to FIG. 42C, the gear 407 is driven to rotate reversely, namely, counterclockwise rotate, as shown in FIG. 42A, a left rack 408 is driven to move downward, and a right rack 408 is driven to move upward. Correspondingly, the lower second movable mechanism 403 moves downward, and the upper second movable mechanism 403 moves upward. That is, the two second movable mechanisms 403 move outward. Meanwhile, under the action of cooperation between the protrusion and the tilt segment of the sliding groove, the left first movable mechanism 402 moves rightward, and the right first movable mechanism 402 moves leftward. That is, the two second movable mechanisms 403 move inward. Therefore, two ends of the wiping member 600 are pushed to the first clamping surface 1211 of the wiping board 1201, and the lower end of the second movable mechanism 403 presses the end portion of the wiping member 600 on the first clamping surface 1211 of the wiping board 1201, until the protrusion moves to a junction of the tilt segment and the straight segment of the sliding groove.

As shown in FIG. 43A to FIG. 43C, the gear 407 is driven by the motor to continue to rotate reversely. In this case, the protrusion enters the straight segment of the sliding groove and butts a bottom wall of the straight segment. In this case, the second movable mechanism 403 continues to move outward, and the first movable mechanism 402 does not continue to move inward again. Subsequently, the second movable mechanism 403 butts the separating member 405, and the separating member 405 stretches out from the supporting framework 401 and pushes the wiping board 1201 away. Therefore, the cleaning module 120 is separated from the supporting framework 401, and falls under the action of its own gravity. Under the action of the maintaining element and the matching element, the loading portion 1202 of the cleaning module 120 rotates downward, and switches to the clamped state, to clamp the wiping member 600.

With reference to the foregoing description, a process in which the operating module 400 detaches a dirty wiping member for the cleaning module 120 is opposite to the foregoing process, and details are not described herein again.

The operating module 400 of this embodiment of the present invention is disposed on the base station 200, and the base station 200 is used for the cleaning robot 100 to park in and configured to replace a cleaning module for the cleaning module 120 detached from the cleaning robot 100.

As shown in FIG. 37A to FIG. 37L, the base station 200 of this embodiment of the present invention may include a casing 202, and the casing 202 may be provided with an access (not shown) for the cleaning robot 100 to enter or leave. The bottom of the casing 202 is provided with a wiping member operating position 2023, and a wiping board tray 203 is located at the wiping member operating position 2023. The cleaning robot 100 drives into the base station 200 through the access, and unloads the dirty cleaning module 120 onto the wiping board tray 203 located on the wiping member operating position 2023. After the operating module 400 completes replacement of the wiping member, and when a new cleaning module 120 is about to reach the wiping member operating position 2023, the cleaning robot 100 mounts the new cleaning module.

The operating module 400 is disposed in the casing 202, and is located at a predetermined height in the casing 202. Moreover, the wiping board tray 203 configured to bear the cleaning module 120 and located below the operating module 400, a supply module 204 configured to provide a wiping member to the cleaning module 120, and a pulling mechanism 205 configured to pull the wiping member provided in the supply module 204 to the cleaning module 120 are further disposed in the casing 202.

The supply module 204 is substantially located above or obliquely above the operating module 400, and may include a winding shaft and a wiping member wound around the winding shaft, and the winding shaft is rotatably disposed on the inner wall of the casing 202. The supply module 204 may further include at least one pair of pushing rolling wheels 2041, the pair of pushing rolling wheels 2041 are oppositely disposed, there is a gap for the wiping member to pass through between the two pushing rolling wheels, and the two pushing rolling wheels are driven by the motor to rotate face to face, thereby pushing the wiping member forward or backward. "forward" is a direction departing from the winding shaft, and "backward" is a direction pointing to the winding shaft.

The pulling mechanism 205 may include a delivery member 2051 and a friction member 2052 disposed on the delivery member 2051. As shown in FIG. 37A to FIG. 37L, the delivery member 2051 may be a synchronization belt substantially winding in the horizontal direction, and is substantially located at a same height as the operating module 400. A position in the casing 202 close to each of left and right ends is provided with one delivery wheel, the synchronization belt winds around the two delivery wheels, and one of the delivery wheels is driven by the motor to actively rotate, to further drive the synchronization belt to move. The synchronization belt may substantially include an upper segment and a lower segment that are parallel, and the friction member 2052 is disposed on the lower segment of the synchronization belt. The friction member 2052 may be specifically a structure having hairbrushes, and includes a block-shaped body disposed on the synchronization belt and the hairbrushes disposed on upper and lower surfaces of the block-shaped body. Therefore, contact friction with the wiping member may be increased, and then the wiping member may be driven to move accordingly.

The delivery member 2051 may drive the friction member 2052 to reciprocate between a first position and a second position. The first position and the second position are two limit positions of movement of the friction member 2052, and may be specifically positions respectively close to the left and right delivery wheels. Specifically, the first position may be a position of the friction member 2052 shown in FIG. 37A, and the second position may be a position of the friction member 2052 shown in FIG. 37G.

Moreover, the operating module 400 is located between the first position and the second position, and specifically a projection of the operating module 400 onto the delivery member 2051 may be located between the first position and the second position. In this way, when moving between the first position and the second position, the friction member 2052 may pass through the operating module 400, so as to remove the dirty wiping member detached from the cleaning module 120 adsorbed on the operating module 400, and may pull the new or clean wiping member provided by the supply module 204 to the cleaning module 120, for the cleaning module 120 to mount.

Specifically, when the delivery member 2051 drives the friction member 2052 to move from the first position to the second position, that is, move from left to right, as shown in FIG. 37A to FIG. 37L, the friction member 2052 may come into contact with the dirty wiping member falling onto the wiping board tray 203, and pull the dirty wiping member toward the second position. Specifically, referring to FIG. 37F, in this case, the wiping board tray 203 is located below the operating module 400, and is slightly lower than the friction member 2052. When the friction member 2052 moves toward the second position and passes through the wiping board tray 203, the hairbrush on the lower surface of the friction member 2052 comes into contact with the dirty wiping member falling onto the wiping board tray 203, thereby sweeping the dirty wiping member toward the second position, and finally moving the dirty wiping member out of the wiping board tray 203.

Figure 37B:
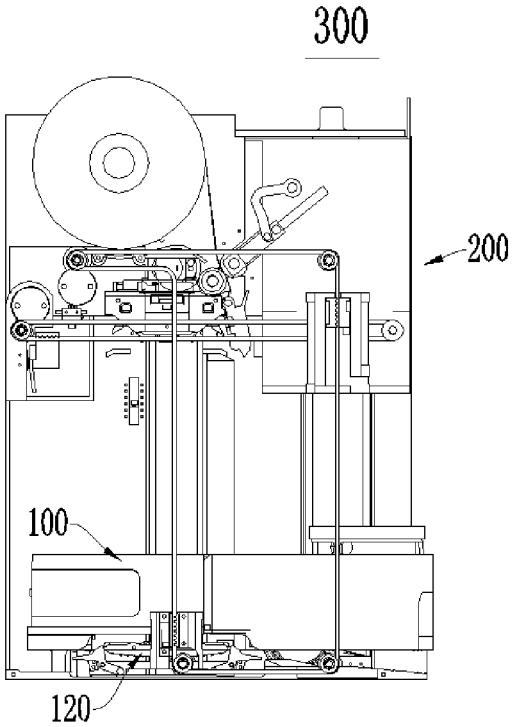
Figure 37C:
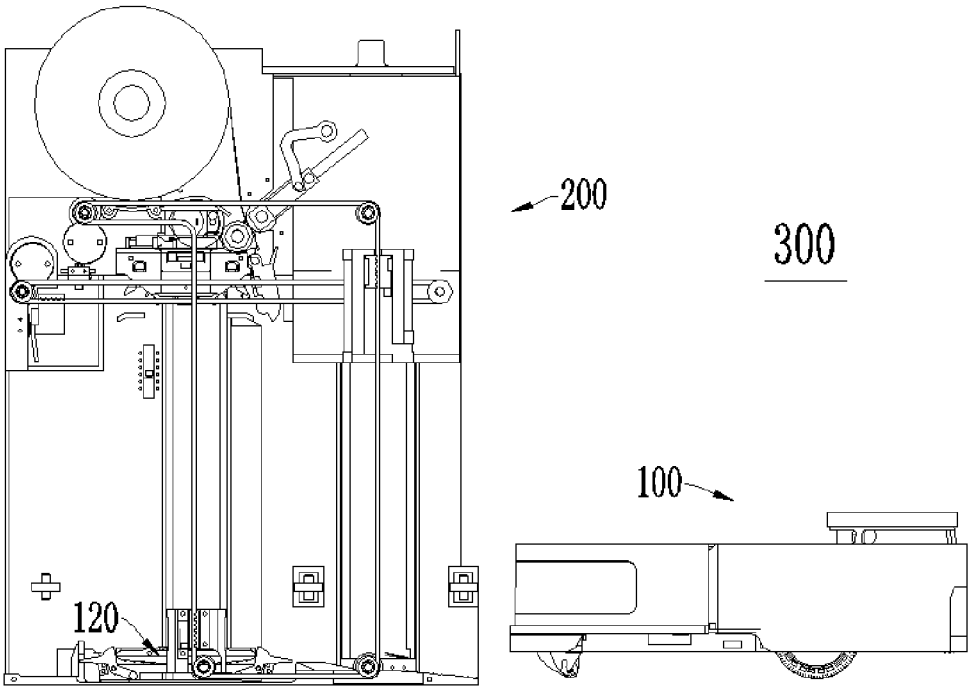
Figure 37D:
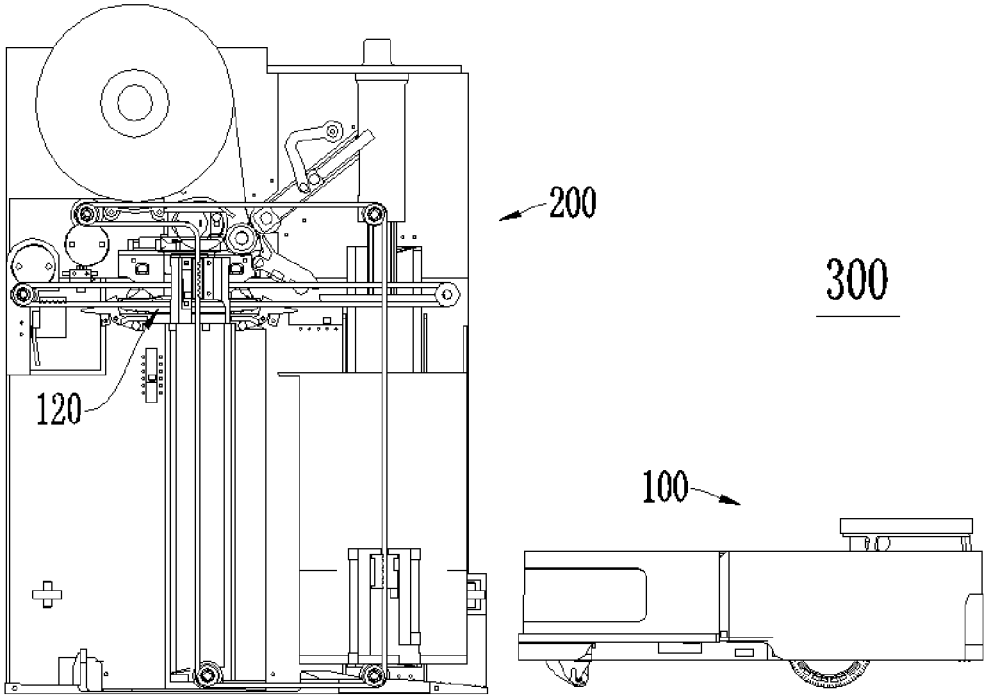
Figure 37E:
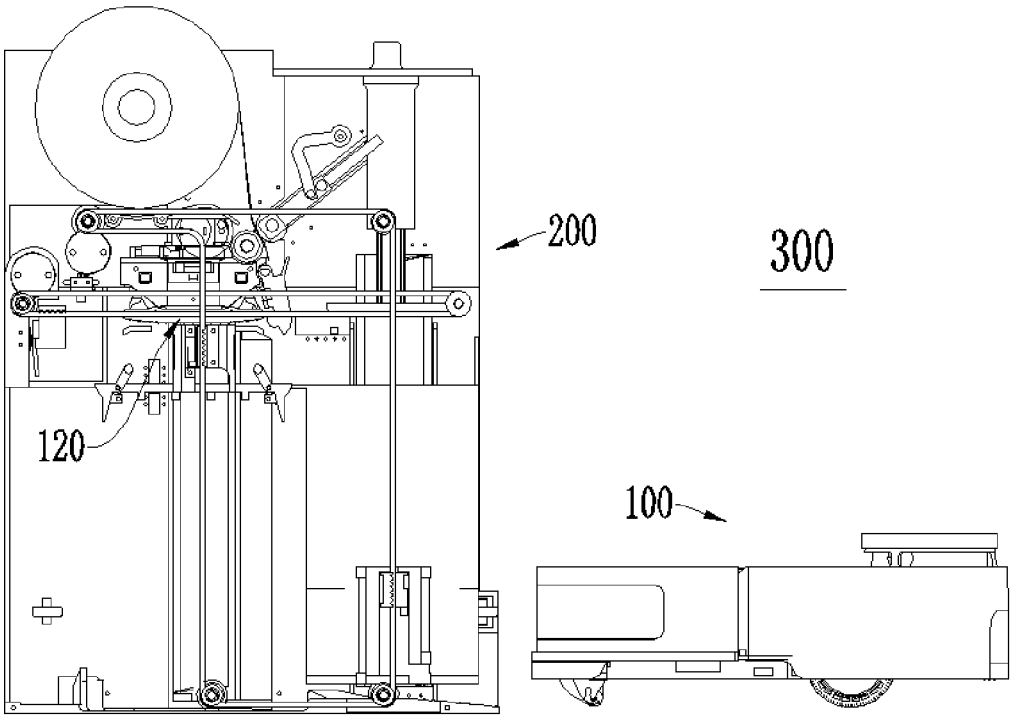
Figure 37F:
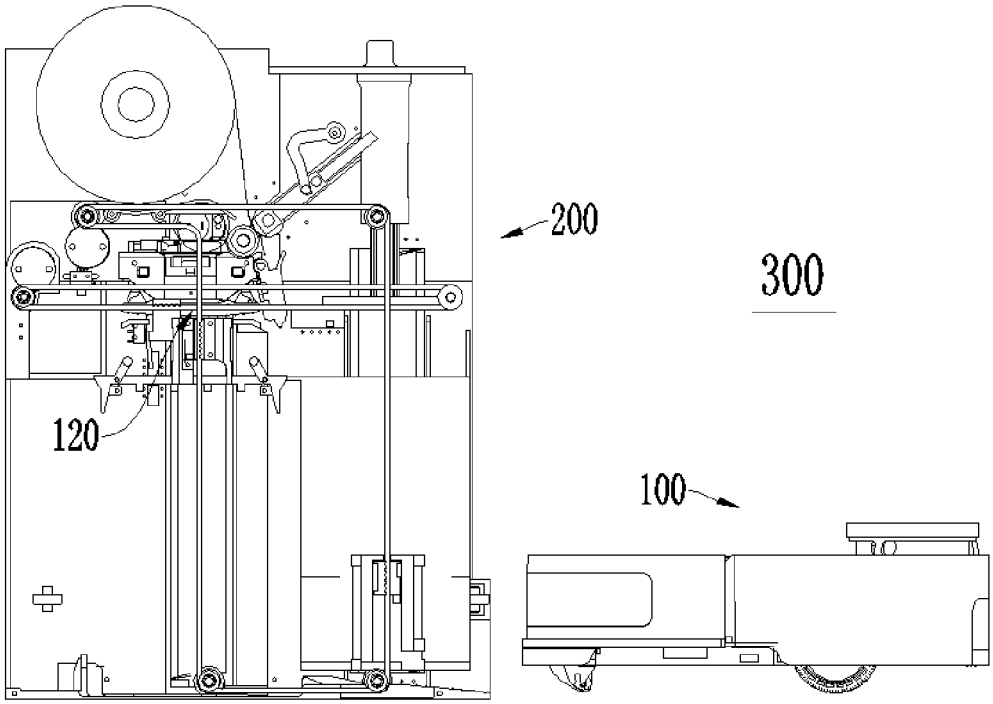
Figure 37G:
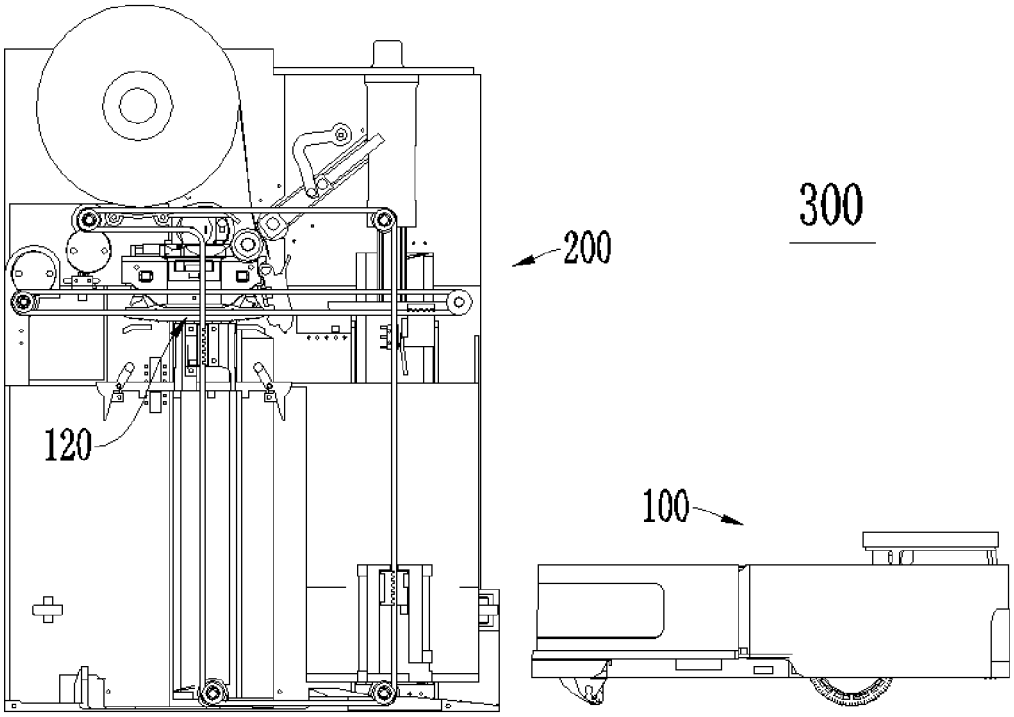
Figure 37H:
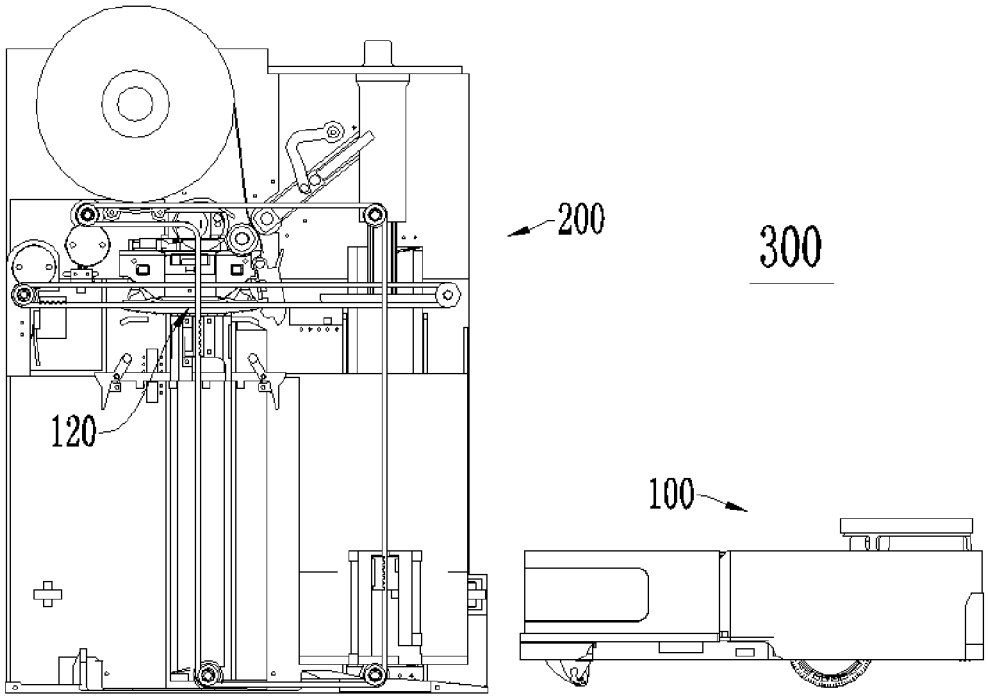

Correspondingly, when the delivery member 2051 drives the friction member 2052 to move from the second position to the first position, that is, move from right to left, as shown in FIG. 37A to FIG. 37L, the friction member 2052 may come into contact with the new or clean wiping member provided by the supply module 204, and pull the wiping member toward the first position. Referring to FIG. 37H, when the friction member 2052 moves toward the first position, the hairbrush on the upper surface of the friction member 2052 may come into contact with the wiping member provided by the supply module 204, thereby pulling the wiping member to move toward the first position.

Further, a recycling box 206 that may be configured to collect the dirty wiping member is disposed in the casing 202, and the recycling box 206 is located at the second position. Specifically, as shown in FIG. 37A to FIG. 37L, the recycling box 206 is substantially located in the casing 202 and corresponds to the right delivery wheel. The recycling box 206 is substantially in a housing shape whose upper end is an opening, and includes a box body 2061 and a support base 2062 disposed at the bottom of the box body 2061.

In a feasible embodiment, the recycling box 206 may be fixedly disposed in the casing 202 along the vertical direction, that is, a position of the recycling box 206 in the casing 202 at least along the vertical direction is fixed.

However, the casing 202 needs to be provided for the cleaning robot 100 to enter or leave. Therefore, to cause no obstruction or interference on the cleaning robot 100 in entering or leaving the casing 202, the height of the recycling box 206 fixedly disposed in the casing 202 along the vertical direction should be at least not less than the height of the cleaning robot 100. As a result, the height of the casing 202 is increased, and consequently the base station 200 is relatively large in volume and poor in portability.

In view of this, in another feasible embodiment, the recycling box 206 may be configured to vertically ascend or descend in the casing 202. When the cleaning robot 100 enters the casing 202, the position of the recycling box ascends, to avoid obstruction or interference on the cleaning robot 100; and when the cleaning robot 100 moves out from the casing 202, the position of the recycling box may descend. In this way, the height space of the casing 202 may be fully used. A specific implementation solution is introduced below in detail.

A lifting mechanism 207 may be disposed in the casing 202, and the lifting mechanism 207 is connected to the wiping board tray 203, and configured to drive the wiping board tray 203 to move toward or away from the operating module 400, that is, drive the wiping board tray 203 to move up and down. In a feasible embodiment, a specific structure of the lifting mechanism 207 may be similar to that of the pulling mechanism 205, and includes upper and lower delivery wheels and a synchronization belt winding around the two delivery wheels, and the wiping board tray 203 may be connected to the synchronization belt.

To cause the recycling box 206 to ascend or descend in the casing 202, the recycling box 206 may be driven by another lifting mechanism; and certainly, may be alternatively driven by the lifting mechanism 207. That is, one lifting mechanism 207 is used for implementing ascending or descending movement of the wiping board tray 203 and the recycling box 206. Specifically, the lifting mechanism 207 includes at least four delivery wheels, to define at least four angular points. Therefore, the lifting mechanism 207 includes at least a first lifting segment 2071 and a second lifting segment 2072, and the two lifting segments are respectively connected to two horizontal segments. The two lifting segments are disposed substantially in parallel, and therefore movements of the two lifting segments are exactly opposite when the synchronization belt rotates. The wiping board tray 203 and the recycling box 206 are respectively connected to the first lifting segment 2071 and the second lifting segment 2072, and therefore lifting situations of the wiping board tray 203 and the recycling box 206 are opposite when the lifting mechanism 207 runs. That is, when the first lifting segment 2071 moves upward, the second lifting segment 2072 moves downward, to respectively drive the wiping board tray 203 and the recycling box 206 to move upward and downward; and vice versa.

Referring to FIG. 37A to FIG. 37C, the wiping board tray 203 is initially located at the bottom of the casing 202. Correspondingly, in this case, the recycling box 206 is located at a highest point of the casing 202. In this way, the recycling box 206 does not block an access of the casing 202, and therefore the cleaning robot 100 may smoothly enter the casing 202, and reach the position of the wiping board tray 203. Subsequently, the cleaning robot 100 releases the cleaning module 120 onto the wiping board tray 203, and drives out of the casing 202. The lifting mechanism 207 runs, to cause the first lifting segment 2071 to move upward, and correspondingly, the second lifting segment 2072 moves downward. Therefore, the wiping board tray 203 is driven to bear the cleaning module 120 to move upward, until the cleaning module 120 and the operating module 400 are attached to perform a replacement operation of the wiping member; and the recycling box 206 moves downward, to collect the dirty wiping member. In this way, one lifting mechanism 207 may be used for implementing lifting of the wiping board tray 203 and the recycling box 206 simultaneously, so that the recycling box 206 is located at a relatively low position when the recycling box plays a role in collecting the dirty wiping member and located at a relatively high position when the cleaning robot 100 needs to enter or leave the casing 202, and consideration may be given to needs of assembly between the cleaning module 120 and each of the operating module 400 and the cleaning robot 100. Therefore, the base station 200 is relatively compact in structure, not excessively large in height, relatively small in volume, and relatively good in portability.

When the lifting mechanism 207 drives, through the wiping board tray 203, the cleaning module 120 to move upward until the wiping board 1201 of the cleaning module 120 attaches to the supporting framework 401 of the operating module 400, the top protrusion 404 at the bottom of the supporting framework 401 butts the upper surface of the triggering end 1214 of the pivoting part 1215, and therefore the pivoting part 1215 rotates, to cause the loading portion 1202 of the cleaning module 120 to switch from the clamped state to the opened state.

Figure 37L:
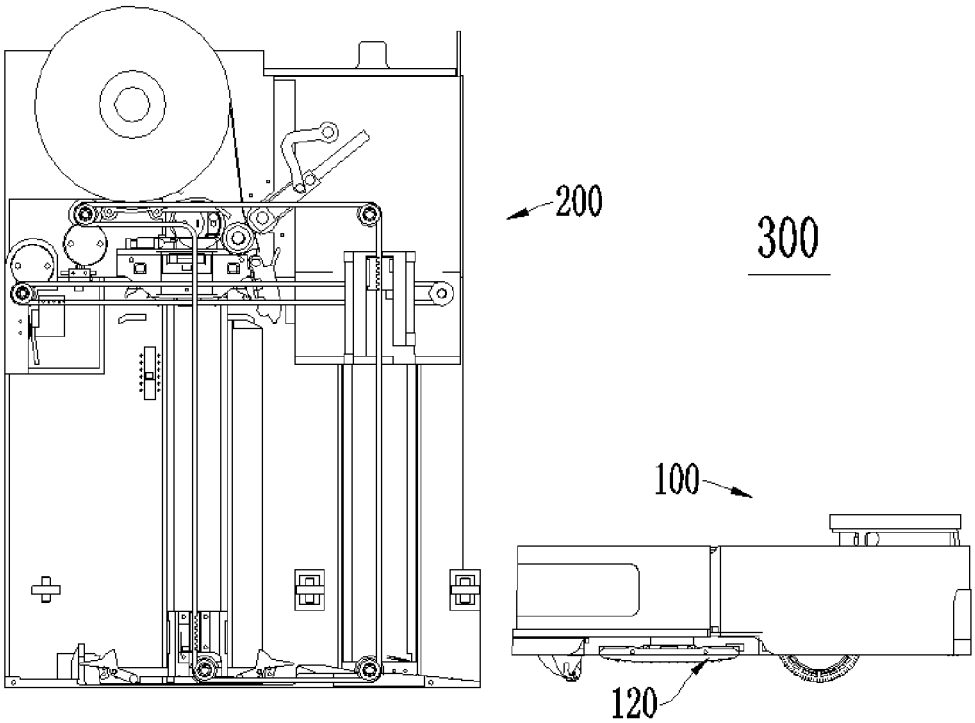
Figure 38A:
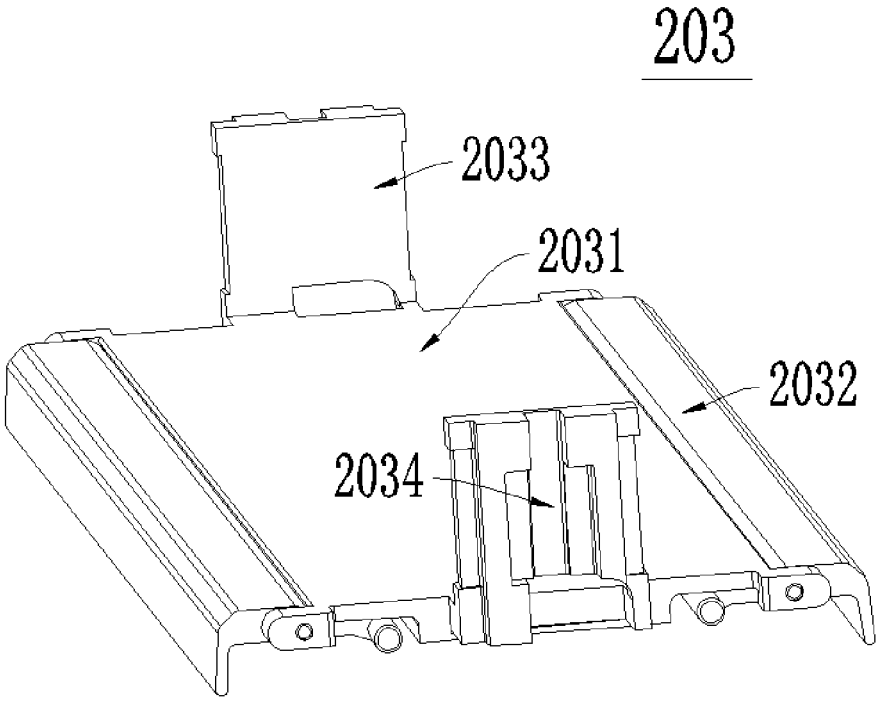
FIG. 38A and FIG. 38B are schematic structural diagrams of a wiping board tray in an unfolded state and a folded state respectively.
Figure 38B:
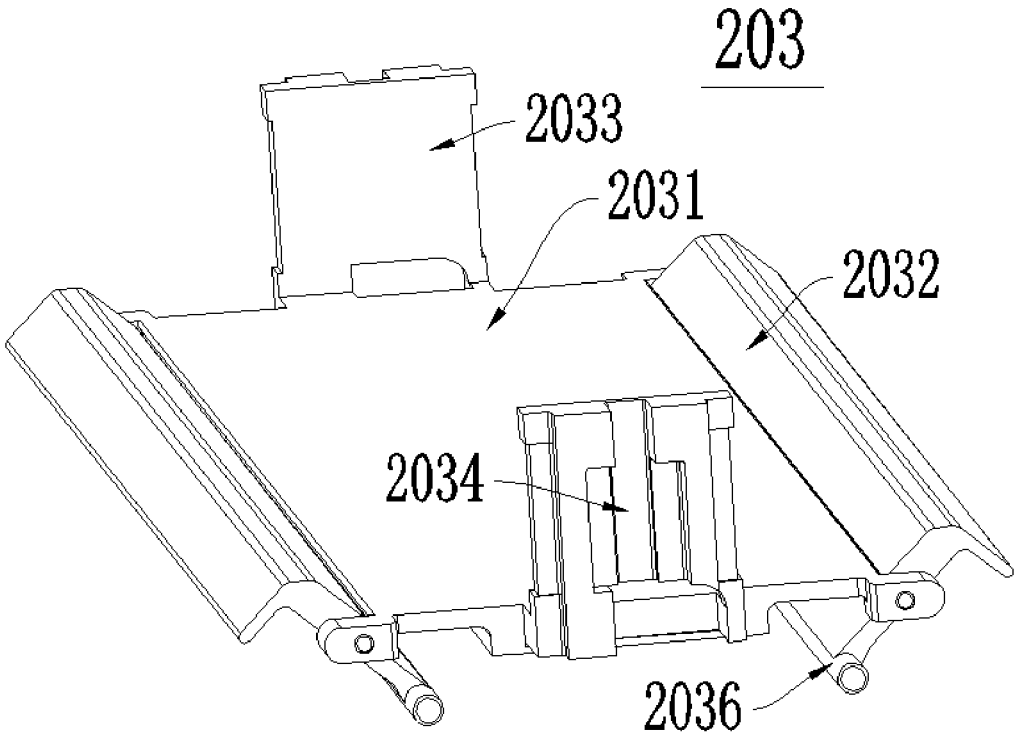

In this embodiment, the wiping board tray 203 is configured to bear the cleaning module 120, or provided for the wiping member to place. In a feasible embodiment, the wiping board tray 203 may be in a board-shaped structure as a whole, and is substantially horizontally disposed. As shown in FIG. 38A and FIG. 38B, in another feasible embodiment, the wiping board tray 203 is designed as a foldable structure, including a main board 2031 and positioning members 2032 rotatably disposed on two opposite sides of the main board 2031. The main body 101 is in a flat board-shaped structure, two ends of which are provided with convex lugs 2033 extending vertically upward, outer sides of the two convex lugs 2033 are depressed inward to form connection grooves 2034, a sliding block 2035 is disposed in the connection groove 2034, and the sliding block 2035 and the synchronization belt of the lifting mechanism 207 are connected, thereby connecting the lifting mechanism 207 and the wiping board tray 203. Referring to FIG. 37A and FIG. 37L, furthermore, a buffering member (for example, spring) is further disposed between the sliding block 2035 and the connection groove 2034, to buffer oscillation of the wiping board tray 203 in a lifting process.

Similarly, for a manner of connecting the recycling box 206 and the synchronization belt of the lifting mechanism 207, reference may be alternatively made to the foregoing structure design, that is, the box body 2061 and the synchronization belt are connected through another sliding block 2053, and details are not described herein.

The positioning member 2032 is substantially in a strip structure, whose cross section may be in such a bended shape as the shape of "7" and has an outer end located outside the main board 2031 and an inner end located under the main body 101, and a rotatable connection point between the positioning member 2032 and the main board 2031 is located between the inner end and the outer end. Similarly, the positioning member 2032 also forms a lever structure, and a supporting point of the lever structure is the rotatable connection point between the positioning member 2032 and the main board 2031.

The wiping board tray 203 has a flattened state and a folded state. When the wiping board tray is in the flattened state, upper surfaces of the two positioning members 2032 and an upper surface of the main board 2031 are substantially flush. In this case, the inner end of the positioning member 2032 butts the lower surface of the main board 2031, and the wiping board tray 203 as a whole presents a plane state in which the upper surface is flat (as shown in FIG. 38A). When the wiping board tray is in the folded state, the outer ends of the two positioning members 2032 are folded upward, and the cleaning module 120 as a whole presents a state in which the upper surface is depressed inward (as shown in FIG. 39B). In this case, the inner end of the positioning member 2032 is detached from the lower surface of the main board 2031, and the wiping board tray 203 as a whole presents a state in which the upper surface is depressed inward (as shown in FIG. 38B).

Further, when the cleaning module 120 and the operating module 400 are not in contact, the wiping board tray 203 is in the flattened state. However, when the cleaning module 120 and the operating module 400 come into contact, the wiping board tray 203 switches to the folded state, the two positioning members 2032 butt two opposite sides of the cleaning module 120, thereby clamping the cleaning module 120 between the two positioning members and correcting the position of the cleaning module 120, to cause the cleaning module and the supporting framework 401 to be connected in the best morphology.

As shown in FIG. 37E, after the loading portion 1202 of the cleaning module 120 switches to the opened state, the lifting mechanism 207 subsequently drives the wiping board tray 203 to move downward by a distance, and the released dirty wiping member falls onto the wiping board tray 203. Subsequently, after the pulling mechanism 205 pulls the wiping member to a target position, the lifting mechanism 207 then drives the wiping board tray 203 to move upward, to cause the wiping board tray 203 and the cleaning module 120 to come into contact. In this case, the wiping board tray 203 switches from the unfolded state to the folded state. Therefore, the positioning member 2032 of the wiping board tray 203 folds the wiping member upward, thereby helping the first movable mechanism 402 of the operating module 400 push the wiping member to the first clamping surface 1211 of the wiping board 1201.

If no external force acts on the positioning member 2032, the wiping board tray 203 is in the flattened state, a specific implementation is the same as the foregoing description, and a reset member may be disposed between the positioning member 2032 and the main board 2031. Alternatively, the outer end of the positioning member 2032 is set relatively large in mass or relatively large in length. Therefore, under the action of the lever principle, the inner end of the positioning member 2032 naturally butts the lower surface of the main board 2031, and the wiping board tray 203 is in the flattened state.

To cause the wiping board tray 203 to switch from the flattened state to the folded state, as shown in FIG. 38A and FIG. 38B, the inner end of the positioning member 2032 is provided with a stop member 2036, whose outer end extends out of the main board 2031. Stop strips 208 cooperating with the stop members 2036 are disposed in the casing 202, and there are two stop strips 208, located at two sides of the first lifting segment 2071. As shown in FIG. 37D, in the process in which the lifting mechanism 207 bears, through the wiping board tray 203, the cleaning module 120 to move upward, when the cleaning module 120 and the operating module 400 come into contact, the stop strip 208 also just butts the outer end of the stop member 2036, thereby causing the wiping board tray 203 to switch from the flattened state to the folded state.

A complete process in which the base station 200 of this embodiment of the present invention replaces the wiping member for the cleaning robot 100 is described below with reference to FIG. 37A to FIG. 37L.

As shown in FIG. 37A, the cleaning robot 100 carrying the cleaning module 120 prepares to drive into the base station 200. In this case, the wiping board tray 203 is located at the bottom of the base station 200, and the recycling box 206 is suspended by the synchronization belt at a high place, thereby opening the access on the casing 202, so as to make it convenient for the cleaning robot 100 to smoothly enter the base station 200.

As shown in FIG. 37B, the cleaning robot 100 drives into the base station 200, to unload the cleaning module 120 onto the wiping board tray 203. In this case, the wiping board tray 203 is in the flattened state.

As shown in FIG. 37C, the cleaning robot 100 drives out of the base station 200.

As shown in FIG. 37D, the lifting mechanism 207 runs. Specifically, the synchronization belt of the lifting mechanism 207 clockwise rotates, to drive the wiping board tray 203 to move upward, and meanwhile, the recycling box 206 moves downward. The wiping board tray 203 bears the cleaning module 120 placed on the wiping board tray to move upward together, until the cleaning module 120 and the supporting framework 401 come into contact. The top protrusion 404 at the bottom of the supporting framework 401 butts the upper surface of the triggering end 1214, to open the wiping board 1201, and the dirty wiping member is released. Meanwhile, the stop strip 208 butts the outer end of the stop member 2036, the positioning member 2032 rotates, the wiping board tray 203 switches to the folded state, and the positioning member 2032 butts two sides of the wiping board 1201 of the cleaning module 120, to correct the position of the wiping board 1201 and clamp the wiping board 1201.

As shown in FIG. 37E, the lifting mechanism 207 inversely runs. Specifically, the synchronization belt of the lifting mechanism 207 counterclockwise rotates, the wiping board tray 203 moves downward by a distance, and the released dirty wiping member falls onto the wiping board tray 203. Under the action of the first attaching element and the second attaching element, the cleaning module 120 is adsorbed under the supporting framework 401, to cause the cleaning module 120 to continue to keep a state of attaching to the supporting framework 401.

As shown in FIG. 37F, the pulling mechanism 205 runs. Specifically, the synchronization belt of the pulling mechanism 205 counterclockwise rotates, to drive the friction member 2052 to move rightward (the second position direction), the lower surface of the friction member 2052 and the dirty wiping member falling onto the wiping board tray 203 come into contact, and the dirty wiping member is pushed rightward.

As shown in FIG. 37G, the synchronization belt of the pulling mechanism 205 continues to counterclockwise rotate, the friction member 2052 continues to drive the dirty wiping member to move rightward, and finally the dirty wiping member is moved out of the wiping board tray 203 and drops into the recycling box 206.

As shown in FIG. 37H, the pushing rolling wheel 2041 of the supply module 204 is driven by the motor to work, to push the new or clean wiping member wound around the winding shaft forward by a distance. Subsequently, the synchronization belt of the pulling mechanism 205 clockwise rotates, the friction member 2052 is driven to move leftward (the first position direction), and the upper surface of the friction member 2052 and the new or clean wiping member come into contact, thereby scratching and pulling the wiping member leftward. Meanwhile, the pushing rolling wheel 2041 also synchronously works, to continuously push the wiping member forward. When the friction member 2052 reaches the first position, the pushing rolling wheel 2041 stops rotating.

Figure 37I:
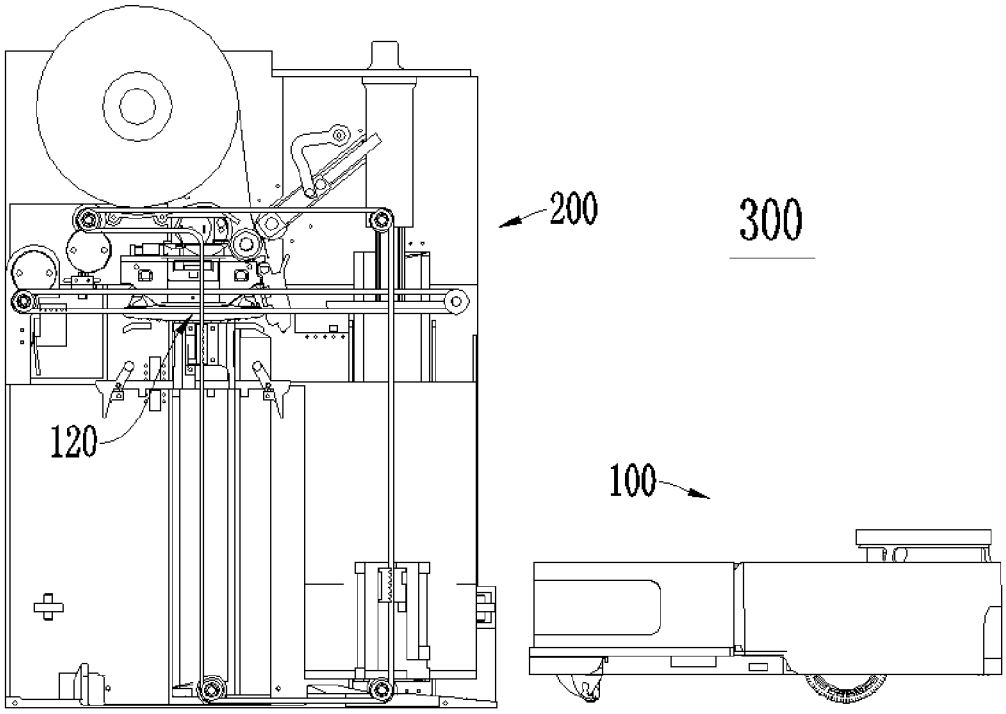

As shown in FIG. 37I, the pushing rolling wheel 2041 rotates reversely, to drag the wiping member backward by a distance. After a detecting element 209 (for example, may be a photoelectric sensor) disposed above the pulling mechanism 205 detects that the wiping member moves backward by a predetermined distance, the pushing rolling wheel stops.

Figure 37J:
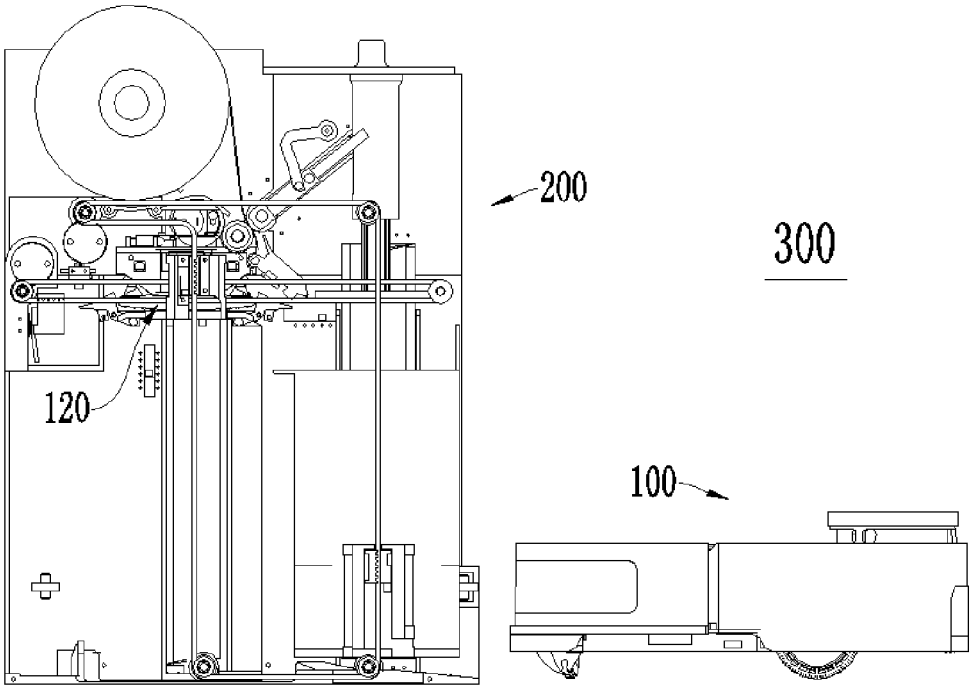

As shown in FIG. 37J, the synchronization belt of the lifting mechanism 207 clockwise rotates, and the wiping board tray 203 moves upward, until the cleaning module 120 and the supporting framework 401 are attached. Meanwhile, the stop strip 208 butts the outer end of the stop member 2036, to cause the wiping board tray 203 to again switch to the folded state, and the outer end of the positioning member 2032 is folded upward, to fold the wiping member upward. Subsequently, the pushing rolling wheel 2041 continues to rotate reversely, to snap the wiping member at a breakpoint.

Figure 37K:
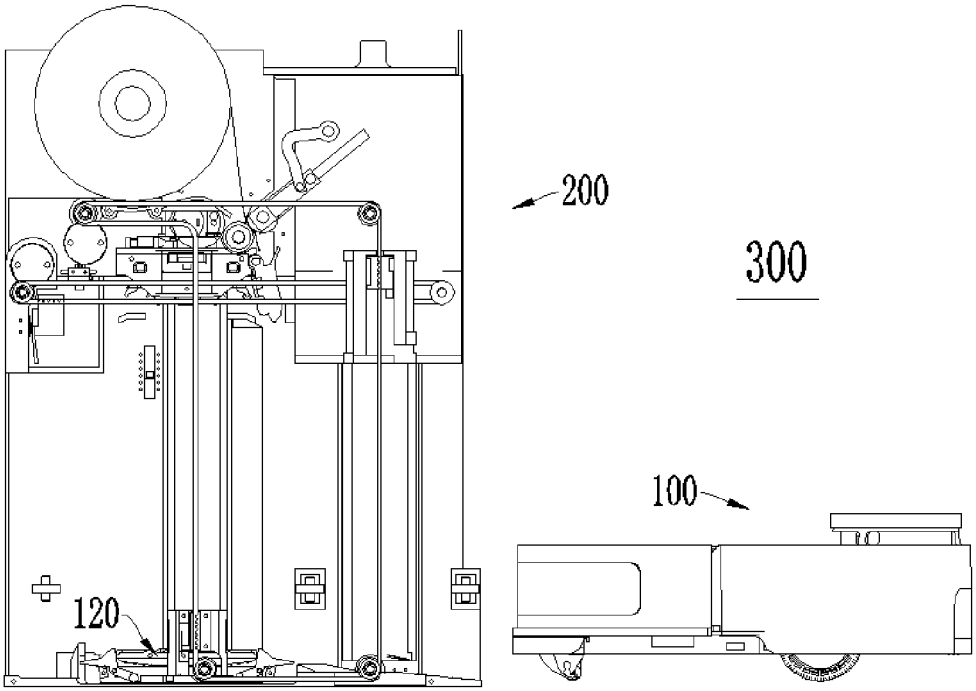

As shown in FIG. 37K, the power mechanism 410 of the operating module 400 works, to drive the first movable mechanism 402 to push the wiping member toward the first clamping surface 1211 of the wiping board 1201. Meanwhile, the second movable mechanism 403 pushes the separating member 405 to stretch out, to push the wiping board 1201 away, the loading portion 1202 switches to the clamped state, and the wiping member is clamped on the cleaning module 120. Then, the synchronization belt of the lifting mechanism 207 counterclockwise rotates, and the wiping board tray 203 moves downward. Meanwhile, the recycling box 206 ascends, until the wiping board tray 203 reaches the bottom of the casing 202, in this case, the recycling box 206 ascends to a highest place and stops.

As shown in FIG. 37L, the cleaning robot 100 again drives into the base station 200, and drives, after mounting the cleaning module 120 on which the wiping member is replaced on the bottom of the base station again, out of the base station 200. Subsequently, cleaning work may be performed.

It may be seen from the foregoing replacement process that, in the foregoing embodiment, to avoid the interference formed on the wiping board tray 203, when replacing the wiping member, the cleaning robot 100 needs to enter and leave the base station 200 twice, and therefore the wiping member replacement efficiency needs to be improved. In view of this, the second embodiment of the present invention provides the following further improved solution.

As shown in FIG. 44A to FIG. 44I, a wiping board operating position is disposed in the casing 202 of the base station 200, the wiping board operating position includes a wiping board separating position 2021 and a wiping board mounting position 2022, the wiping board separating position 2021 is used for the wiping board tray 203 to place, and the wiping board mounting position 2022 is located between an access of the casing 202 and the wiping board separating position 2021, and used for the cleaning module 120 performing replacement with a new wiping member to place.

Figure 45:
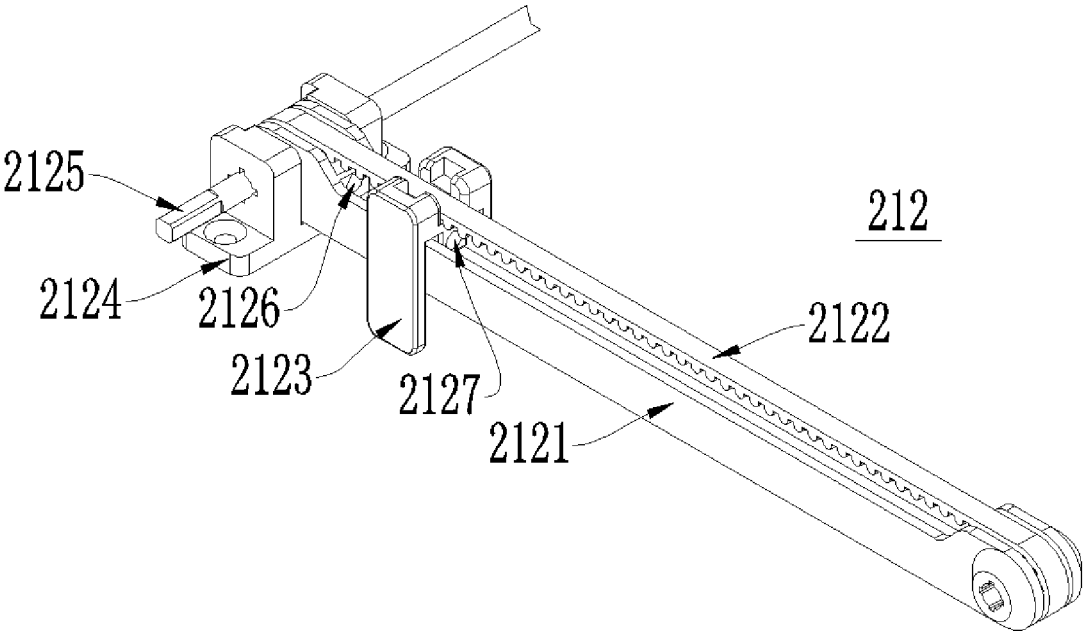
FIG. 45 is a schematic structural diagram of a translation and transposition mechanism in FIG. 44A to FIG. 44I.

The base station 200 further includes a translation and transposition mechanism 212 disposed in the casing 202. As shown in FIG. 45, the translation and transposition mechanism 212 includes: a rotatable arm 2121, rotatably disposed on an inner wall of the casing 202 facing the access. The rotatable arm 2121 is substantially in a rod shape, and has a connection end (a left end shown in FIG. 45) rotatably connected to the inner wall of the casing 202 and a free end (a right end shown in FIG. 45) with the back facing the connection end. The connection end and the free end are respectively rotatably provided with a first synchronization wheel and a second synchronization wheel (not shown), the synchronization belt 2122 winds around the first synchronization wheel and the second synchronization wheel, and the synchronization belt 2122 is connected to a pushing block 2123. The first synchronization wheel and a motor are connected, and the motor drives the first synchronization wheel to rotate, to drive the synchronization belt 2122 and the pushing block 2123 of the synchronization belt to move. Specifically, the rotatable arm 2121 is rotatably disposed on the inner wall of the casing 202 through a supporting seat 2124, and a transmission shaft 2125 disposed on the connection end passes through connection ears of the supporting seat 2124 and is connected to an output shaft of the motor.

The pushing block 2123 is made of a magnetizable material such as iron, cobalt, or nickel, and can be attracted by a magnetic force, or a magnetic element 2127 such as a magnet is disposed on the pushing block 2123. The rotatable arm 2121 is respectively provided with a first magnet 2126 and a second magnet (not shown) close to the connection end and the free end. When the pushing block 2123 is driven by the synchronization belt 2122 to move to be close to the connection end or the free end, the first magnet 2126 or the second magnet may generate a magnetic attraction force on the pushing block 2123, to cause the pushing block 2123 to have a stable trend of being located at the connection end or the free end.

The working principle of this embodiment is: the rotatable arm 2121 is initially in a vertical state, the pushing block 2123 approaches the connection end and is magnetically attracted by the first magnet 2126, and the synchronization belt 2122 is in a locked state. Rotation of the rotatable arm 2121 in a direction back to the wiping board separating position 2021 and the wiping board mounting position 2022 is limited by the inner wall of the casing 202. Therefore, when the motor drives the transmission shaft 2125 to rotate, the rotatable arm 2121 can rotate only in a direction toward the wiping board separating position 2021 and the wiping board mounting position 2022, and finally the rotatable arm 2121 is caused to switch from the vertical state to a horizontal state. Subsequently, an output twisting force of the motor is increased, and when an action force applied by the motor to the first synchronization wheel overcomes a magnetic attraction force of the first magnet 2126 on the pushing block 2123, the first synchronization wheel is driven to start rotating, and the synchronization belt 2122 rotates accordingly, to drive the pushing block 2123 to move. The moving direction of the pushing block 2123 is pointing from the wiping board separating position 2021 to the wiping board mounting position 2022, thereby pushing the wiping board that is borne by the wiping board tray 203 located on the wiping board separating position 2021 and on which replacement of the wiping member is just completed to the wiping board mounting position 2022. In this case, the pushing block 2123 is magnetically attracted by the second magnet. Then, the motor rotates inversely, and the rotatable arm 2121 rotates to a vertical position.

A complete process in which the base station 200 of this embodiment of the present invention replaces the wiping member for the cleaning robot 100 is described below with reference to FIG. 44A to FIG. 44I.

As shown in FIG. 44A, the cleaning robot 100 prepares to enter the base station 200 to replace the wiping member. In this case, the rotatable arm 2121 is in a vertical state, the pushing block 2123 is magnetically attracted by the first magnet 2126, and the synchronization belt 2122 is in a locked state.

Figure 44B:
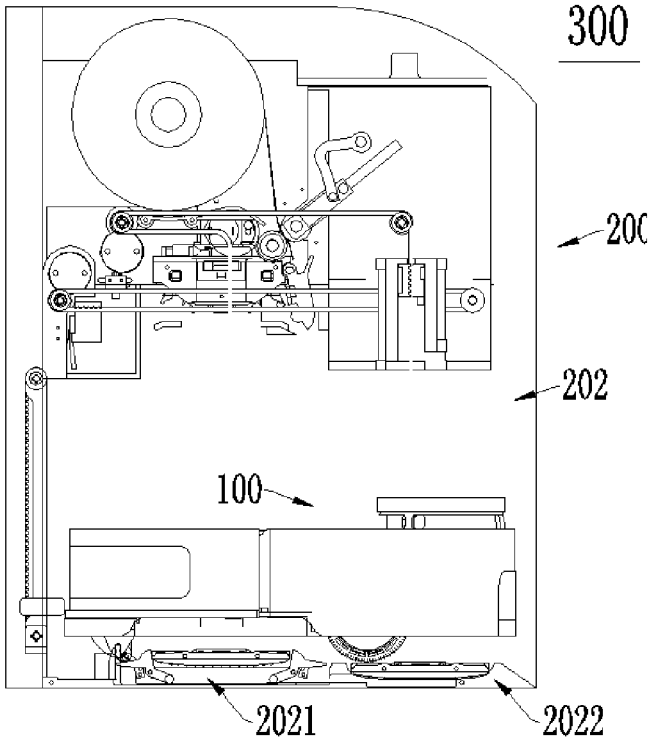

As shown in FIG. 44B, the cleaning robot 100 enters the base station 200 through the access, and unloads the cleaning module 120 onto the wiping board tray 203 located on the wiping board separating position 2021.

Figure 44C:
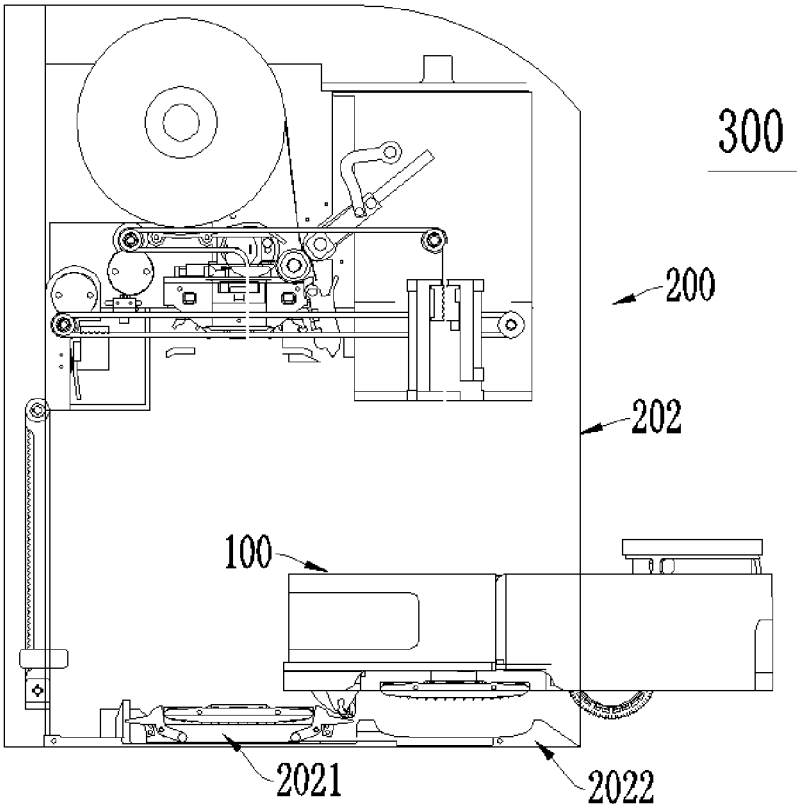

As shown in FIG. 44C, the cleaning robot 100 retreats to the wiping board mounting position 2022, and mounts the cleaning module 120 that is provided in a previous operation round and on which replacement with the new wiping member is performed.

Figure 44D:
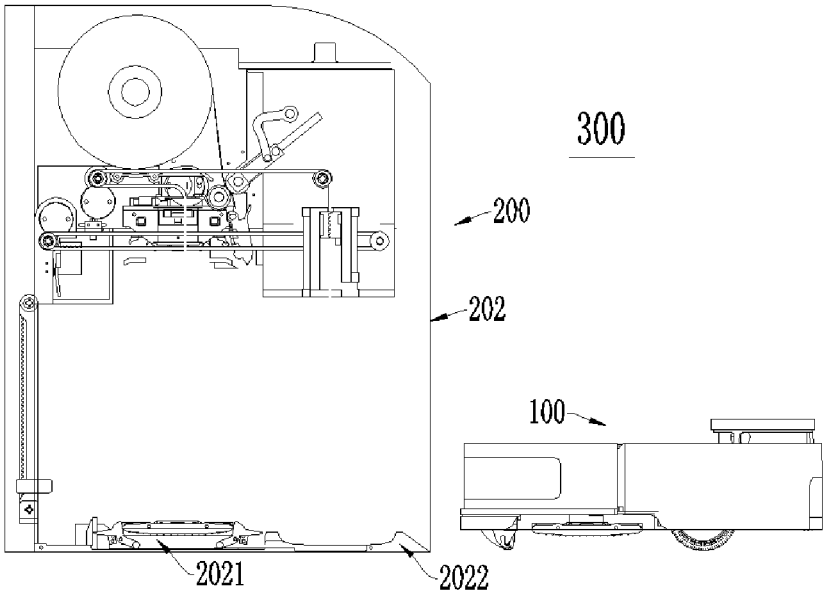

As shown in FIG. 44D, the cleaning robot 100 retreats from the base station 200.

Figure 44E:
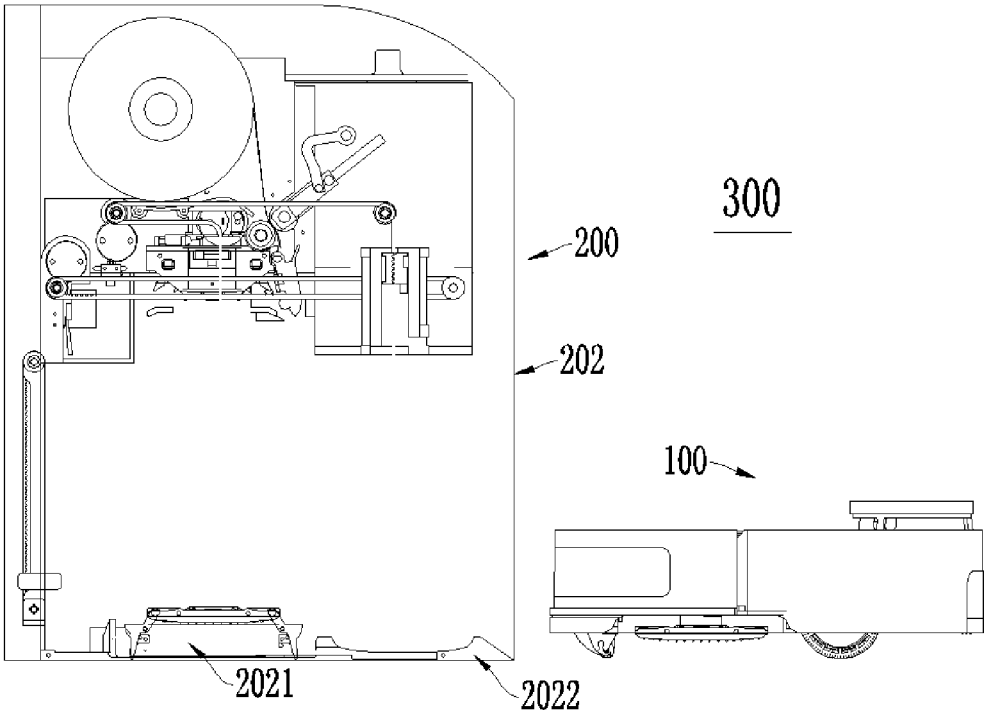

As shown in FIG. 44E, according to the process shown in FIG. 37A to FIG. 37L, a replacement operation of the wiping member is performed on the cleaning module 120 detached from the cleaning robot 100 in this round in the base station 200, and subsequently the wiping board tray 203 lowers the cleaning module 120 on which replacement with the clean wiping member is performed to the wiping board separating position 2021.

Figure 44F:
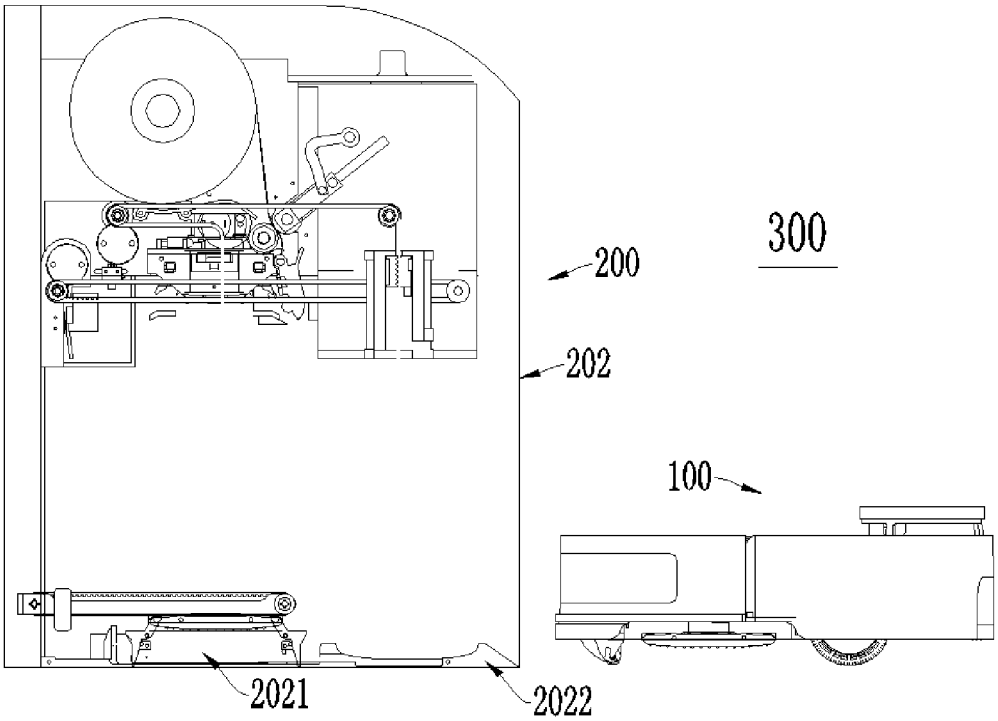

As shown in FIG. 44F, the motor drives the translation and transposition mechanism 212 to operate, to cause the rotatable arm 2121 to rotate from the original vertical position to a horizontal position.

Figure 44G:
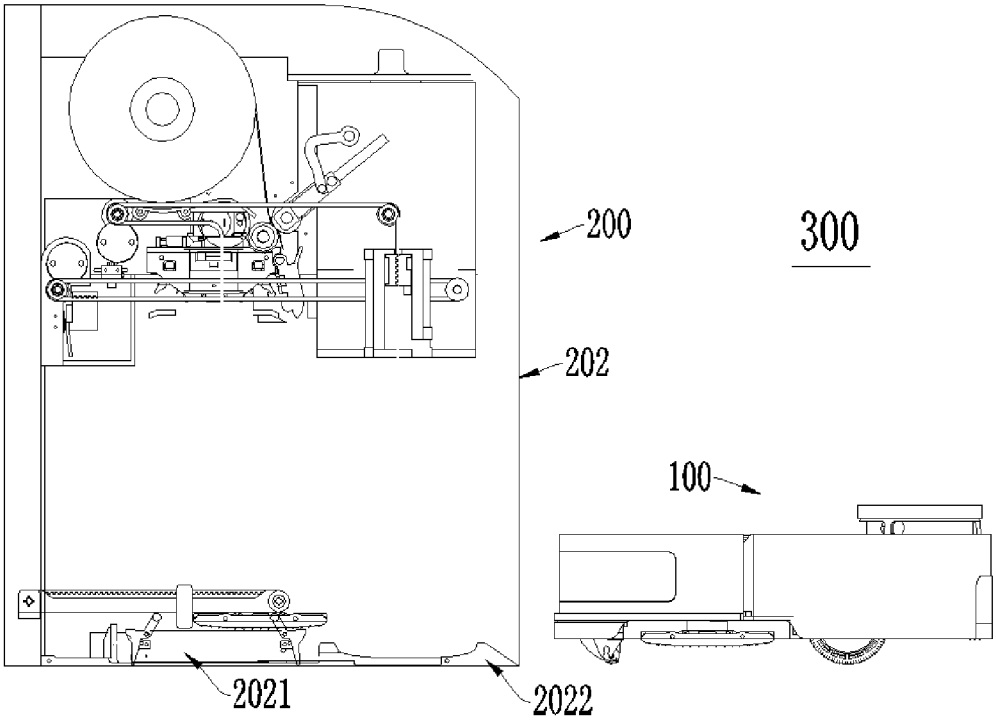
Figure 44H:
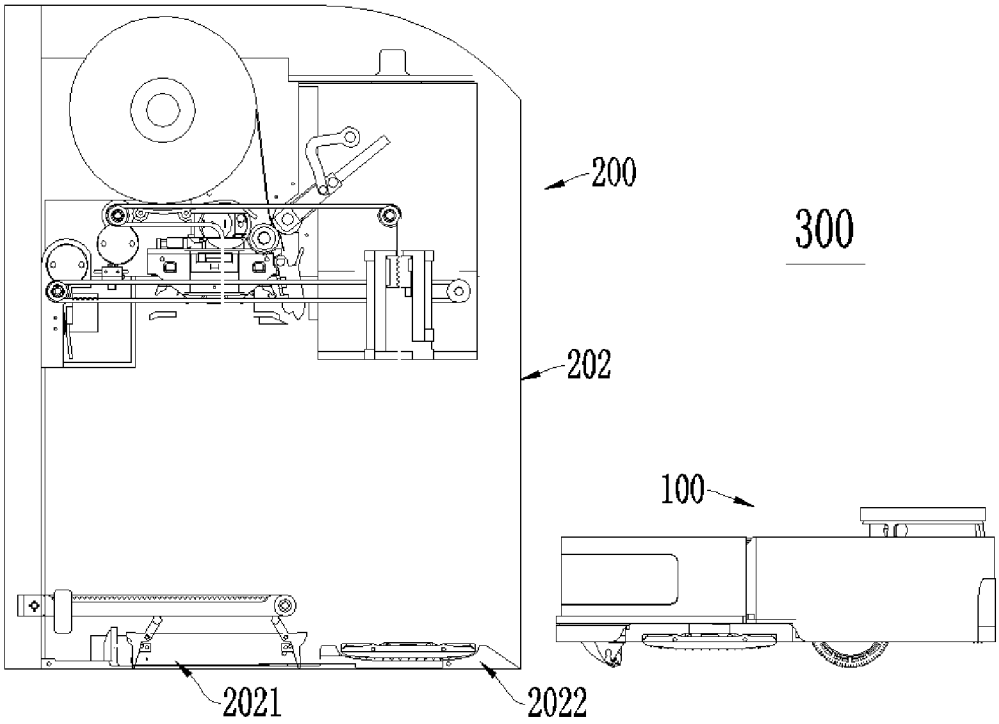

As shown in FIG. 44G and FIG. 44H, the motor drives the first synchronization wheel to overcome the magnetic attraction force of the first magnet 2126 on the pushing block 2123, to drive the pushing block 2123 to move rightward, and then the cleaning module 120 that is placed on the wiping board tray 203 and on which replacement with the clean wiping member is performed is pushed to the wiping board mounting position 2022.

Figure 44I:
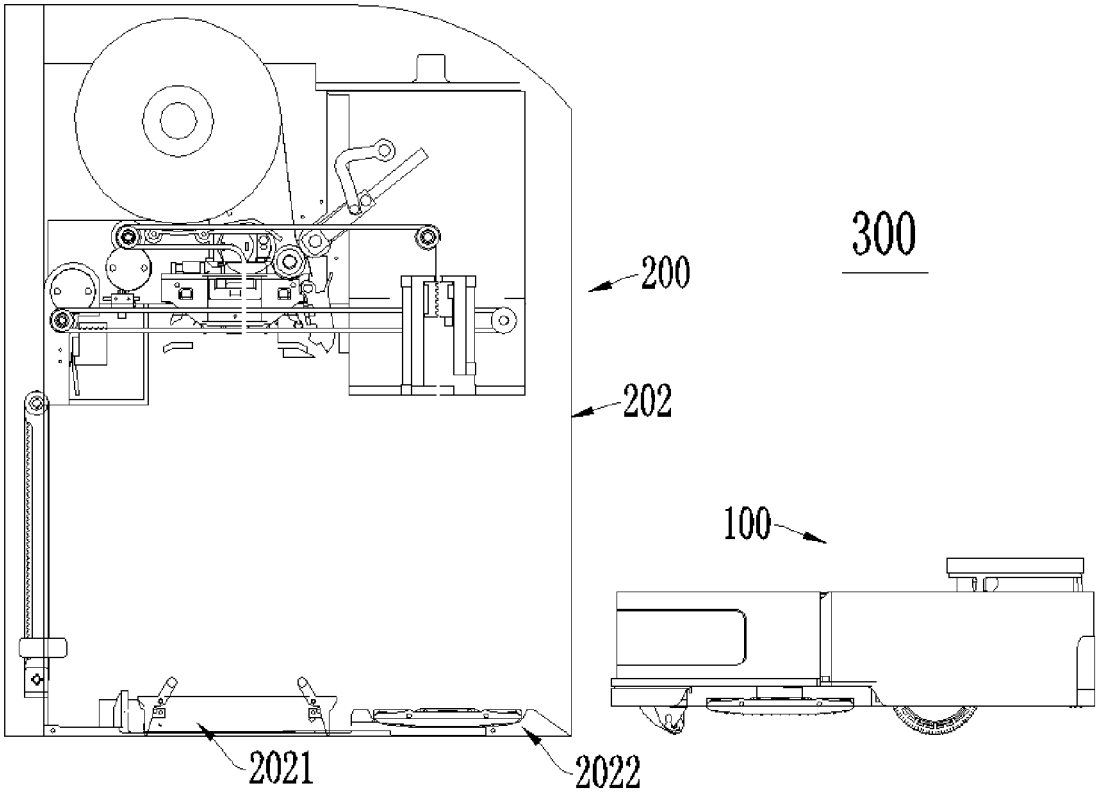

As shown in FIG. 44I, subsequently, the motor rotates inversely, and the rotatable arm 2121 rotates to a vertical position.

Therefore, it can be seen that, with the aid of the technical solution of the foregoing improved embodiment, by adding, to the base station 200, the translation and transposition mechanism 212 and the wiping board mounting position 2022 configured to temporarily store the cleaning module 120 on which replacement with the new wiping member is performed, the translation and transposition mechanism 212 may push the cleaning module 120 on which the operating module 400 completes replacement of the wiping member from the wiping board tray 203 to the wiping board mounting position 2022. In this way, when replacing the cleaning module 120, the cleaning robot 100 unloads a dirty cleaning module 120 onto the wiping board tray 203, and subsequently mounts a new cleaning module 120 from the wiping board mounting position 2022. Therefore, the cleaning robot only needs to enter and leave the base station 200 once, to complete replacement of the cleaning module 120, and therefore replacement efficiency is greatly improved.

It should be noted that, a difference between the base station 200 in the second solution and the base station 200 in the first solution shown in FIG. 37A to FIG. 37L only lies in that the translation and transposition mechanism 212 and the wiping board mounting position 2022 (substantially, the base station 200 in the first solution includes the wiping board separating position 2021) are added, and other structures are substantially the same. Reference may be made to the foregoing description, and details are not described herein.

FIG. 46A to FIG. 46L are diagrams of a process in which the base station 200 of the third feasible solution replaces a wiping member for a cleaning robot 100 according to the second embodiment of the present invention. The base station 200 in the solution is slightly different from the base station 200 in the first solution shown in FIG. 37A to FIG. 37L and the second solution shown in FIG. 44A to FIG. 44I. The difference lies in that, the device 400 configured to replace a wiping member for the cleaning module 120 and the recycling box 206 in the base station 200 in this solution are different from the operating module 400 in the foregoing two solutions. For other similarities, reference may be made to the foregoing description, and details are not described herein.

Moreover, the wiping board tray 203 in this solution may be the same as or different from that in the foregoing solution. When the wiping board tray 203 is in a structure the same as that in the foregoing solution, the stop strips 208 may be correspondingly disposed in the casing 202. However, when the wiping board tray 203 is in a structure different from that in the foregoing solution, the wiping board tray 203 may include only one bearing board, which is similar to the main board 2031 in the foregoing solution, but does not include the positioning member 2032. In this case, the wiping board tray 203 includes only the unfolded state, but does not include the folded state.

The wiping board tray 203 is disposed on the lifting mechanism 207, and is driven by the lifting mechanism 207 to move up and down. In this solution, likewise, the lifting mechanism 207 may be the same as that in the foregoing first and second solutions, or may use another replacement manner. For example, in this embodiment, the lifting mechanism 207 may be a belt-shaped structure including a synchronization belt, a transmission belt, and the like that are vertically disposed in the casing 202, a synchronization wheel is disposed in each of positions in the casing 202 close to the upper end and the bottom, the synchronization belt and the transmission belt are wound around the two synchronization wheels, and the wiping board tray 203 is fixed on a vertical segment on any side of the synchronization belt and the transmission belt.

As shown in FIG. 46A, in this solution, the operating module 400 may include only an adsorbing board 411 and a magnetic element (not shown) disposed on the bottom of the adsorbing board 411, and the adsorbing board 411 is similar to the supporting framework 401 in the foregoing solution. The position in the casing 202 close to the upper end is provided with a movable mechanism 412, the movable mechanism 412 may also be a belt-shaped structure including a synchronization belt, a transmission belt, and the like, is wound around in a plurality of belt pulleys, and forms at least a horizontal pulling segment 4121.

Figure 46E:
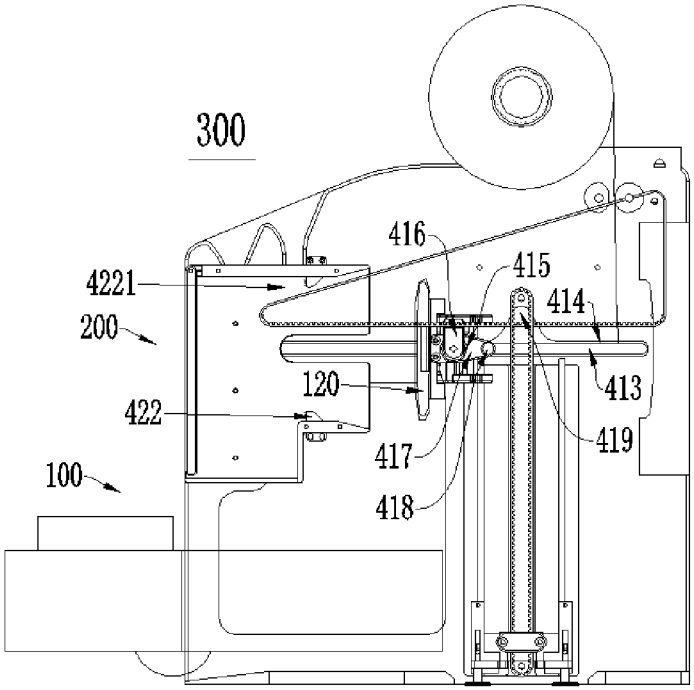

With reference to FIG. 46E, the adsorbing board 411 and a horizontal pulling segment 4121 of the movable mechanism 412 are fixedly connected through a connection assembly, and the adsorbing board 411 and the connection assembly are rotatably connected. Specifically, the inner wall of the casing 202 of the base station 200 close to the upper end is provided with a first sliding groove 413 and a second sliding groove 414 that are horizontal. The size of the first sliding groove 413 is less than the size of the second sliding groove 414, and the two sliding grooves are disposed on a same horizontal position. The inner wall of the casing 202 is further provided with a third sliding groove 419, and the third sliding groove 419 is in a mountain peak shape, and is in smooth transition with and in communication with the second sliding groove 414. Moreover, the third sliding groove 419 corresponds to the position of the lifting mechanism 207.

The connection assembly includes a first rolling wheel 415 disposed in the first sliding groove 413 and movable along the horizontal direction in the first sliding groove 413, and a first connection member 416 and a second connection member 417 that are rotatably connected to the first rolling wheel 415. The first connection member 416 and the horizontal pulling segment 4121 of the movable mechanism 412 are fixedly connected, the second connection member 417 has one end connected to the adsorbing board 411 and another end rotatably provided with a second rolling wheel 418, and the second rolling wheel 418 may slide in the second sliding groove 414 and the third sliding groove 419. A manner in which the first connection member 416 and the second connection member 417 are rotatably connected to the first rolling wheel 415 may be that, the second connection member 417 is in a sheet shape or board shape, a side of which facing the first sliding groove 413 is provided with a shaft, and the first rolling wheel 415 is rotatably disposed on the shaft. The end portion of the shaft may extend to a side of the first rolling wheel 415 back to the first sliding groove 413. The first connection member 416 is also in a sheet shape or board shape, and is fixedly connected to the end portion of the shaft.

Alternatively, the second connection member 417 is provided with a round hole matching the first rolling wheel 415 in shape and size, the first rolling wheel 415 has one part inserted into the round hole and capable of rotating in the round hole and the other part located outside the round hole, and the part exposed outside the round hole is then inserted into the first sliding groove 413. The position of the circle center of the first rolling wheel 415 may be provided with a shaft, which extends in a direction away from the first sliding groove 413, the first connection member 416 may be provided with a shaft hole, and the shaft is threaded in the shaft hole.

The adsorbing board 411 has a horizontal position and a vertical position. Specifically, when the lifting mechanism 207 conveys the cleaning module 120 upward to a position near the adsorbing board 411, the cleaning module 120 is adsorbed at the lower end of the adsorbing board 411 under the action of a magnetic force. In this case, the second rolling wheel 418 is located in the third sliding groove 419, and the adsorbing board 411 as a whole is in a horizontal position state. When the movable mechanism 412 moves, the adsorbing board 411 connected to the horizontal pulling segment 4121 of the movable mechanism 412 through the connection assembly is overturned.

Specifically, when the horizontal pulling segment 4121 moves leftward, the second rolling wheel 418 originally in the vertical state in the third sliding groove 419 enters a left half segment of the horizontal second sliding groove 414. Therefore, under the action of limit of the second rolling wheel 418 and the second sliding groove 414, the adsorbing board 411 clockwise rotates upward, which is a process shown in FIG. 46D to FIG. 46E.

Correspondingly, when the horizontal pulling segment 4121 moves leftward, the second rolling wheel 418 originally in the vertical state in the third sliding groove 419 enters a right half segment of the horizontal second sliding groove 414. The adsorbing board 411 counterclockwise rotates upward, which is a process shown in FIG. 46G to FIG. 46H.

In this solution, the recycling box 206 is located at one end of the horizontal pulling segment 4121 (a left side shown in FIG. 46A to FIG. 46L), and an outer side at the other end of the horizontal pulling segment 4121 may be provided with a wiping member mounting position 420. The recycling box 206 has an opening facing the horizontal pulling segment 4121, upper and lower ends at the opening of the recycling box are provided with separating modules 422, and the separating module 422 is in a barb-shaped structure, configured to hook the wiping member and take down the wiping member from the wiping board 1201 of the cleaning module 120. Therefore, the position in which the separating module 422 is disposed corresponds to the wiping member separating position 4221. The wiping member mounting position 420 is substantially in a shape of a slot opened inward, and the shape of the slot body and the shape of the bottom of the wiping board 1201 of the cleaning module 120 match. The end portion of the wiping member provided by the supply module 204 may droop to the wiping member mounting position 420. A feeding module 421 is further disposed between the supply module 204 and the wiping member mounting position 420, and includes at least two delivery wheels, and the two delivery wheels are intermittently close and far away to clamp the wiping member. As shown in FIG. 46A, one delivery wheel is a round rolling wheel, and the other delivery wheel is a cam. A complete process in which the base station 200 of this embodiment of the present invention replaces the wiping member for the cleaning robot 100 is described below with reference to FIG. 46A to FIG. 46L.

As shown in FIG. 46A, the cleaning robot 100 prepares to enter the base station 200 to replace the wiping member. In this case, the wiping board tray 203 is located at the bottom of the casing 202, the second rolling wheel 418 is located in the third sliding groove 419, and the adsorbing board 411 is in a horizontal position state.

As shown in FIG. 46B, the cleaning robot 100 enters the base station 200 through the access, unloads the cleaning module 120 onto the wiping board tray 203, and retreats by a distance.

As shown in FIG. 46C, the lifting mechanism 207 drives the wiping board tray 203 to move upward, to convey the cleaning module 120 borne by the wiping board tray to the adsorbing board 411.

As shown in FIG. 46D, under the action of a magnetic force, the cleaning module 120 is adsorbed by the adsorbing board 411. The lifting mechanism 207 descends, and the wiping board tray 203 returns to the bottom of the base station 200.

As shown in FIG. 46E, the movable mechanism 412 clockwise rotates, and the horizontal pulling segment 4121 moves leftward. The second rolling wheel 418 enters the left half segment of the second sliding groove 414 through the third sliding groove 419, and the adsorbing board 411 rotates leftward by 90 degrees, to switch to the vertical position state. Subsequently, the movable mechanism 412 continues to work, and the adsorbing board 411 fixes the cleaning module 120 to continue to move toward the recycling box 206.

Figure 46F:
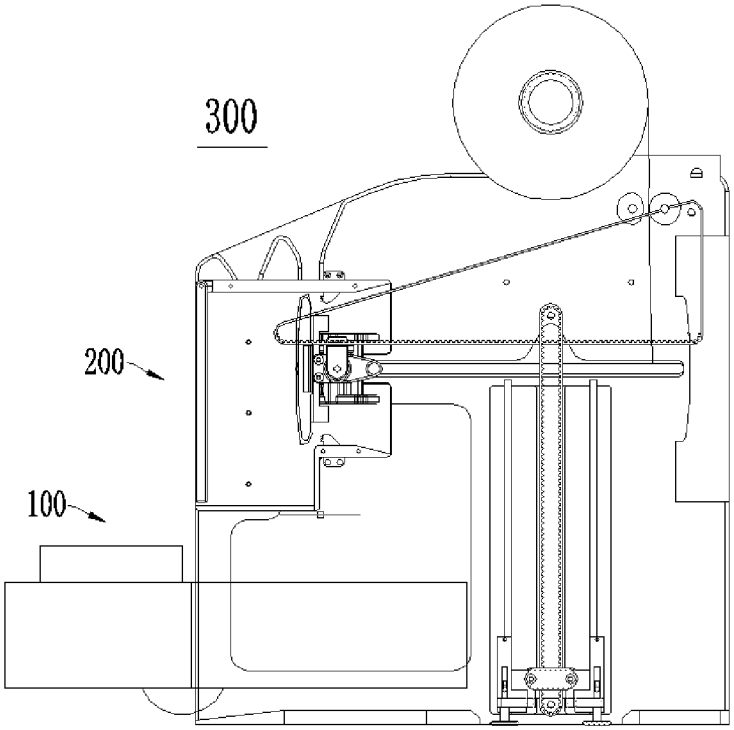

As shown in FIG. 46F, the adsorbing board 411 and the cleaning module 120 enter the recycling box 206 through the opening.

Figure 46G:
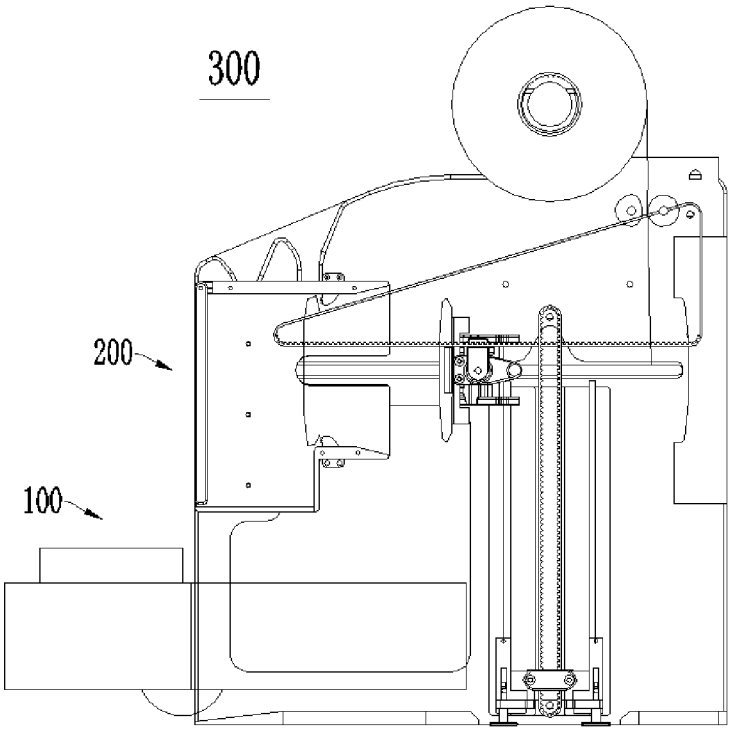

As shown in FIG. 46G, the movable mechanism 412 counterclockwise rotates inversely, to drive the adsorbing board 411 and the cleaning module 120 to move backward. When the cleaning module 120 passes through the separating module 422, the dirty wiping member on the cleaning module is hooked and scraped off, and subsequently drops into the recycling box 206.

Figure 46H:
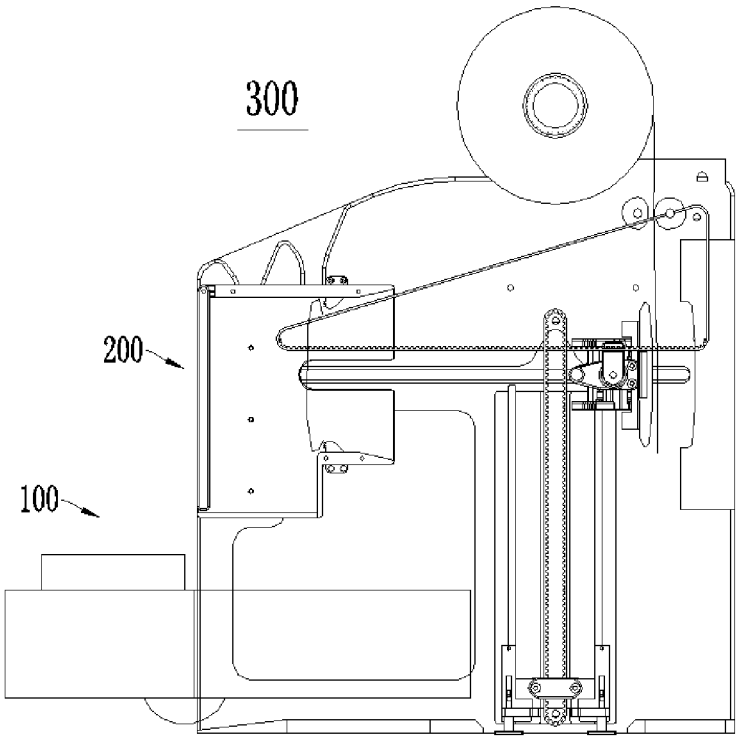
Figure 46I:
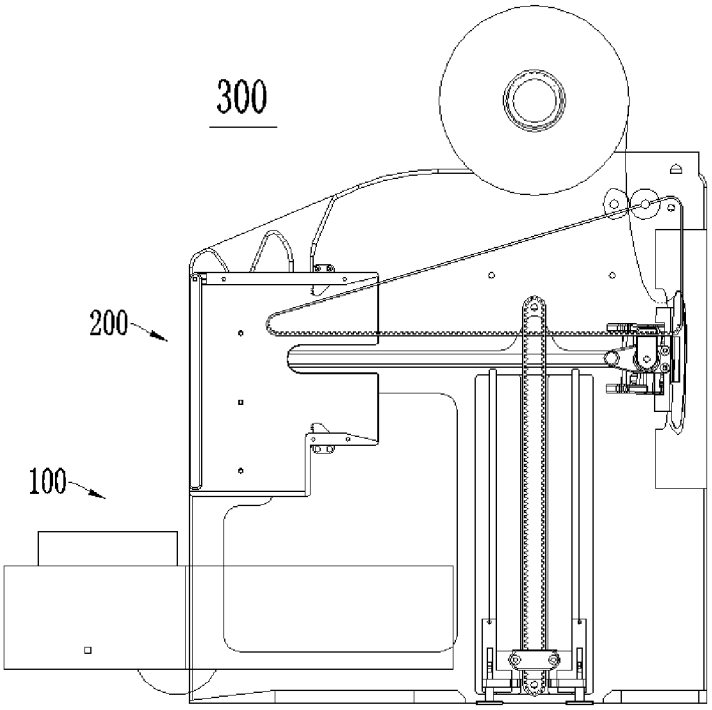

As shown in FIG. 46H, the movable mechanism 412 continues to inversely rotate, and the adsorbing board 411 and the cleaning module 120 continue to move backward (rightward). When moving to the position corresponding to the third sliding groove 419, the second rolling wheel 418 again enters the third sliding groove, and the adsorbing board 411 switches to the horizontal position state. Immediately afterward, with rotation of the movable mechanism 412, the second rolling wheel 418 again moves to the right half segment of the second sliding groove 414. The adsorbing board 411 rotates rightward by 90 degrees, to switch to the vertical position state.

As shown in FIG. 46I, the movable mechanism 412 continues to drive the adsorbing board 411 and the cleaning module 120 to move rightward, until the wiping board 1201 of the cleaning module 120 is exactly seated in the wiping member mounting position 420. In this case, the two delivery wheels of the feeding module 421 clamps the new wiping member provided by the supply module 204. When the wiping board 1201 of the cleaning module 120 is seated in the wiping member mounting position 420, a tensile force is applied to the wiping member, to snap and clamp the wiping member.

Figure 46J:
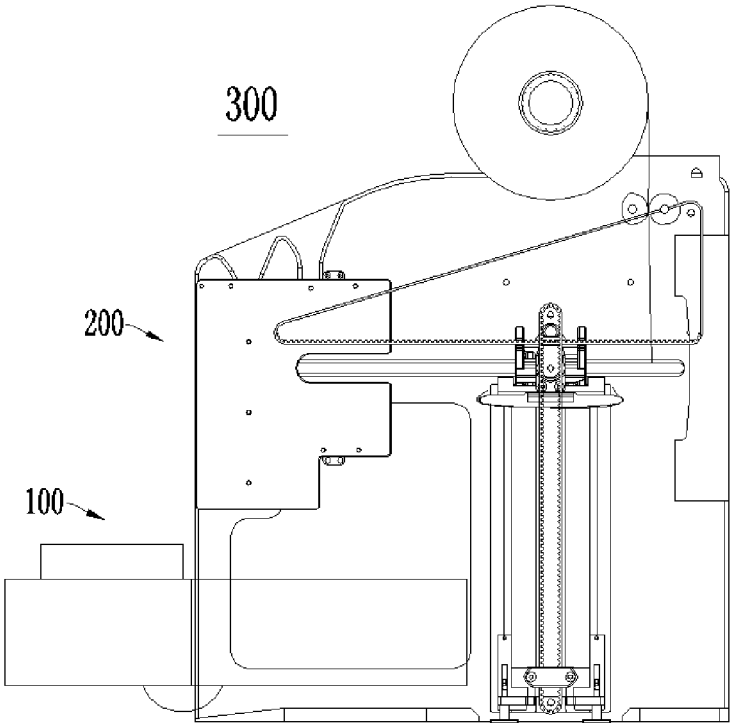

As shown in FIG. 46J, the movable mechanism 412 inversely drives the adsorbing board 411 and the cleaning module 120 to move leftward, and stops when the second rolling wheel 418 again enters the third sliding groove 419 through the second sliding groove 414, and the adsorbing board 411 is in communication with the cleaning module 120 and is restored to the horizontal position state.

Figure 46K:
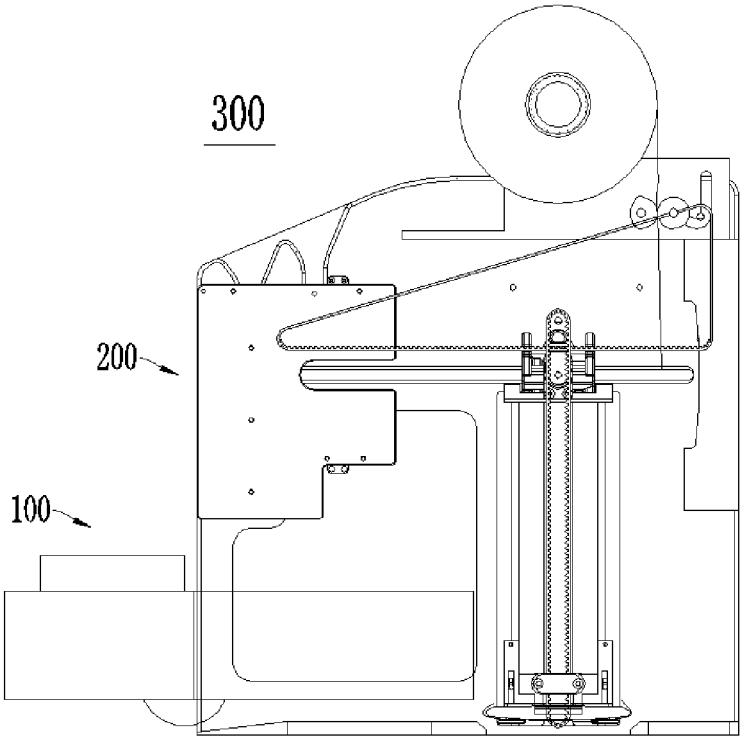

As shown in FIG. 46K, the lifting mechanism 207 drives the wiping board tray 203 to ascend, to take down the cleaning module 120 from the adsorbing board 411. Subsequently, the wiping board tray 203 is then driven to bear the cleaning module 120 to descend to the bottom.

Figure 46L:
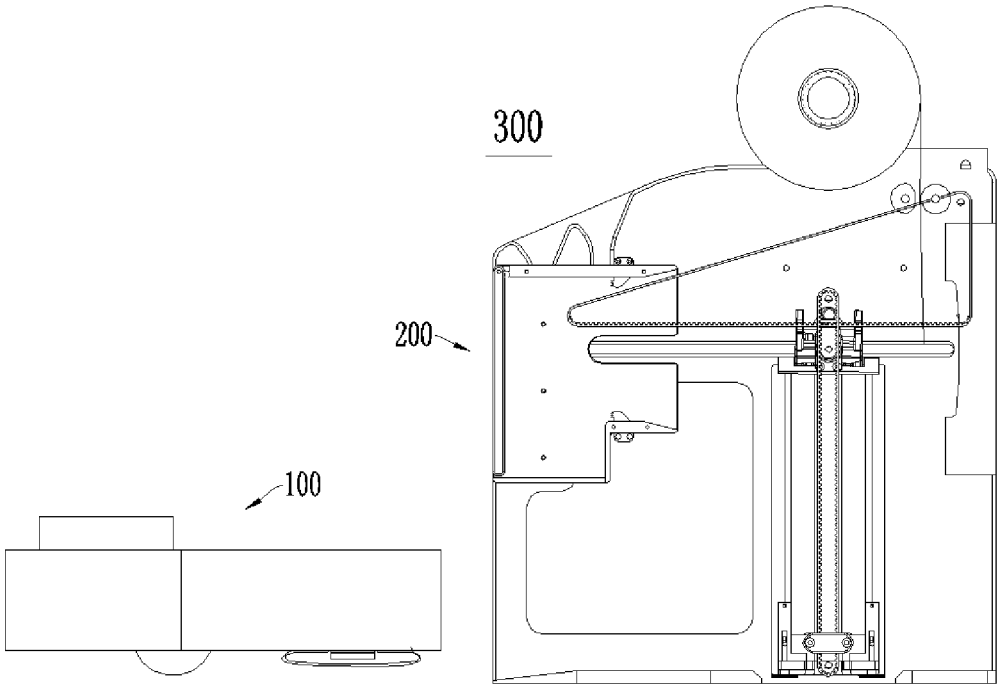

As shown in FIG. 46L, the cleaning robot 100 drives into the base station 200 to mount the cleaning module 120, and subsequently retreats from the base station 200 to begin working.

In the embodiment, a manner in which the adsorbing board 411 and the cleaning module 120 implement detachable magnetism may be that, the magnetic element disposed on the adsorbing board 411 may be an electromagnet. When the cleaning module 120 needs to be adsorbed on the adsorbing board 411, the electromagnet is powered on to generate a magnetic field. When the cleaning module 120 needs to be taken down from the adsorbing board 411 (a step shown in FIG. 46K), the electromagnet is powered off, the magnetic field disappears, and the cleaning module 120 falls onto the wiping board tray 203 under the action of gravity.

Moreover, the cleaning module 120 is also slightly different from those in the foregoing two solutions. In this embodiment, the cleaning module 120 may include only one wiping board 1201, which may be stuck to a cleaning module through a magic fastener/hook-and-loop fastener. In this way, in a step shown in FIG. 46I, when the movable mechanism 412 drives the adsorbing board 411 and the cleaning module 120 to move rightward until the wiping board 1201 is seated in the wiping member mounting position 420, the wiping board 1201 not only may apply a downward tensile force to the wiping member, thereby snapping the wiping member at a weak connection point, but also may apply a pressure to the wiping member, to enable the wiping member to be firmly stuck to the magic fastener/hook-and-loop fastener at the bottom of the wiping board 1201.

FIG. 47 to FIG. 50 are accompanying drawings involved in a third embodiment of the present invention. The third embodiment specifically provides a base station 200 used for a cleaning robot 100 to park in, and an automatic cleaning system 300 employing or equipped with the base station 200. In this embodiment, the cleaning robot 100 may be completely the same as the cleaning robot in the foregoing first and/or second embodiment, and details are not described herein. This embodiment describes a process of recycling a dirty wiping member, and the base station 200 mainly includes a receiving module, and a collection box 240 configured to recycle the dirty wiping member to the receiving module.

Figure 47:
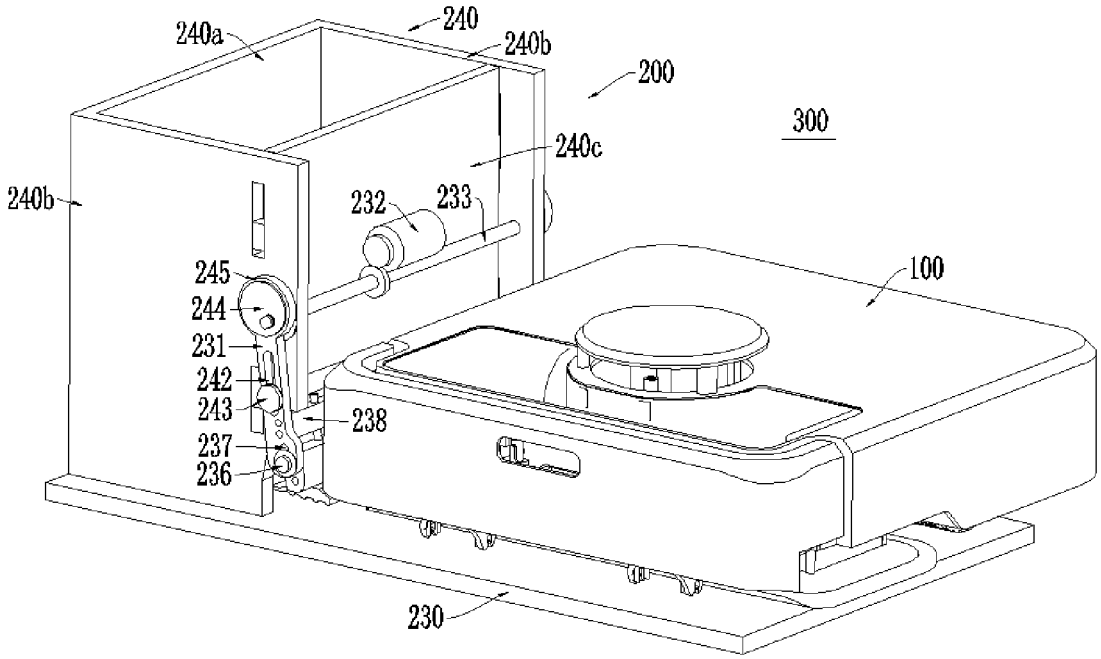
FIG. 47 is a schematic structural diagram of a first feasible solution of a cleaning system according to a third embodiment of the present invention.
Figure 49:
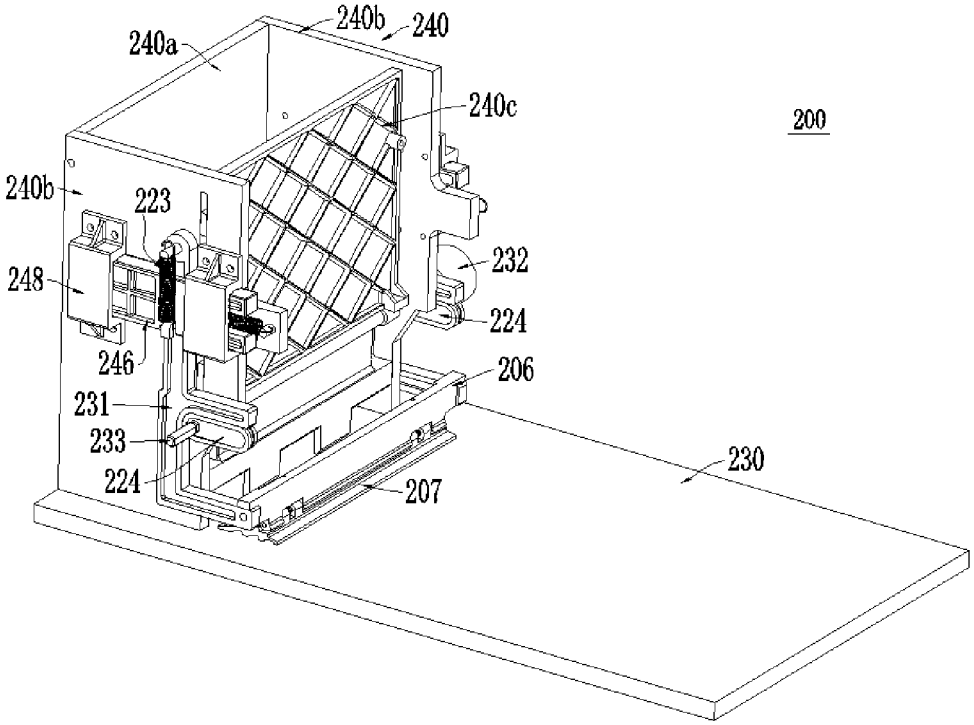
FIG. 49 is a schematic structural diagram of a base station of a second feasible solution of the cleaning system according to the third embodiment of the present invention.
Figure 50:
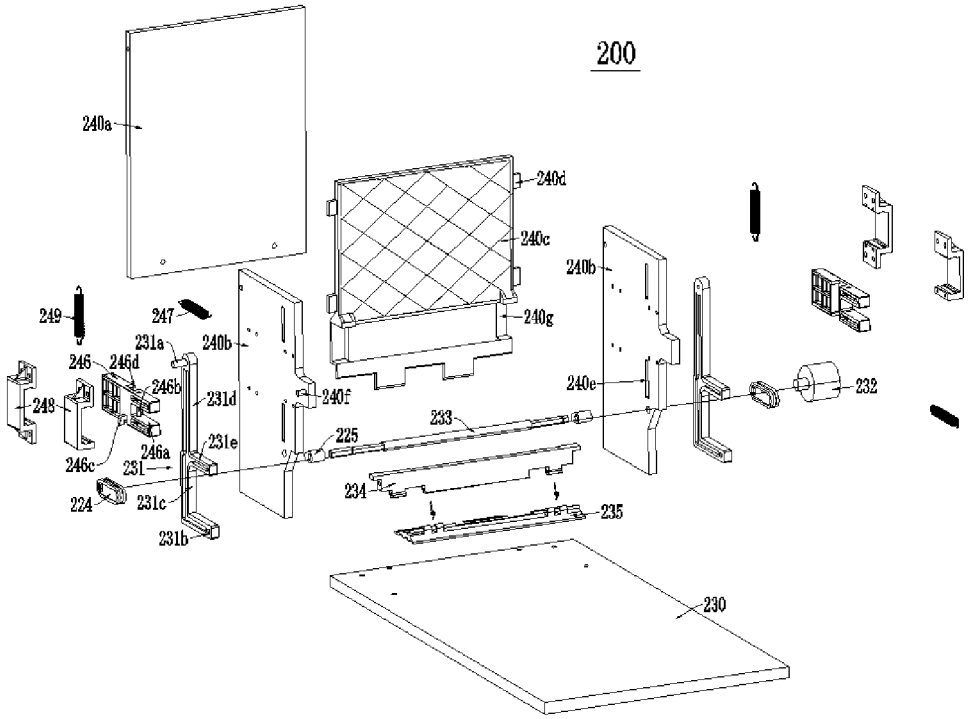
FIG. 50 is a schematic structural exploded view of the base station shown in FIG. 49.

As shown in FIG. 47, FIG. 49, and FIG. 50, in this embodiment, the base station 200 may include a bottom board 230 configured to be placed on a supporting surface (for example, ground), and the collection box 240 disposed on the bottom board 230 and configured to collect the dirty wiping member detached from the cleaning robot 100. The area of the bottom board 230 is greater than the area of a projection of the collection box 240 on the bottom board 230. In this way, when being disposed on the bottom board 230, the collection box 240 only occupies a partial region on the upper surface of the bottom board 230, and therefore the bottom board 230 forms a vacant region on the outer side of the collection box 240, for the cleaning robot 100 to park in (as shown in FIG. 47).

The collection box 240 may be in a half-open structure, and includes a rear board 240*a*, two side boards 240*b* connected to the rear board 240*a* and disposed oppositely, and a pressing board 240*c* slidably disposed between the two side boards 240*b* and opposite to the rear board 240*a*. The rear board 240*a* and the two side boards 240*b* are vertically disposed on the bottom board 230, the two side boards 240*b* are disposed in parallel, the pressing board 240*c* is clamped between the two side boards 240*b*, and the pressing board 240*c* is preferably parallel to the rear board 240*a*. Moreover, the pressing board 240*c* may slide up and down relative to the two side boards 240*b*, thereby opening or closing the collection box 240.

As shown in FIG. 50, to guide and limit up-and-down sliding of the pressing board 240*c*, convex lug structures 240*d* are formed at two horizontal ends of the pressing board 240*c*, the two side boards 240*b* are respectively provided with strip-shaped limit and guidance holes 240*e* extending vertically. The convex lug structures 240*d* are inserted into the limit and guidance holes 240*e* of the two side boards 240*b*, and may move up and down in the limit and guidance holes 240*e*, thereby limiting the pressing board 240*c* and guiding up-and-down sliding.

To recycling the dirty wiping member detached from the cleaning robot 100 into the collection box 240, the base station 200 further includes a wiping member collection mechanism. The wiping member collection mechanism includes a driving assembly disposed on the collection box 240 and a raking assembly driven by the driving assembly. The raking assembly is driven by the driving assembly to cause a lower end of the raking assembly to have a working stroke moving in a direction toward the collection box 240 and a returning stroke moving in a direction away from the collection box 240. When being in the working stroke, the lower end of the raking assembly comes into contact with the bottom board 230, to tightly press the dirty wiping member and drag the dirty wiping member to move toward the collection box 240 on the bottom board 230. When being in the returning stroke, the lower end of the raking assembly is detached from the bottom board 230.

As shown in FIG. 47, FIG. 49, and FIG. 50, the raking assembly may include a swinging member 231. The driving assembly may include a motor 232, and an actuation member driven by rotation of the motor 232. The actuation member and the swinging member 231 cooperate to drive the lower end of the swinging member 231 to move along the working stroke or returning stroke.

The driving assembly further includes an input shaft 233 driven by rotation of the motor 232, the input shaft 233 is threaded to outer sides of the two side boards 240*b* of the collection box 240, and two ends of the input shaft are each provided with an actuation member. With reference to FIG. 47, the motor 232 may drive, through a meshing action between a driving gear and a driven gear, the input shaft 233 to rotate. There are also two swinging members 231, disposed on outer sides of the collection box 240 and correspondingly cooperating with the two actuation members respectively.

In a feasible embodiment, the raking assembly may include only the swinging member 231, or the swinging member 231 individually forms the raking assembly. In this case, when being in the working stroke, the lower end of the swinging member 231 may butt the bottom board 230, tightly press the dirty wiping member, and drag the dirty wiping member to move toward the collection box 240. In this case, the lower end of the swinging member 231 forms the lower end of the raking assembly.

In another feasible embodiment, the raking assembly may further include a connection member 234 and a squeezing board 235, two ends of the connection member 234 are rotatably connected to the lower ends of the two swinging members 231 respectively, and the squeezing board 235 is rotatably disposed at a lower end of the connection member 234. In this case, the lower end of the squeezing board 235 forms the lower end of the raking assembly.

The connection member 234 is substantially in a horizontally extending slat shape, two ends of which are respectively connected to the two side boards 240*b* of the collection box 240. The squeezing board 235 is substantially in a horizontally extending board shape, and to increase contact friction between a lower surface of the squeezing board and the dirty wiping member, the lower surface of the squeezing board 235 may form concave-convex textures extending along the length direction of the squeezing board.

The squeezing board 235 and the connection member 234 may be rotatably connected through pin shafts. Specifically, as shown in FIG. 50, the lower end of the squeezing board 235 may form one or more notches, and the upper end of the squeezing board 235 may be correspondingly provided with one or more connection protrusions. Two sides of the notch and the connection protrusion are provided with pin holes, the pin shafts are threaded in the pin holes, and the connection protrusion is stuck in the corresponding notch.

Figure 48:
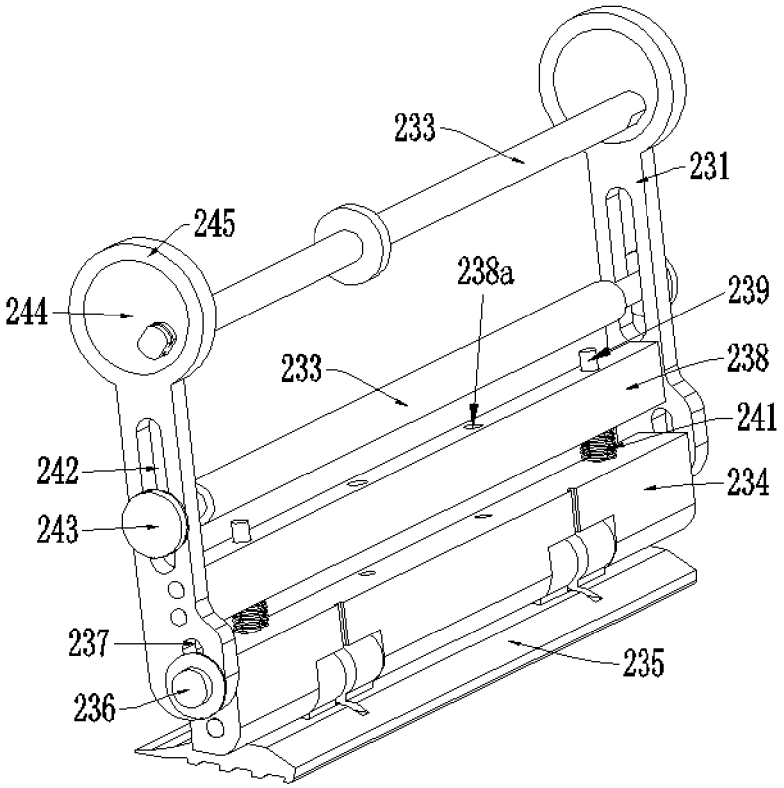
FIG. 48 is a schematic structural diagram of a wiping member collection mechanism in FIG. 47.

The connection member 234 may move up and down relative to the swinging member 231, to cause the squeezing board 235 to float up and down. Specifically, as shown in FIG. 48, two ends of the connection member 234 are provided with connection shafts 236, the lower ends of the two swinging members 231 are provided with shaft holes 237 extending along the vertical direction, and the two connection shafts 236 are respectively inserted into the two shaft holes 237. The connection shafts 236 may move up and down in the shaft holes 237, to further cause the squeezing board 235 to float.

When the working stroke begins, the squeezing board 235 compresses the dirty wiping member on the bottom board 230. As the working stroke continuously proceeds, a compression force of the squeezing board 235 on the dirty wiping member and the bottom board 230 is gradually increased, to push the connection member 234 to move upward. Subsequently, the compression force of the squeezing board 235 on the dirty wiping member and the bottom board 230 is then gradually reduced, and then the connection member 234 falls back. Therefore, during the entire working stroke, the squeezing board 235 may always keep compression on the dirty wiping member and the bottom board 230.

A guiding member 238 located above the connection member 234 may be disposed between the two swinging members 231, the guiding member 238 is provided with a guiding hole 238*a*, a guiding pin 239 is movably threaded in the guiding hole 238*a*, and the lower end of the guiding pin 239 and the connection member 234 are fixedly connected. When the squeezing board 235 moves on the bottom board 230 to push the connection member 234 to move up and down relative to the swinging member 231, the guiding pin 239 may be driven to move up and down in the guiding hole 238*a*, and then up-and-down floating of the connection member 234 and the squeezing board 235 is guided and righted.

To improve the compression force on the dirty wiping member and the bottom board 230, in another embodiment, an elastic member 241 may be disposed to push the connection member 234 and the squeezing board 235. The elastic member 241 in a compressed state is disposed between the guiding member 238 and the connection member 234. In this way, during the entire working stroke, as the connection member 234 moves up and down relative to the swinging member 231, the biased elastic member 241 may apply downward elastic action forces in different extents to the connection member 234, to further improve the force by which the squeezing board 235 compresses the dirty wiping member and the bottom board 230, thereby avoiding a case that the dirty wiping member is not dragged by the squeezing board 235 because the compression force applied by the squeezing board 235 is relatively small, and ensuring that the dirty wiping member can smoothly move toward the collection box 240.

A tension spring may be disposed between the squeezing board 235 and the connection member 234, and a twisting force applied by the tension spring to the squeezing board 235 causes the end portion of the squeezing board 235 close to the collection box 240 to have a trend of rotating around a direction toward the bottom board 230. In this way, under the action of the twisting force applied by the tension spring, the end portion of the squeezing board 235 close to the collection box 240 always has a trend of rotating downward. Therefore, when the squeezing board 235 begins to switch from a descending stroke to the working stroke, the left end of the squeezing board 235 first comes into contact with the dirty wiping member and the bottom board 230, and as the squeezing board 235 continues to descend, the squeezing board 235 rotates by using the end portion of the squeezing board coming into contact with the bottom board 230 as a supporting point, until the lower surface of the squeezing board completely comes into contact with the dirty wiping member and the bottom board 230. In this way, by causing the squeezing board 235 to gradually come into contact with and compress the dirty wiping member and the bottom board 230, a compression effect of the squeezing board 235 on the dirty wiping member may be improved.

The pressing board 240*c* of the collection box 240 is designed to be capable of opening when the squeezing board 235 moves to the end of the working stroke. The lower end of the pressing board 240*c* may form a wedged inclined surface facing the squeezing board 235, and an end portion of the squeezing board 235 facing the wedged inclined surface is a wedged end. The wedged inclined surface may be formed by tilting a partial lower end surface of the pressing board 240*c* toward the squeezing board 235, and the wedged end may be a tip end, a cross-sectional area of which is gradually reduced along the working stroke direction. When the squeezing board 235 moves to the wedged end along the working stroke to butt the wedged inclined surface, the pressing board 240*c* may be pushed by the wedged end to slide upward, thereby opening the collection box 240, and the dirty wiping member compressed at the lower end of the squeezing board 235 enters the collection box 240 through the opened opening. When the working stroke is completed, the squeezing board 235 moves upward, to reach the returning stroke. In this case, the pressing board 240*c* may fall under the action of its own gravity, to cause the lower end of the pressing board to butt the bottom board 230, thereby pressing the dirty wiping member and causing the dirty wiping member to remain in the current position, to avoid a case that the dirty wiping member has a displacement because of an external factor (for example, wind blowing or airflow).

As shown in FIG. 48, in an embodiment, a pivoting portion 242 is disposed on the swinging member 231, and an engaging portion 243 is disposed on the side board 240*b* of the collection box 240. The pivoting portion 242 may be a strip-shaped sliding groove disposed on the swinging member 231 and extending along the length direction of the swinging member 231, and the engaging portion 243 may be a guiding component fixed on the side board 240*b* of the collection box 240. The guiding component is inserted into the strip-shaped sliding groove and can rotate and slide in the strip-shaped sliding groove. The actuation member includes an eccentric structure, and the eccentric structure and the upper end of the swinging member 231 are rotatably connected.

The eccentric structure may be an eccentric wheel 244, and the eccentric wheel 244 and the input shaft 233 are eccentrically disposed. The upper end of the swinging member 231 may be provided with a wheel ring 245, and the eccentric wheel 244 is disposed in the wheel ring 245. Alternatively, the eccentric structure may be a connecting rod, the extending direction of the connecting rod and the axial direction of the input shaft 233 are perpendicular, and the upper end of the swinging member 231 and the connecting rod are rotatably connected.

As shown in FIG. 49, the input shaft 233 drives the eccentric structure to rotate, the eccentric structure may drive the upper end of the swinging member 231 rotatably connected to the eccentric structure to rotate around the axis of the input shaft 233, and a rotation track of the upper end of the swinging member 231 is a circle. The position in the swinging member 231 close to the middle is limited by the pivoting portion 242 and the engaging portion 243. Therefore, the swinging member 231 rotates by using a junction of the pivoting portion 242 and the engaging portion 243 as a supporting point, so that the lower end of the swinging member may swing. Therefore, the connection member 234 and the squeezing board 235 that are disposed at the lower end of the swinging member 231 are driven to swing accordingly.

A working process of the embodiment is described below:

The squeezing board 235 of the raking assembly is initially located at a raised position, the cleaning robot works and then enters the base station 200, and the dirty wiping member is released onto the bottom board 230 of the base station 200.

Subsequently, the motor 232 drives the input shaft 233 to clockwise rotate, and under the driving of the eccentric structure, the squeezing board 235 gradually moves downward, until the dirty wiping member is pressed.

The motor 232 drives the input shaft 233 to continue to clockwise rotate, the squeezing board 235 is driven to move toward the working stroke direction, and then the dirty wiping member is dragged to move together, until the wedged end of the squeezing board 235 butts the wedged inclined surface of the pressing board 240*c* of the collection box 240. As the squeezing board 235 continues to move forward, the pressing board 240*c* is pushed away, and the dirty wiping member is fed into the collection box 240.

The squeezing board 235 moves to the end of the working stroke, the motor 232 drives the input shaft 233 to continue to clockwise rotate, and the squeezing board 235 begins to rise and move backward, until the wedged end is detached from the wedged inclined surface. The pressing board 240*c* moves downward under the action of gravity, to press the dirty wiping member, and a part of the dirty wiping member is inputted to the collection box 240.

The motor 232 drives the input shaft 233 to continue to clockwise rotate, and the squeezing board 235 moves along the returning stroke. The foregoing process is repeated, until the dirty wiping member is completely received into the collection box 240.

As shown in FIG. 49 and FIG. 50, in another embodiment, a slidable member 246 capable of moving along the working stroke direction or the returning stroke direction is disposed on the side board 240*b* of the collection box 240, a first reset member 247 is disposed between the slidable member 246 and the side board 240*b*, and a reset force applied by the first reset member 247 to the slidable member 246 causes the slidable member to have a trend of moving toward the returning stroke direction. A guiding hoop 248 is disposed on the side board 240*b* of the collection box 240, and the slidable member 246 is threaded in the guiding hoop 248 and is vertically limited by the guiding hoop 248, so that the slidable member 246 may horizontally move on the side board 240*b*.

A notch 246*a* is formed on the slidable member 246, and a first hanging member 246*b* is disposed in the notch 246*a*. The outer wall of the side board 240*b* may be provided with a second hanging member 240*f*. The first reset member 247 may be a spring, two ends of which are respectively hung on the first hanging member 246*b* and the second hanging member 240*f*. The first hanging member 246*b* may be a pin shaft structure vertically disposed in the notch 246*a*, and the second hanging member 240*f* may be a protrusion structure disposed on the outer wall of the side board 240*b*. The first reset member 247 is in the stretched state, to apply a tensile force toward the returning stroke direction to the slidable member 246.

The swinging member 231 may be slidably disposed on the side board 240*b*, and the swinging member 231 and the slidable member 246 are fixed between each other along the working stroke direction or the returning stroke direction. A second reset member 249 is disposed between the swinging member 231 and the slidable member 246, and a reset force applied by the second reset member 249 to the swinging member 231 causes the swinging member to have a trend of moving in a direction departing from the bottom board 230.

As shown in FIG. 50, the outer wall at the upper end of the swinging member 231 is provided with a third hanging member 231*a*, the outer wall at the lower end of the slidable member 246 is provided with a fourth hanging member 246*c*, and the second reset member 249 is a spring, two ends of which are respectively hung on the third hanging member 231*a* and the fourth hanging member 246*c*. The third hanging member 231*a* may be a protrusion structure disposed on the outer wall of the swinging member 231, and the fourth hanging member 246*c* may be a hook-shaped structure disposed on the outer wall of the slidable member 246. The second reset member 249 is in the stretched state, to apply an upward tensile force to the swinging member 231.

The inner side wall of the slidable member 246 is provided with a guiding sliding groove 246*d* extending along the vertical direction, and the swinging member 231 is threaded in the guiding sliding groove 246*d* and is limited by the guiding sliding groove 246*d* along the horizontal direction.

The swinging member 231 is provided with a first contour tracing groove 231*c*, and the actuation member includes a first cam 224 disposed in the first contour tracing groove 231*c*. The first cam 224 is driven by the input shaft 233 to rotate in the first contour tracing groove 231*c*, and may drive, by butting the surface of the first contour tracing groove 231*c*, the swinging member 231 to move, the swinging member 231 is reset under the action of the first reset member 247 and the second reset member 249, and then movement of the swinging member 231 is cycled.

The swinging member 231 as a whole is in an inverted "F" shape, including a rod body 231*d*, and a first extending portion 231*e* disposed on the rod body 231*d*. A right surface of the rod body 231*d* and a lower surface of the first extending portion 231*e* define the first contour tracing groove 231*c*. The rod body 231*d* is threaded in the guiding sliding groove 246*d*, and the first extending portion 231*e* is located below the slidable member 246. The swinging member 231 further includes a second extending portion 231*b* disposed at the lower end of the rod body 231*d*, and the connection member 234 is rotatably disposed on an end portion of the second extending portion 231*b*.

The first cam 224 includes two flat contour tracing surfaces disposed oppositely, and arc-shaped contour tracing surfaces in smooth transition with the two flat contour tracing surfaces, and a connection point between the first cam 224 and the input shaft 233 is located at a circle center of one of the arc-shaped contour tracing surfaces. The first contour tracing groove 231*c* includes an arc-shaped smooth transition surface connected between the right surface of the rod body 231*d* and the lower surface of the first extending portion 231*e*, and the curvature of the arc-shaped smooth transition surface and the curvature of the arc-shaped contour tracing surface match. The arc-shaped contour tracing surface close to the connection point between the first cam 224 and the input shaft 233 forms the lowest potential energy point of the first cam 224. Correspondingly, the arc-shaped contour tracing surface away from the connection point between the first cam 224 and the input shaft 233 forms the highest potential energy point of the first cam 224.

When the squeezing board 235 is located at the working stroke, the lowest potential energy point of the first cam 224 rotates in the arc-shaped smooth transition surface, and the highest potential energy point of the first cam 224 slides on the right surface of the rod body 231*d*. The lower surface of the first extending portion 231*e* and the lowest potential energy point of the first cam 224 come into contact, and then the swinging member 231 is located at the lowest position. In this way, the connection member 234 and the squeezing board 235 that are disposed at the lower end of the swinging member 231 can be compressed on the bottom board 230. Meanwhile, the highest potential energy point of the first cam 224 slides on the right surface of the rod body 231*d*, and a distance between connection points between the swinging members 231 and the input shaft 233 is gradually increased. Because the input shaft 233 is fixed relative to the collection box 240, the swinging member 231 gradually moves away from the input shaft 233. In this way, the connection member 234 and the squeezing board 235 that are disposed at the lower end of the swinging member 231 move toward the collection box 240 accordingly. Therefore, the squeezing board 235 compresses the dirty wiping member on the bottom board 230, and the swinging member 231 is pushed by the first cam 224 to cause the squeezing board 235 to move toward the collection box 240, thereby recycling the dirty wiping member.

When the squeezing board 235 is located at the returning stroke, the lowest potential energy point of the first cam 224 slides on the right surface of the rod body 231*d*, and the highest potential energy point of the first cam 224 slides on the lower surface of the first extending portion 231*e*. The lower surface of the first extending portion 231*e* and the highest potential energy point of the first cam 224 come into contact, and then the swinging member 231 is located at the highest position. In this way, the connection member 234 and the squeezing board 235 that are disposed at the lower end of the swinging member 231 are raised away from the bottom board 230. Meanwhile, the lowest potential energy point of the first cam 224 slides on the right surface of the rod body 231*d*. In this case, under the action of the first reset member 247, the slidable member 246 and the swinging member 231 are pulled to move toward the returning stroke direction, and the connection member 234 and the squeezing board 235 that are disposed at the lower end of the swinging member 231 also move toward the returning stroke direction accordingly. Therefore, the squeezing board 235 is raised to be higher than the bottom board 230, and under the action of the first reset member 247, the swinging member 231, and the connection member 234 and the squeezing board 235 that are disposed at the lower end of the swinging member 231 are driven to move toward the returning stroke direction, to implement returning of the swinging member 231.

A second contour tracing groove 240*g* is formed on a surface of the pressing board 240*c* facing the returning stroke direction. A second cam 225 accommodated in the second contour tracing groove 240*g* is disposed on the input shaft 233, and the highest potential energy point of the second cam 225 and the highest potential energy point of the first cam 224 are located at two sides of the input shaft 233.

The second contour tracing groove 240*g* includes a surface facing the returning stroke direction (briefly referred to as a front side surface below) and a lower surface. The highest potential energy point of the second cam 225 and the highest potential energy point of the first cam 224 are located at the two sides of the input shaft 233. Therefore, when the squeezing board 235 is located at the working stroke, the highest potential energy point of the first cam 224 is located below. In this case, the highest potential energy point of the second cam 225 is located above, to butt the lower surface of the second contour tracing groove 240*g*, the pressing board 240*c* is pushed away by the second cam 225 and is in the opened state, and then the dirty wiping member dragged by the squeezing board 235 enters the collection box 240.

When the squeezing board 235 is located at the returning stroke, the highest potential energy point of the first cam 224 is located above. In this case, the highest potential energy point of the second cam 225 is located below. That is, the lowest potential energy point of the second cam 225 butts the lower surface of the second contour tracing groove 240*g*, and therefore the pressing board 240*c* falls under the action of its own gravity, and then presses the dirty wiping member.

FIG. 51 to FIG. 56 are accompanying drawings involved in a fourth embodiment of the present invention. The fourth embodiment specifically provides a base station 200, capable of automatically recycling a dirty wiping member detached by a cleaning robot 100, and including: a rack 11, a wiping member separating position 13 disposed on the rack 11 and used for the cleaning robot 100 to release a wiping member, a receiving module 15 disposed on the rack 11 and configured to accommodate a wiping member, a delivery device 17 disposed on the rack 11, a clamping mechanism 19 disposed on the delivery device 17, and a driving mechanism configured to drive the delivery device 17. The clamping mechanism 19 has a first working state of moving between the receiving module 15 and the wiping member separating position 13, a second working state of clamping a wiping member on the wiping member separating position 13, and a third working state of releasing a wiping member into the receiving module 15. The driving mechanism drives the delivery device 17 to cause the clamping mechanism 19 to move between the wiping member separating position 13 and the receiving module 15 and then switch among the first working state, the second working state, and the third working state.

During use, after the wiping member completes mopping, the cleaning robot 100 may park in the wiping member separating position 13, and release the wiping member onto the wiping member separating position 13. Then, the driving mechanism is started to drive the delivery device 17 to then cause the clamping mechanism 19 to move between the wiping member separating position 13 and the receiving module 15 and switch among the first working state, the second working state, and the third working state. When clamping the wiping member on the wiping member separating position 13 and clamping the wiping member to move until moving to the receiving module 15, the clamping mechanism 19 opens toward the receiving module 15, to release the wiping member into the receiving module 15. In this way, the wiping member is automatically recycled, and an operator does not need to manually take out the wiping member, to avoid manual intervention.

The rack 11 includes a first framework 41 and a second framework 43 that are vertically disposed, the first framework 41 and the second framework 43 as a whole are rectangular and respectively form a first opening and a second opening, and the cleaning robot 100 can pass through the first opening to enter the rack 11, and is threaded in the second opening.

The wiping member separating position 13 and the receiving module 15 are both disposed between the first framework 41 and the second framework 43, and the wiping member separating position 13 is a parking board located at the bottom of the rack 11 and used for the cleaning robot 100 to park in and receiving the released wiping member. The receiving module 15 is located above the wiping member separating position 13, and has an upper end opened, to collect the dirty wiping member.

The delivery device 17 includes a first delivery portion 37 and a second delivery portion 39, the first delivery portion 37 includes a plurality of first synchronization wheels 45 disposed on the first framework 41 and a first synchronization belt 49 surrounding the plurality of first synchronization wheels 45. The driving mechanism is in a transmission connection to the first synchronization wheels 45, to drive the first synchronization wheels 45 to rotate. The driving mechanism may be a motor.

A controller connected to the driving mechanism is disposed on the rack 11, configured to receive a signal sent by the cleaning robot 100 and control the driving mechanism according to the signal sent by the cleaning robot 100. The signal sent by the cleaning robot 100 may be a wiping member replacement signal, and when the cleaning robot 100 sends the wiping member replacement signal to the controller, the controller controls the driving mechanism, to enable the driving mechanism to drive the delivery device to perform delivery. In another implementation, the controller is connected to the clamping mechanism 19 and configured to control the clamping mechanism to perform separation and attaching. The controller is a control electromagnet.

A plurality of third rotatable shafts 53 is disposed on the first framework 41 and corresponds to the plurality of first synchronization wheels 45, and each first synchronization wheel 45 is fixedly sleeved on a corresponding third rotatable shaft 53, thereby driving the third rotatable shaft 53 to rotate to drive the first synchronization wheel 45 to rotate, and then drive the first synchronization belt 49 to rotate.

Similarly, with reference to the foregoing description on the first delivery portion 37, the second delivery portion 39 includes a plurality of second synchronization wheels 47 disposed on the second framework 43 and a second synchronization belt 51 surrounding the plurality of second synchronization wheels 47. The driving mechanism is in a transmission connection to the second synchronization wheels 47, to drive the second synchronization wheels 47 to rotate.

A plurality of fourth rotatable shafts 55 is disposed on the second framework 43 and corresponds to the plurality of second synchronization wheels 47, and each second synchronization wheel 47 can be fixedly sleeved on a corresponding fourth rotatable shaft 55, thereby driving the fourth rotatable shaft 55 to rotate to drive the second synchronization wheel 47 to rotate, and then drive the second synchronization belt 51 to rotate.

The clamping mechanism 19 includes a first rotatable shaft 31 and a second rotatable shaft 33 that are disposed oppositely and a first clamping jaw 21 and a second clamping jaw 23 that are respectively sleeved on the first rotatable shaft 31 and the second rotatable shaft 33, the first clamping jaw 21 and the second clamping jaw 23 can respectively rotate around extending directions of the first rotatable shaft 31 and the second rotatable shaft 33, and two ends of the first rotatable shaft 31 and two ends of the second rotatable shaft 33 are respectively connected to the first synchronization belt and the second synchronization belt of the delivery device 17. A tension spring 35 is disposed between the first clamping jaw 21 and the second clamping jaw 23, and the first clamping jaw 21 and the second clamping jaw 23 are separated from each other under an action force of the tension spring 35, to cause the clamping mechanism 19 to be in an opened state.

One end of the first clamping jaw 21 away from the first rotatable shaft 31 is provided with magnet configured to attach to the second clamping jaw 23. When the clamping mechanism 19 is in the opened state, a spacing between magnets of the first clamping jaw 21 and the second clamping jaw 23 is large, the force of the tension spring 35 is greater than a magnetic force between the first clamping jaw 21 and the second clamping jaw 23, and the clamping mechanism 19 may be kept in the opened state. When the clamping mechanism 19 is in the closed state, a spacing between the magnets of the first clamping jaw 21 and the second clamping jaw 23 is small, a magnetic force between the first clamping jaw 21 and the second clamping jaw 23 is greater than the force of the tension spring 35, and the clamping mechanism 19 is kept closed and provides a clamping force.

Figure 54:
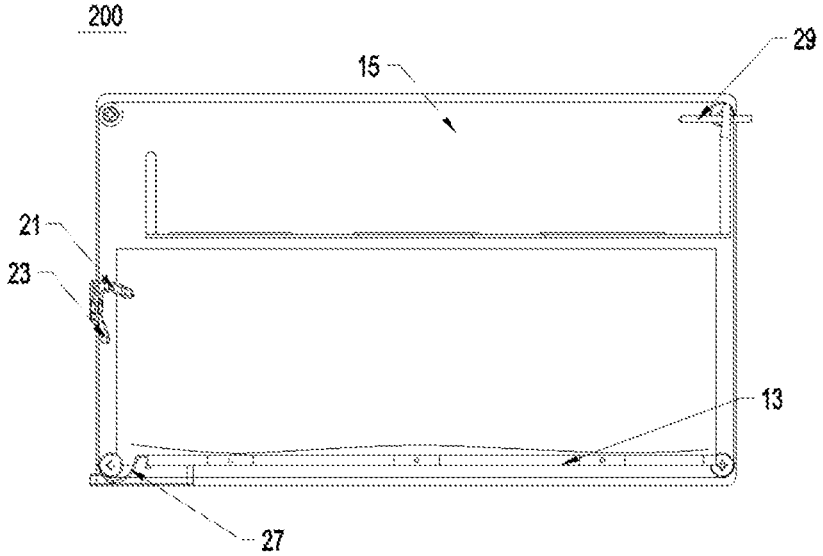
FIG. 54 is a schematic structural diagram of the base station when the clamping mechanism is in a first working state.
Figure 55:
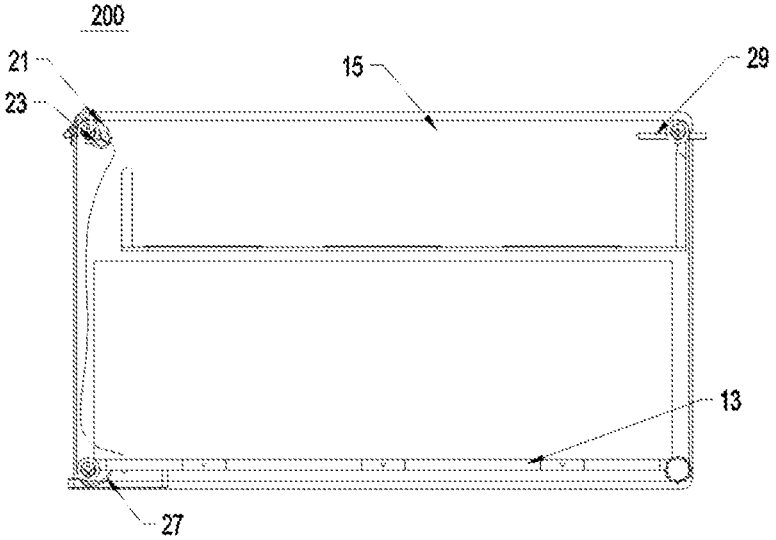
FIG. 55 is a schematic structural diagram of the base station when the clamping mechanism is in a second working state.
Figure 56:
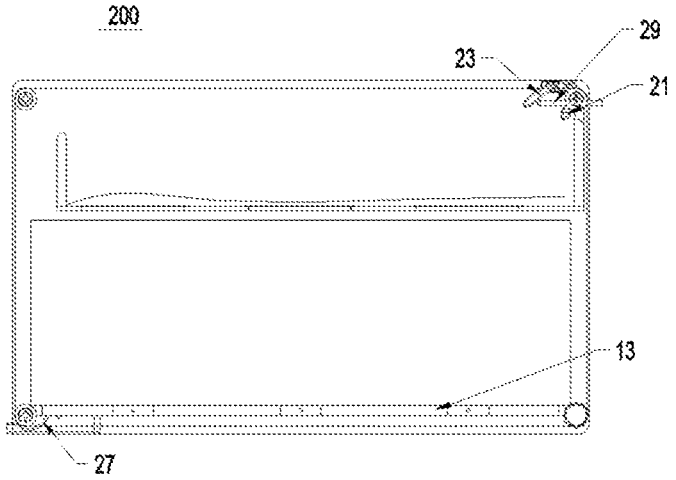
FIG. 56 is a schematic structural diagram of the base station when the clamping mechanism is in a third working state.
Figure 57:
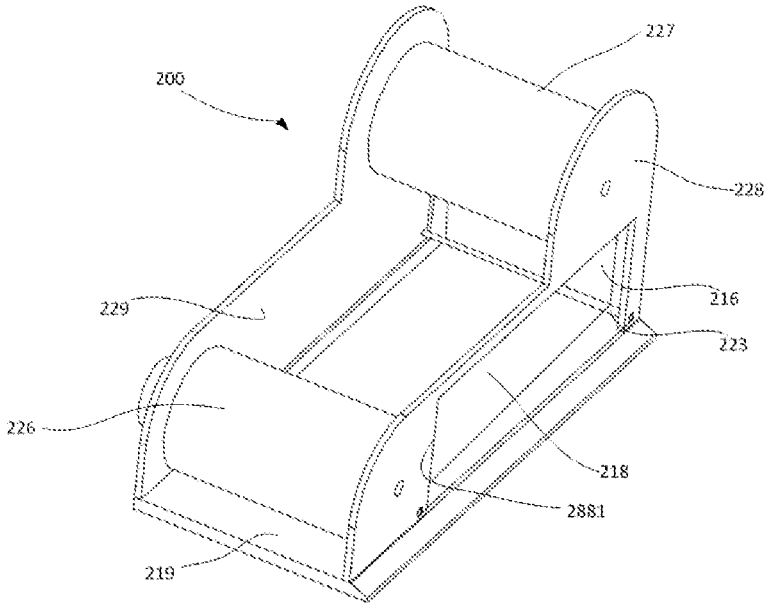
FIG. 57 is a schematic structural diagram of a base station according to a fifth embodiment of the present invention.
Figure 58:
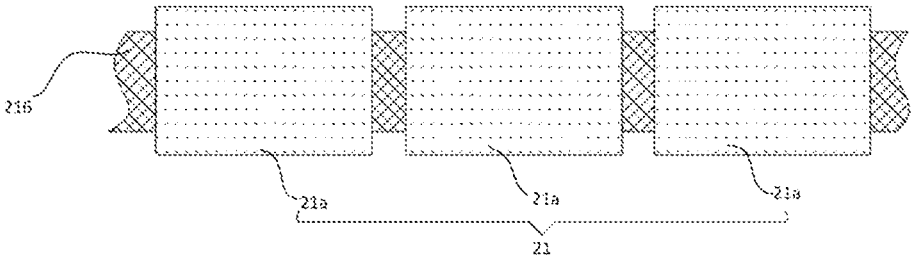
FIG. 58 is a schematic structural diagram of a base belt in FIG. 57.
Figure 59:
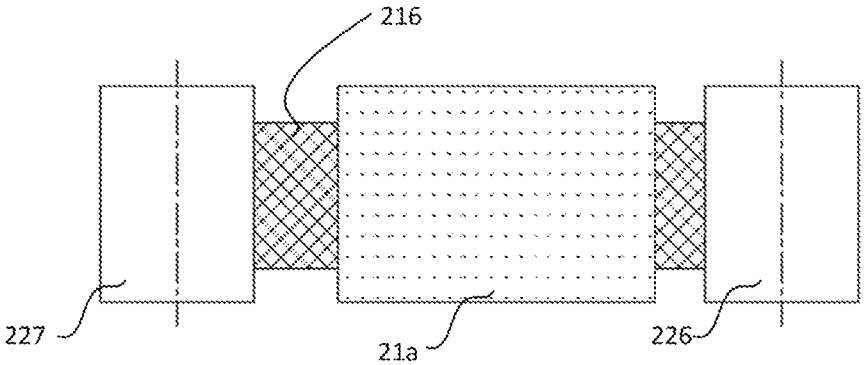
FIG. 59 is a schematic structural diagram of a first roller, a second roller, and the base belt in FIG. 57.

As shown in FIG. 54, a first guiding portion 27 located on a side of the wiping member separating position 13 is further disposed on the rack 11 and configured to apply an action force to the second clamping jaw 23, to enable the second clamping jaw 23 to rotate relative to the first clamping jaw 21 and attach to the first clamping jaw 21, to clamp the wiping member. After the cleaning robot 100 parks in the wiping member separating position 13 and releases the wiping member, the driving mechanism drives the first synchronization wheel 45 and the second synchronization wheel 47 to respectively drive the first synchronization belt 49 and the second synchronization belt 51 to counterclockwise rotate, and the clamping mechanism 19 moves downward. When the second clamping jaw 23 moves to come into contact with the first guiding portion 27, the first guiding portion 27 applies an action force to the second clamping jaw 23, and the second clamping jaw 23 counterclockwise rotates, and then attaches to the magnet on the first clamping jaw 21, to clamp the wiping member.

The first guiding portion 27 is a first groove opened upward, and when the second clamping jaw 23 moves to come into contact with the inner wall of the first groove, the inner wall of the first groove applies a resisting force to the second clamping jaw 23. As the delivery device 17 rotates, the second clamping jaw 23 rotates around the second rotatable shaft 33 under the action of the resisting force and attaches to the magnet on the first clamping jaw 21, to clamp the wiping member.

A second guiding portion 29 located on a side of the receiving module 15 is further disposed on the rack 11 and configured to apply an action force to the second clamping jaw 23, to enable the second clamping jaw 23 to rotate relative to the first clamping jaw 21 and separate from the first clamping jaw 21, to release the wiping member. Specifically, after the first clamping jaw 21 and the second clamping jaw 23 attach and clamp the wiping member, the driving mechanism drives the delivery device 17 to clockwise rotate, to cause the clamping mechanism 19 to move upward. When the clamping mechanism moves to directly face the second guiding portion 29, the second guiding portion 29 applies an action force to the second clamping jaw 23, to cause the second clamping jaw 23 to clockwise rotate and separate from the magnet on the first clamping jaw 21, to release the wiping member.

The second guiding portion 29 is a rod body capable of stretching in between the first clamping jaw 21 and the second clamping jaw 23, and is configured to butt the second clamping jaw 23. When the clamping mechanism 19 moves toward the rod body with the delivery of the delivery device 17, the rod body stretches in between the first clamping jaw 21 and the second clamping jaw 23, to apply an action force to the second clamping jaw 23. With the continuous delivery of the delivery device 17, the second clamping jaw 23 rotates around the second rotatable shaft 33 under the action force of the rod body and separates from the magnet on the first clamping jaw 21, and the wiping member can drop into the receiving module 15 under the action of gravity.

The first clamping jaw 21 is provided with a second groove used for the rod body to thread, and the second groove is opened toward the second clamping jaw 23. The second groove can guide the rod body to move toward the second clamping jaw 23, to ensure that the second clamping jaw 23 and the first clamping jaw 21 are separated.

FIG. 57 to FIG. 63 are accompanying drawings involved in a fifth embodiment of the present invention. The fifth embodiment provides a base station 200 for a cleaning robot 100 to park in, and an automatic cleaning system 300 equipped with the base station 200. The base station 200 may automatically replace a wiping member such as mopping paper or mopping cloth for the cleaning robot 100, thereby reducing intervention by a user and improving use experience of the user.

The base station 200 includes: a base belt 216, a plurality of wiping members arranged along the base belt 216 and detachably disposed on the base belt 216, a movable mechanism configured to drive the base belt 216 to move, and a wiping member operating position 218 used for the cleaning robot 100 to replace a wiping member. After a wiping member on the base belt 216 located at the wiping member operating position 218 is carried by the cleaning robot 100, a vacant region 222 is formed on the base belt. The movable mechanism can receive, in the vacant region 222, a wiping member 21*b* detached from the cleaning robot 100 and then move the base belt 216, to cause another wiping member 21*a* to be located at the wiping member operating position 218.

The base station 200 provided in this embodiment is provided with the base belt 216 driven by the movable mechanism to move and the wiping member operating position 218 for the cleaning robot 100 to replace a wiping member, so that the cleaning robot 100 enters the wiping member operating position 218 in need of replacing a wiping member, to place the used wiping member 21*b* in the vacant region 222 on the base belt 216, the base belt 216 is driven by the movable mechanism, to switch the to-be-used wiping member 21*a* to the wiping member operating position 218, and the cleaning robot 100 performs replacement with the to-be-used wiping member 21*a* and then completes automatic replacement of the wiping member. Therefore, the base station 200 of this embodiment can facilitate automatic replacement of the wiping member, reduce intervention by the user in replacement of the wiping member, and improve the use experience of the user.

The plurality of wiping members attaches to a surface of the base belt 216, and is arranged along an extending direction of the base belt 216. The base belt 216 is in a flat structure, and is made of a cloth material or paper material. The base belt 216 passes through the wiping member operating position 218, to carry a wiping member to the wiping member operating position 218 in the form of facing the cleaning robot 100. The cleaning robot 100 enters the wiping member operating position 218, but does not interfere with movement of the base belt 216. The base belt 216 may carry and deliver the wiping member, and in a process of carrying the wiping member, the wiping member may park in the wiping member operating position 218, to be replaced by the cleaning robot 100.

Figure 61:
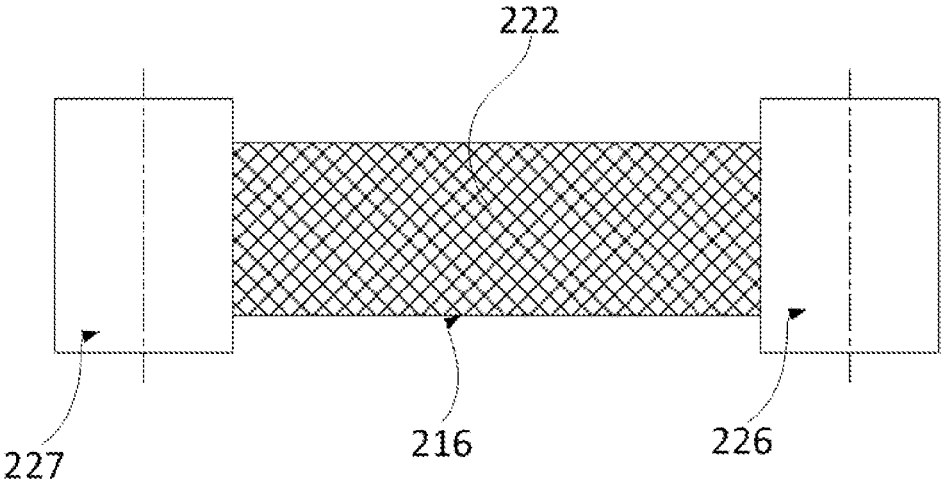
FIG. 61 is a schematic structural diagram of a base belt in a wiping member operating position in a state in FIG. 60.
Figure 62:
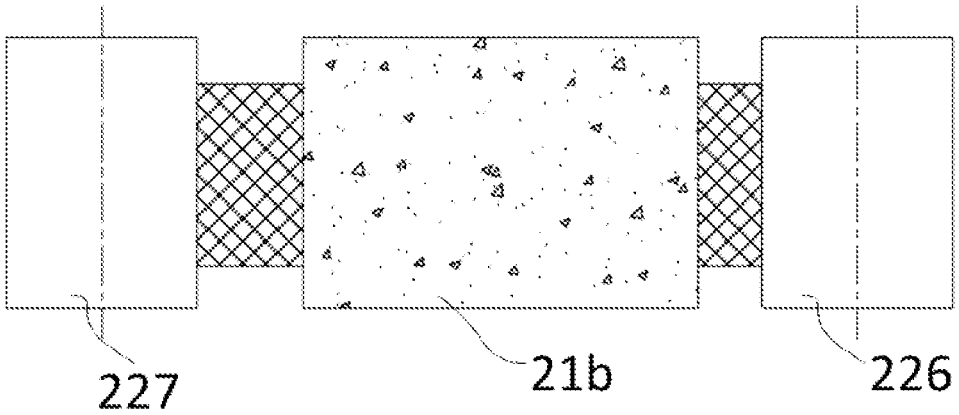
FIG. 62 is a schematic diagram of a structure in which a cleaning member detached from a cleaning robot is located on a base belt.

Wiping members may be continuously arranged on the base belt 216, and neighboring wiping members are not connected to each other. Two neighboring wiping members are spaced apart by a specific distance or closely adjacent to each other. Preferably, the plurality of wiping members is arranged at intervals on the base belt 216, and is distributed in a breakpoint form. The plurality of wiping members attaches to the surface of the base belt 216 at intervals along a length direction of the base belt 216, and neighboring wiping members are equal in spacing. A preset distance by which neighboring wiping members are spaced may cause only one wiping member to be attached to the base belt 216 in the wiping member operating position 218, for the cleaning robot 100 to perform replacement. As shown in FIG. 61, after the wiping member is carried and removed, the base belt 216 in the wiping member operating position 218 is in a vacant state, and no wiping member is attached in the vacant region 222. The vacant region 222 located in the wiping member operating position 218 is in a motionless state until receiving the used wiping member 21*b*, and the another to-be-used wiping member 21*a* is still wound around a second roller 227 and stored, to avoid a case that the to-be-used used wiping member 21*a* is unfolded in advance and exposed in air to affect a cleaning effect. Correspondingly, the used wiping member 21*b* is wound around a first roller 226 and is collected.

The plurality of wiping members sequentially moves to the wiping member operating position 218 along a moving direction of the base belt 216, to switch and move to the wiping member operating position 218 without repetition. In this way, it is ensured that a wiping member replaced by the cleaning robot 100 is an unused wiping member, to effectively clean the ground.

There is a specific storage space on the base station 200, to-be-used wiping members 21*a* may be stacked in the storage space, and the base belt 216 sequentially carries and removes the to-be-used wiping members through the storage space. Alternatively, the base belt 216 may be folded and stored in the storage space, and through pulling of the first roller 226, the base belt 216 carries the wiping member and moves out of the storage space together.

The base station 200 is provided with a first storage portion configured to store the to-be-used wiping member 21*a*, and a second storage portion configured to store a wiping member detached from the cleaning robot 100. The wiping member in the first storage portion moves to the wiping member operating position 218 through the base belt 216, is carried and detached by the cleaning robot 100 in the wiping member operating position 218, and then moves to the second storage portion. By disposing the second storage portion, the used wiping member 21*b* is automatically collected and stored.

The movable mechanism includes the first roller 226 that can rotate to be wound with the base belt 216, thereby driving the base belt 216 to move. The first roller 226 is wound with the base belt 216 to cause the base belt 216 to move, and movement of the base belt 216 may be used for conveying the used wiping member 21*b* to a designated region or designated storage space.

The first roller 226 is wound with the used wiping member 21*b* to form the foregoing second storage portion, to automatically collect the used wiping member 21*b*, thereby reducing intervention by the user. While being wound with the base belt 216, the first roller 226 is wound with the wiping member on the base belt 216 together, thereby collecting the used wiping member 21*b*. By disposing the first roller 226, the winding of the base belt 216 and the collection of the used wiping member 21*b* are combined, to automatically collect the used wiping member 21*b*, and the structure is simple, to facilitate manufacturing.

The base station 200 further includes the second roller 227 that can be wound with the base belt 216 and the to-be-used wiping member 21*a*. The first roller 226 is wound with the base belt 216, to drive the second roller 227 to synchronously release the base belt 216. As the base belt 216 is released, the to-be-used wiping member 21*a* enters the wiping member operating position 218 along with the base belt 216, for the cleaning robot 100 to perform replacement. In this way, collection of the used wiping member 21*b* and supply of the to-be-used wiping member 21*a* may be combined, to ensure that the cleaning robot 100 automatically replaces the wiping member smoothly. The second roller 227 is wound with the to-be-used wiping member 21*a* to form the foregoing first storage portion.

During use, a part of the base belt 216 is wound around the first roller 226, and a part of the base belt 216 may be wound around the second roller 227. In an initial state, most or all of the wiping member is wound around the second roller 227, and the first roller 226 is only wound with a part of the base belt 216 or the first roller 226 is only fixedly connected to one end of the base belt 216 and is not wound with the base belt 216. One wiping member is located at the wiping member operating position 218 or is mounted on a mopping board of the cleaning robot 100 in advance. When the cleaning robot 100 performs replacement, the wiping members on the base belt 216 are sequentially replaced to the cleaning robot 100.

The base belt 216 is wound layer by layer around the first roller 226 or the second roller 227, and an attaching space of the wiping member is formed between neighboring layers of the base belt 216. In this way, not only the base belt 216 can be used as a transmission member to drive the second roller 227 to rotate, to release and provide the to-be-used wiping member 21*a* to the wiping member operating position 218, but also the used wiping member 21*b* can be automatically collected.

One end of the base belt 216 is fixed to the first roller 226, and the other end is fixed to the second roller 227. The first roller 226 is driven to rotate, and the second roller 227 is driven through the base belt 216 to rotate. A driving mechanism such as a motor configured to drive the first roller 226 to rotate is disposed on the base station 200.

The base station 200 includes a casing, the first roller 226 and the second roller 227 are mounted on the casing in a manner in which rotatable shafts are parallel, the wiping member operating position 218 is located in the casing, and the first roller 226 and the second roller 227 are located outside the wiping member operating position 218. The casing has a bottom board 219, and a front board 228 and a back board 229 that are disposed on the bottom board 219. The front board 228 is provided with an access 2881 leading to the wiping member operating position 218, for the cleaning robot 100 to enter or move out of the wiping member operating position 218.

The front board 228 and the back board 229 cause the first roller 226 and the second roller 227 to be suspended, to make it convenient for the first roller 226 and the second roller 227 to rotate. The casing is provided with steering shafts 223 respectively on two sides of the wiping member operating position 218 in the horizontal direction, the second roller 227 is located above the wiping member operating position 218, and the base belt 216 passes through the steering shaft 223 from the second roller 227, has the extending direction changed, and then extends to the first roller 226.

The base belt 216 located at the wiping member operating position 218 is disposed close to the bottom board 219, and the wiping member is attached to the base belt 216 in the form of having the back facing the bottom board 219. To cause the base belt 216 and the bottom board 219 to be disposed in parallel, the steering shafts 223 disposed on the two sides of the wiping member operating position 218 in the horizontal direction are at the same height relative to the bottom board 219, and when passing through the steering shafts 223, the base belt 216 has the extending direction changed. The base belt 216 is in a stretched state or tightened state between the first roller 226 and the second roller 227, and therefore may cause the wiping member to face the cleaning robot 100 in an unfolded form in the wiping member operating position 218, making it convenient for the cleaning robot 100 to perform replacement.

The base station 200 is further provided with a positioning mechanism, configured to position the wiping member in the wiping member operating position 218. The positioning mechanism may be a structure positioning assembly, for example, a liftable obstruction board, the base belt 216 has a limit slot cooperating with the obstruction board. When the base belt 216 needs to be limited to motionlessness, the obstruction board is raised or unfolded, to stretch into the limit slot, to stop the base belt 216 and prevent the base belt 216 from moving. When the limit needs to be removed, the obstruction board is lowered and moved out of the limit slot, and the base belt 216 normally moves.

To implement automatic control and reduce operations of the user, the positioning mechanism includes a controller, and a measurement assembly configured to measure a quantity of loops by which a steering shaft 223 rotates, and the controller is configured to determine a position of the wiping member according to the quantity of loops measured by the measurement assembly. The measurement assembly may measure a quantity of loops by which either of the two steering shafts 223 rotates. After the base belt 216 carries the used wiping member 21*b*, an original loop quantity of each steering shaft 223 is zeroed out, and a loop quantity begins to be measured again; and when a designated loop quantity is reached, the base belt 216 is stopped from moving, and a next to-be-used wiping member 21*a* is moved to the wiping member operating position 218. Additionally, the controller may further determine, according to a loop quantity increased each time, the position of the wiping member carried by the base belt 216, and determine a quantity of the remaining to-be-used wiping members 21*a* through a finally accumulated loop quantity.

The cleaning robot 100 is provided with a universal wheel and a mopping board that are capable of moving up and down, and the universal wheel and the mopping board are retracted and lowered by moving up and down. The cleaning robot 100 has a cleaning mode and an obstacle crossing mode, and in the cleaning mode, the mopping board moves downward to support the cleaning robot 100, and the universal wheel is retracted. In the obstacle crossing mode, the mopping board is retracted, and the universal wheel is lowered to support the cleaning robot 100. The cleaning robot 100 in the obstacle crossing mode enters the wiping member operating position 218. A clamping mechanism is disposed on the mopping board, and the clamping mechanism has a clamping position of fixing the wiping member to the lower surface of the mopping board, and a release position of allowing the wiping member to be detached from the mopping board.

After the cleaning robot 100 carries a wiping member in the base station 200 located at the wiping member operating position 218 and moves the wiping member out of the wiping member operating position 218, the base belt 216 in the wiping member operating position 218 presents a vacant state in which no wiping member is disposed, to form the vacant region 222. When the cleaning robot 100 needs to replace the wiping member, the cleaning robot 100 switches from the cleaning mode to the obstacle crossing mode.

Figure 60:
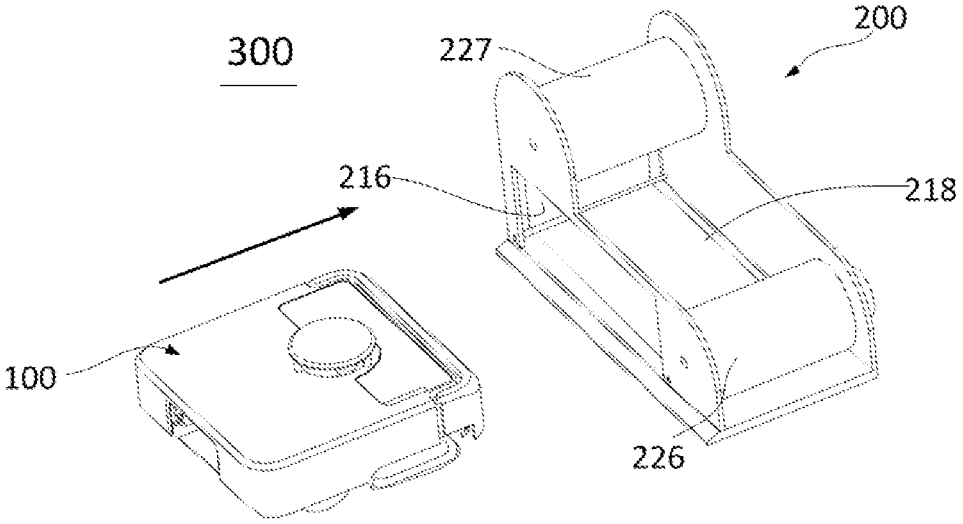
FIG. 60 is a schematic structural diagram when a cleaning robot prepares to enter a base station.

In the cleaning mode, the wiping member is clamped by the clamping mechanism and fixed to the mopping board, to clean the floor along with the mopping board. The mopping board moves downward to cause the wiping member to come into contact with the ground. In the obstacle crossing mode, the cleaning robot 100 is supported by using the universal wheel, and the mopping board moves upward to suspend the wiping member. With reference to FIG. 60 and FIG. 61, by using the obstacle crossing mode, the cleaning robot 100 approaches the base station 200 according to an instruction of the internal controller to enter the wiping member operating position 218 from the access 2881, and crosses above the base belt 216. In this case, the mopping board faces the vacant region 222. As shown in FIG. 63, the mopping board carrying the used wiping member 21*b* moves downward until the wiping member comes into contact with and is attached to the base belt 216.

In this case, the clamping mechanism switches from the clamping position to the release position, and the wiping member and the mopping board are separated. Then, the mopping board and the clamping mechanism move upward, and the used wiping member 21*b* is located on the base belt 216 in the wiping member operating position 218. Then, the first roller 226 is driven through the motor to rotate, to drive the base belt 216 to move, until a next to-be-used wiping member 21*a* is released from the second roller 227 and enters the wiping member operating position 218 along with the base belt 216. Correspondingly, the used wiping member 21*b* is wound around the first roller 226 together with the base belt 216.

Then, the mopping board moves downward until coming into contact with the to-be-used wiping member 21*a*. In this case, the clamping mechanism switches from the release position to the clamping position, to fix the wiping member to the lower surface of the mopping board, to complete mounting of the wiping member. Afterward, the mopping board then ascends, and the clamping mechanism is kept in the clamping position. In this way, replacement of the wiping member is completed. Then, the cleaning robot 100 in the obstacle crossing mode moves out of the base station 200 from the access 2881, and finally switches to the cleaning mode to perform cleaning. The base belt 216 keeps motionless until the cleaning robot 100 repeats the foregoing steps to place the used wiping member 21*b* and then perform replacement with the to-be-used wiping member 21*a*.

The automatic cleaning system 300 provided in this embodiment includes: a cleaning robot 100, and the base station 200 for the cleaning robot 100 to park in according to the foregoing embodiment. The cleaning robot 100 and the base station 200 can communicate. For example, the cleaning robot 100 and the base station 200 perform position information communication, or the base station 200 communicates with the cleaning robot 100 about information indicating whether a wiping member is located at the wiping member operating position 218.

The automatic cleaning system 300 or the base station 200 provided in this embodiment of this application may further include a reminding mechanism, configured to send a reminding signal when a quantity of to-be-used wiping members 21*a* is less than a predetermined quantity. If the length of the entire base belt 216 is specific, a loop quantity of the steering shaft 223 or the first roller 226 or the second roller 227 may be accumulated. When the loop quantity reaches a specific loop quantity, it indicates that the quantity of to-be-used wiping members 21*a* is less than the predetermined quantity. Certainly, the current diameter of the first roller 226 or the second roller 227 may be alternatively measured. When the diameter of the first roller 226 is greater than a preset diameter or the diameter of the second roller 227 is less than a predetermined diameter, it indicates that the quantity of to-be-used wiping members 21*a* is less than the predetermined quantity, and replacement with a new base belt 216 needs to be performed as a whole, to improve use experience of the user.

It should be noted that, in the descriptions of the present invention, terms "first" and "second" are only used to describe the objective and distinguish similar objects without a limitation on a sequence between the two, and cannot be understood as indicating or implying relative importance. In addition, in descriptions of the present invention, "a plurality of" means two or more, unless otherwise stated.

Only several embodiments of the present invention are described above. A person skilled in the art can make various modifications or variations to the embodiments of the present invention according to the content disclosed in the application document without departing from the spirit and scope of the present invention.

What is claimed is:

1. An automatic cleaning system, comprising: a cleaning robot including: a wiping board configured to receive and mount a wiper thereto forming a wiping surface, wherein the wiping board is detachable from the cleaning robot; and a mover configured to move the cleaning robot, wherein the wiping surface is configured to wipe a working surface as the cleaning robot moves; a base station including: a space to receive the cleaning robot, a carrier configured to convey the wiping board within the base station, wherein, to replace the wiper, the cleaning robot is received in the space of the base station and the wiping board is detached from the cleaning robot and coupled to the carrier, and wherein the carrier is configured to convey the wiping board to a first position within the base station to separate the wiper from the wiping board, and the carrier is configured to convey the wiping board to a second position within the base station to mount a replacement wiper to the wiping board a separator, at the first position, configured to act on the wiping board or the wiper to separate the wiper from the wiping board; and a recycling box configured to receive the wiper separated from the wiping board.

2. The automatic cleaning system of claim 1, wherein an opening of the recycling box is below the separator.

3. The automatic system of claim 1, wherein the separator is disposed at an opening of the recycling box.

4. The automatic system of claim 1, wherein the separator is disposed in the recycling box, and when the wiping board passes through the separator, the wiper on the wiping board is hooked and scraped off, causing the wiper to drop into the recycling box.

5. The automatic cleaning system of claim 1, wherein the base station further comprises:

a mounter, at the second position, configured to act on the wiping board to mount the replacement wiper to the wiping board.

6. The automatic cleaning system of claim 1, wherein the first position and the second position are the same.

7. The automatic cleaning system of claim 1, wherein the first position and the second position are disposed above the space to accommodate at least partially receiving the cleaning robot within the base station.

8. The automatic cleaning system of claim 1, wherein the base station further comprises: a driving module configured to drive a movement of carrier within the base station.

9. The automatic cleaning system of claim 8, wherein the carrier is configured to move the wiping board vertically within the base station.

10. The automatic cleaning system of claim 1, further comprising: a storage configured to store the replacement wiper prior to mounting to the wiping board.

11. The automatic cleaning system of claim 10, wherein the storage is detachably connected to the base station.

12. The automatic cleaning system of claim 1, wherein the base station further comprises: a wiping board operating position, the first position and second position are higher than the wiping board operating position.

13. The automatic cleaning system of claim 12, wherein the wiping board operating position comprises: a wiping board separating position configured to hold the wiping board separated by the cleaning robot; and a wiping board mounting position configured to hold the wiping board with a new wiper.

14. The automatic cleaning system of claim 13, wherein the wiping board separating position and the wiping board mounting position are the same.

15. A control method for the automatic cleaning system of claim 1, the control method comprising: controlling the cleaning robot to detach, from the cleaning robot, a wiping board connected to the cleaning robot, the wiping board having a wiper mounted thereon; controlling the separator to separate the wiper from the wiping board; and mounting a replacement wiper to the wiping board.

16. The control method of claim 15, wherein the detaching step further comprises coupling the wiping board to a carrier, and wherein the carrier conveys the wiping board between one or more locations of the detaching step, the separating step, and the mounting step.

17. The control method of claim 16, wherein the two or more of the locations of the detaching step, the separating step, and the mounting step, are the same.

18. The control method of claim 15, further comprising: mounting, to the cleaning robot, the wiping board combined with the replacement wiper.

* * * * *